US010381791B2

(12) United States Patent
Chen

(10) Patent No.: US 10,381,791 B2
(45) Date of Patent: Aug. 13, 2019

(54) COAXIAL CABLE CONNECTOR

(71) Applicant: EZCONN CORPORATION, Taipei (TW)

(72) Inventor: Han-Chung Chen, Taipei (TW)

(73) Assignee: EZCONN CORPORATION, Taipei (TW)

( * ) Notice: Subject to any disclaimer, the term of this patent is extended or adjusted under 35 U.S.C. 154(b) by 0 days.

(21) Appl. No.: 15/811,686

(22) Filed: Nov. 14, 2017

(65) Prior Publication Data

US 2018/0069354 A1 Mar. 8, 2018

Related U.S. Application Data

(63) Continuation of application No. 14/585,293, filed on Dec. 30, 2014, now Pat. No. 9,859,669.

(30) Foreign Application Priority Data

May 21, 2014 (TW) ..... 103208850 U

(51) Int. Cl.

| | |
|---|---|
| ***H01R 24/38*** | (2011.01) |
| ***H01R 24/40*** | (2011.01) |
| ***H01R 103/00*** | (2006.01) |
| ***H01R 9/05*** | (2006.01) |

(52) U.S. Cl.

CPC ..... *H01R 24/40* (2013.01); *H01R 9/05* (2013.01); *H01R 24/38* (2013.01); *H01R 2103/00* (2013.01)

(58) Field of Classification Search

CPC ..... H01R 9/05; H01R 9/0521; H01R 24/40; H01R 2103/00

USPC ..... 439/321, 578–585

See application file for complete search history.

(56) References Cited

U.S. PATENT DOCUMENTS

| | | | | |
|---|---|---|---|---|
| 7,544,094 | B1 * | 6/2009 | Paglia | H01R 9/0518 439/585 |
| 2010/0055978 | A1 * | 3/2010 | Montena | H01R 13/622 439/583 |
| 2010/0297871 | A1 * | 11/2010 | Haube | H01R 13/641 439/489 |
| 2012/0003869 | A1 * | 1/2012 | Ehret | H01R 13/622 439/578 |
| 2012/0244733 | A1 * | 9/2012 | Amidon | H01R 9/0518 439/271 |
| 2012/0282804 | A1 * | 11/2012 | Rodrigues | H01R 13/622 439/583 |
| 2013/0072048 | A1 * | 3/2013 | Schafer | H01R 13/622 439/372 |
| 2013/0130544 | A1 * | 5/2013 | Wei | H01R 9/05 439/584 |

(Continued)

*Primary Examiner* — Edwin A. Leon
*Assistant Examiner* — Oscar C Jimenez
(74) *Attorney, Agent, or Firm* — Min-Lee Teng; Litron Patent & Trademark Office

(57) ABSTRACT

A coaxial cable connector configured to be mounted to an externally threaded connector, comprising a nut portion having an inner thread configured to engage with an outer thread of said externally threaded connector, an inner-sleeve portion coaxially arranged with said nut and a first sleeve coaxially arranged with said nut, wherein said first sleeve comprises an inner flange radially on an outer wall of said inner-sleeve portion, characterized in that: when said nut is rotated relatively to said first sleeve, said inner-sleeve portion is rotated relatively to said first sleeve.

19 Claims, 76 Drawing Sheets

(56) References Cited

U.S. PATENT DOCUMENTS

| | | | | |
|---|---|---|---|---|
| 2013/0143438 | A1* | 6/2013 | Wilson | H01R 9/0524<br>439/578 |
| 2014/0004739 | A1* | 1/2014 | Ehret | H01R 13/622<br>439/578 |
| 2015/0295368 | A1* | 10/2015 | Wilson | H01R 9/0524<br>439/578 |
| 2015/0325932 | A1* | 11/2015 | Ehret | H01R 13/622<br>439/584 |
| 2016/0072204 | A1* | 3/2016 | Edmonds | H01R 9/0521<br>439/583 |
| 2016/0181742 | A1* | 6/2016 | Wilson | H01R 9/0524<br>439/578 |
| 2016/0248178 | A1* | 8/2016 | Hammons | H01R 9/0524 |
| 2017/0093054 | A1* | 3/2017 | Edmonds | H01R 9/0521 |
| 2018/0062307 | A1* | 3/2018 | Thakare | H01R 13/622 |
| 2018/0233836 | A1* | 8/2018 | Ehret | H01R 13/622 |

* cited by examiner

COAXIAL CABLE CONNECTOR

This application is a continuation of application Ser. No. 14/585,293, filed Dec. 30, 2014, which claims priority of Taiwan Patent Application No. 103208850, filed on May 21, 2014, all of which are incorporated herein by reference in their entirety.

BACKGROUND OF THE DISCLOSURE

Field of the Disclosure

The present disclosure relates to a coaxial cable connector, and more particularly to a coaxial cable connector with improved electric properties.

Brief Description of the Related Art

A conventional screw-type coaxial cable connector has poor connection for the ground reference since the coaxial cable connector has a nut, when engaging with a thread interface of an externally threaded connector, not fully contacting an inner sleeve of the coaxial cable connector, and the inner sleeve does not fully contact the externally threaded connector. Besides, the coaxial cable connector could be pulled back such that the nut and the inner sleeve are loosely connected with the externally threaded connector and the performance of signal transmission becomes poor.

SUMMARY OF THE DISCLOSURE

The present disclosure provides a coaxial cable connector including a nut portion and an inner-sleeve portion integrally formed as a single part with the nut portion. With the nut portion rotating relatively to an outer sleeve of the coaxial cable connector, the inner-sleeve portion may rotate relatively to the outer sleeve. When the coaxial cable connecter is assembled with a coaxial cable, the inner sleeve portion may have good electrical ground connection with a braided layer, i.e. ground lines, of the coaxial cable. When the coaxial cable connector is assembled with an externally threaded connector of an electronic device, no matter whether the nut portion is fully or loosely engaged with the externally threaded connector, good electrical ground connection may be provided and the quality of signal transmission may be improved.

The present disclosure provides a coaxial cable connector configured to engage with an externally threaded connector of an electronic device. The coaxial cable connector includes a nut portion configured to engage with the externally threaded connector, an inner-sleeve portion coaxial with the nut portion and a first sleeve coaxial with the nut portion, wherein the first sleeve has an inner flange radially on and around the inner-sleeve portion, characterized in that with the nut portion rotating relatively to the first sleeve, the inner-sleeve portion may rotate relatively to the first sleeve.

The present disclosure provides a coaxial cable connector configured to engage with an externally threaded connector of an electronic device. The coaxial cable connector includes a nut portion configured to engage with the externally threaded connector, an inner-sleeve portion coaxial with the nut portion and a first sleeve coaxial with the nut portion, wherein the first sleeve has an inner flange radially on and around the inner-sleeve portion, wherein a first annular space between the first sleeve and the inner-sleeve portion is configured to receive a peripheral portion of a coaxial cable, wherein the inner-sleeve portion is configured to be arranged between a second annular space between the peripheral portion of the coaxial cable and a central portion of the coaxial cable, characterized in that the inner-sleeve portion is configured to rotate around the central portion of the coaxial cable.

The present disclosure provides a coaxial cable connector configured to engage with an externally threaded connector of an electronic device. The coaxial cable connector includes a nut portion configured to engage with the externally threaded connector, an inner-sleeve portion coaxial with the nut portion, a first sleeve coaxial with the nut portion and a second sleeve around the inner-sleeve portion and between the inner-sleeve portion and the first sleeve, wherein an annular space between the first sleeve and the second sleeve is configured to receive a plastic jacket of a coaxial cable.

These, as well as other components, steps, features, benefits, and advantages of the present disclosure, will now become clear from a review of the following detailed description of illustrative embodiments, the accompanying drawings, and the claims.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same reference number or reference indicator appears in different drawings, it may refer to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
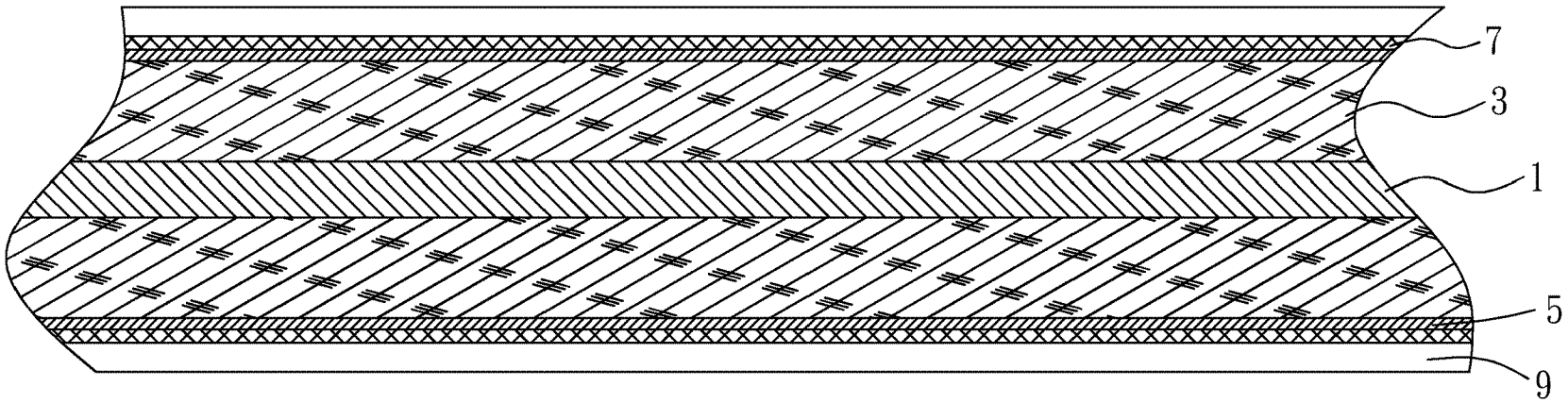
FIG. 1 shows a cross-sectional view of a coaxial cable in accordance with the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

FIG. 1 shows a cross-sectional view of a coaxial cable in accordance with the present invention. Referring to FIG. 1, the coaxial cable includes a metal wire 1, an insulating layer 3 enclosing the metal wire 1, a thin metal film 5 enclosing the insulating layer 3, a metal braided film 7 enclosing the thin metal film 5, and a plastic jacket 9 enclosing the metal braided layer 7. The metal wire 1 may be made of copper, iron, silver, nickel, a tin-gold alloy, a copper-gold alloy, a copper-tin alloy, a copper-nickel alloy, a conductive polymer or a non-metallic conductor. The thin metal film 5 may be made of an aluminum-containing layer, a copper-containing layer or an electrically conducting layer, such as aluminum foil or copper foil. The thin metal film may have a function for electrical shielding, and thereby interference may be reduced. The metal braided film 7 may be two-layer braided, three-layer braided or four-layer braided and may be made of aluminum, an aluminum alloy, copper or a copper alloy, for example.

The present disclosure is provided with multiple embodiments having many features that may be mutually combined together, mentioned as below.

First Embodiment

Figure 2A:
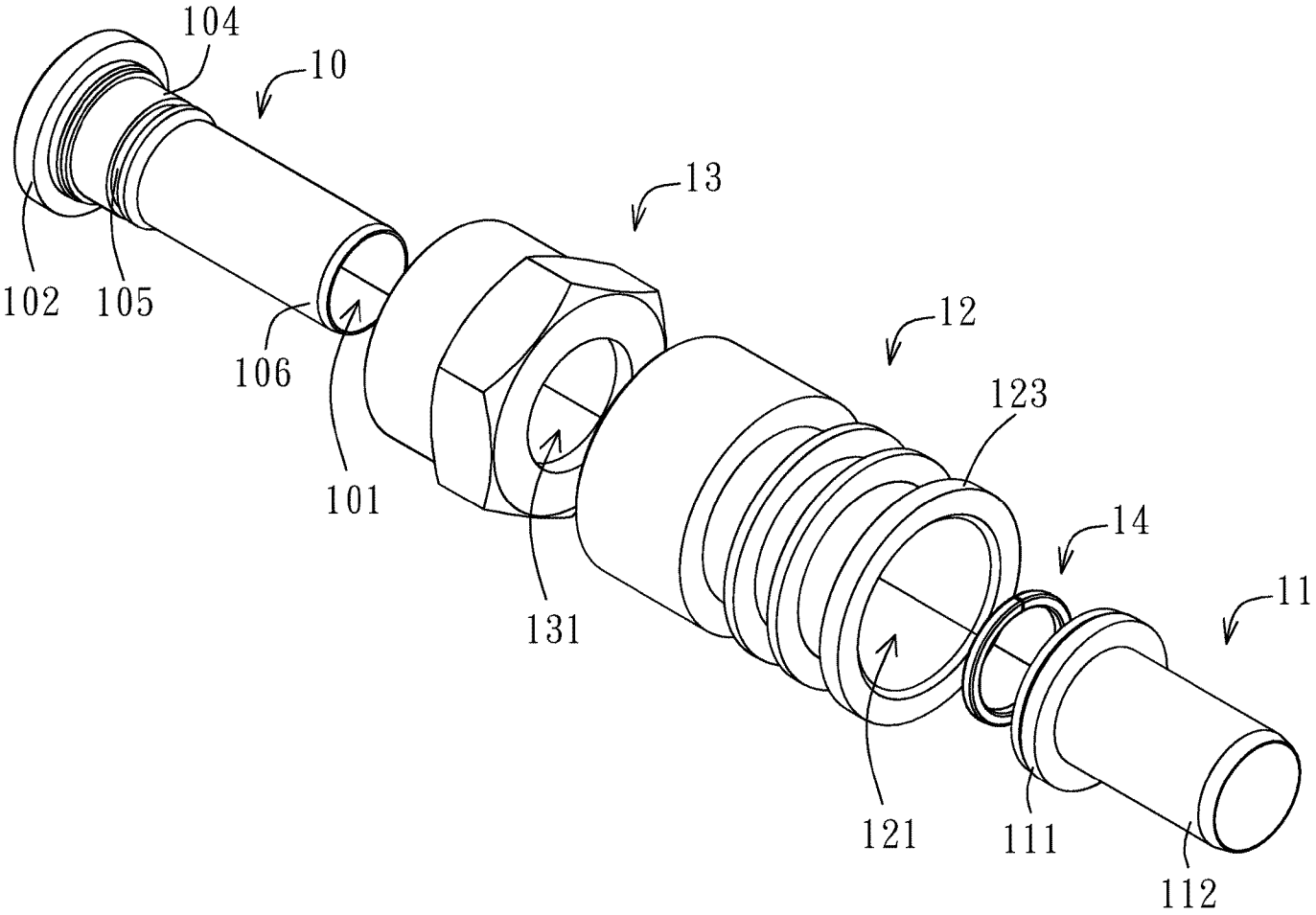
FIG. 2*a* shows a perspective exploded view of a coaxial cable connector in accordance with a first embodiment of the present invention.
Figure 2B:
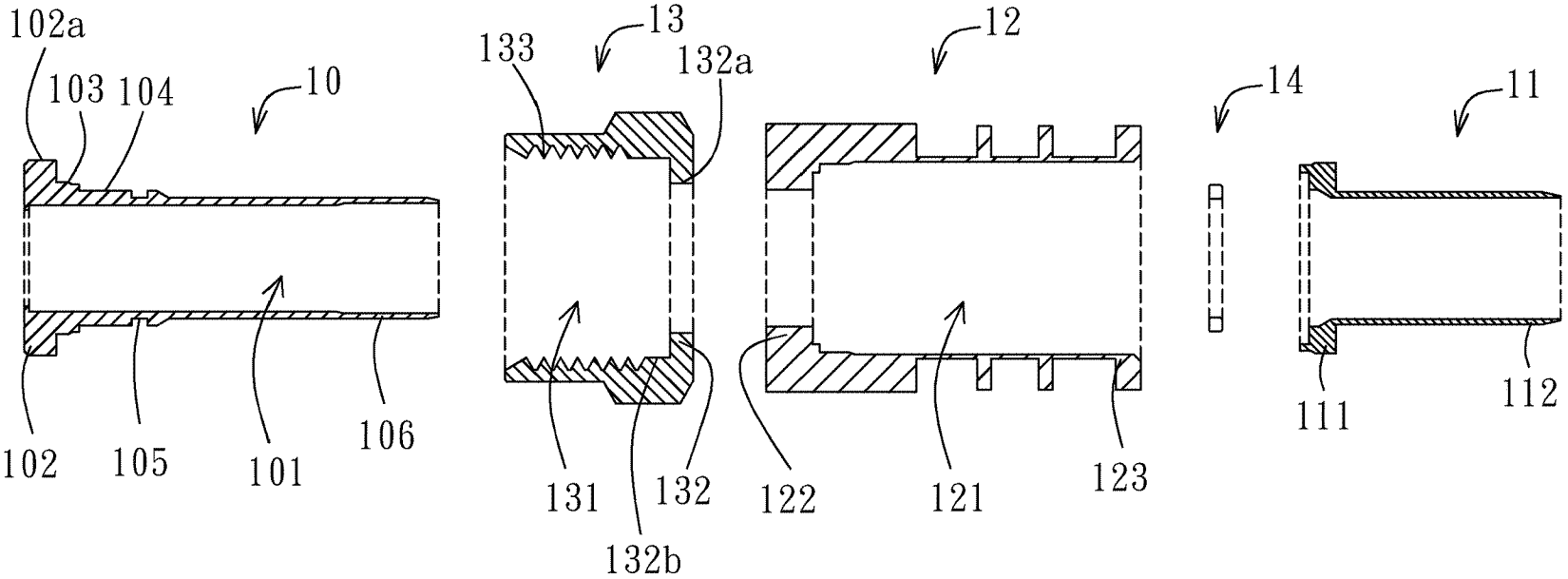
FIG. 2*b* shows a cross-sectional view of each element of the coaxial cable connector in accordance with the first embodiment of the present invention.
Figure 2C:
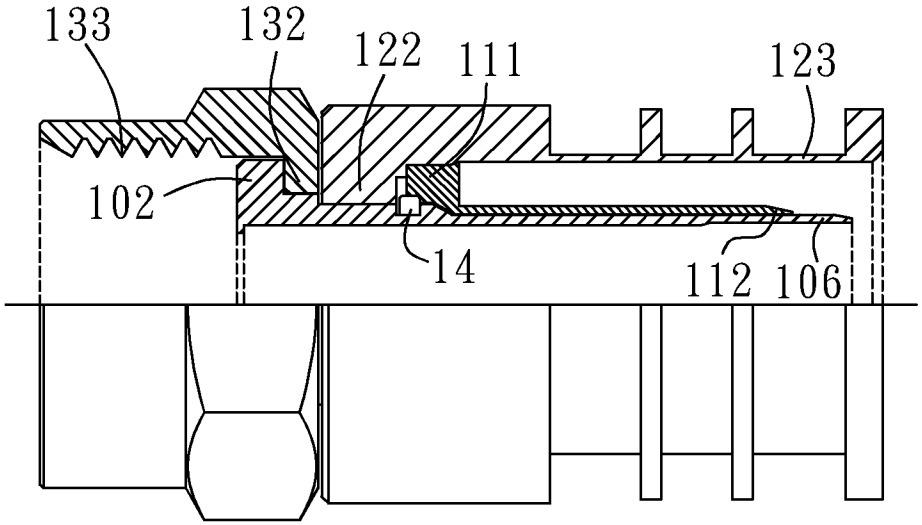
FIG. 2*c* shows a cross-sectional view of the coaxial cable connector in accordance with the first embodiment of the present invention.
Figure 2D:
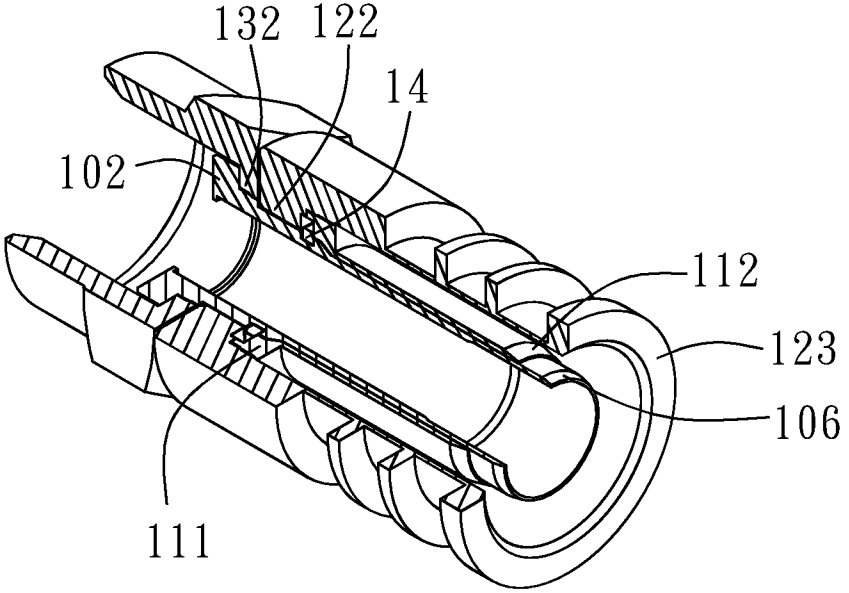
FIG. 2*d* shows a three-quarter cross-sectional perspective view of the coaxial cable connector in accordance with the first embodiment of the present invention.

FIG. 2*a* shows a perspective exploded view of a coaxial cable connector in accordance with a first embodiment of the present invention. FIG. 2*b* shows a cross-sectional view of each element of the coaxial cable connector in accordance with the first embodiment of the present invention. FIG. 2*c* shows a cross-sectional view of the coaxial cable connector in accordance with the first embodiment of the present invention. FIG. 2*d* shows a three-quarter cross-sectional perspective view of the coaxial cable connector in accordance with the first embodiment of the present invention. Referring to FIGS. 2*a*-2*d*, the coaxial cable connector includes a first inner sleeve 10, a second inner sleeve 11, an outer sleeve 12, a nut 13 and a locking ring 14 coaxially arranged and is configured to be assembled with the coaxial cable as shown in FIG. 1. Each of the first inner sleeve 10, second inner sleeve 11, outer sleeve 12, nut 13 and locking ring 14 may be made of copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the first inner sleeve 10, second inner sleeve 11, outer sleeve 12, nut 13 and locking ring 14. The locking ring 14 may be a C-shaped metal ring.

The first inner sleeve 10 may include an outer flange 102, a first cylindrical surface 103, a second cylindrical surface 104 and a rear extension portion 106. The first cylindrical surface 103 is formed between the outer flange 102 and the second cylindrical surface 104 in the axial direction; the second cylindrical surface 104 is formed between the first cylindrical surface 103 and a groove 105 in the axial direction; the groove 105 is circumferentially formed in an outer cylindrical wall of the first inner sleeve 10 and between the second cylindrical surface 104 and the rear extension portion 106 in the axial direction. The second inner sleeve 11 may include an outer flange 111 and a rear extension portion 112. The nut 13 includes an inner flange 132 and an inner thread 133. The outer sleeve 12 may include an inner flange 122 and a rear extension portion 123, wherein the rear extension portion 123 has an inner diameter greater than an outer diameter of the rear extension portion 106 and then an outer diameter of the rear extension portion 112, and the rear extension portion 112 has an inner diameter greater than an outer diameter of the rear extension portion 106. The rear extension portion 112 has an axial length less than that of the rear extension portion 106. The nut 13 may be a hex nut, square nut, ring nut, wing nut or any other type of nut, which may be assembled with an externally threaded connector of an electronic device using a wrench or other tools.

The assembly for the coaxial cable connector in the first embodiment is mentioned as below. First, the first inner sleeve 10 has the rear extension portion 106 inserted into a through hole 131 in the nut 13 from a front end of the nut 13 and then the nut 13 is fixed, e.g., by way of tightly fitting, tolerance fitting, sintered metal bonding or adhesive bonding, with the first inner sleeve 10 such that the inner flange 132 of the nut 13 has an inner cylindrical surface 132*a* tightly fitted with or securely fixed with the first cylindrical surface 103 of the first inner sleeve 10 and the outer flange 102 of the first inner sleeve 10 has an outer cylindrical surface 102*a* tightly fitted with or securely fixed with an inner cylindrical wall 132*b* of the nut 13. The inner cylindrical wall 132*b* is formed between the inner thread 133 and the inner flange 132. Next, the rear extension portion 106 is inserted into a through hole 121 in the outer sleeve 12 such that the outer sleeve 12 has the inner flange 122 sleeved around the second cylindrical surface 104 of the first inner sleeve 10. Next, the locking ring 14 is moved into the through hole 121 in the outer sleeve 12 from the rear extension portion 123 of the outer sleeve 12 so as to be fixed in the groove 105 circumferentially formed in the outer cylindrical wall of the first inner sleeve 10. Thereby, the locking ring 14 may abut against the inner flange 122 of the outer sleeve 12 to lock the inner flange 122 around the second cylindrical surface 104 of the first inner sleeve 10 and to prevent the outer sleeve 12 from moving in the axial direction away from the nut 13. Next, the second inner sleeve 11 is moved into the through hole 121 in the outer sleeve 12 from the rear extension portion 123 of the outer sleeve 12 so as to be arranged in an annular space between the first inner sleeve 10 and the outer sleeve 12. The outer flange 111 of the second inner sleeve 11 may have an outer cylindrical surface to be fixed, e.g., by way of tightly fitting, tolerance fitting, sintered metal bonding or adhesive bonding, with an inner cylindrical wall of the outer sleeve 12. The way to fix the outer flange 111 of the second inner sleeve 11 with the inner cylindrical wall of the outer sleeve 12 may be the same as the way to fix the nut 13 with the first inner sleeve 10. The locking ring 14 is arranged between the inner flange 122 of the outer sleeve 12 and the outer flange 111 of the second inner sleeve 11 and to prevent the first inner sleeve 10 from moving in the axial direction relatively to the outer sleeve 12. The rear extension portion 106 is concentrically surrounded by the rear extension portion 112 that is concentrically surrounded by the rear extension portion 123. When the nut 13 is rotated relatively to the second inner sleeve 11 and the outer sleeve 12, the first inner sleeve 10 may also rotate relatively to both of the second inner sleeve 11 and the outer sleeve 12 due to the rear extension portion 112 having an inner diameter greater than an outer diameter of the rear extension portion 106 and the nut 13 being fixed with the first inner sleeve 10.

Figure 2E:
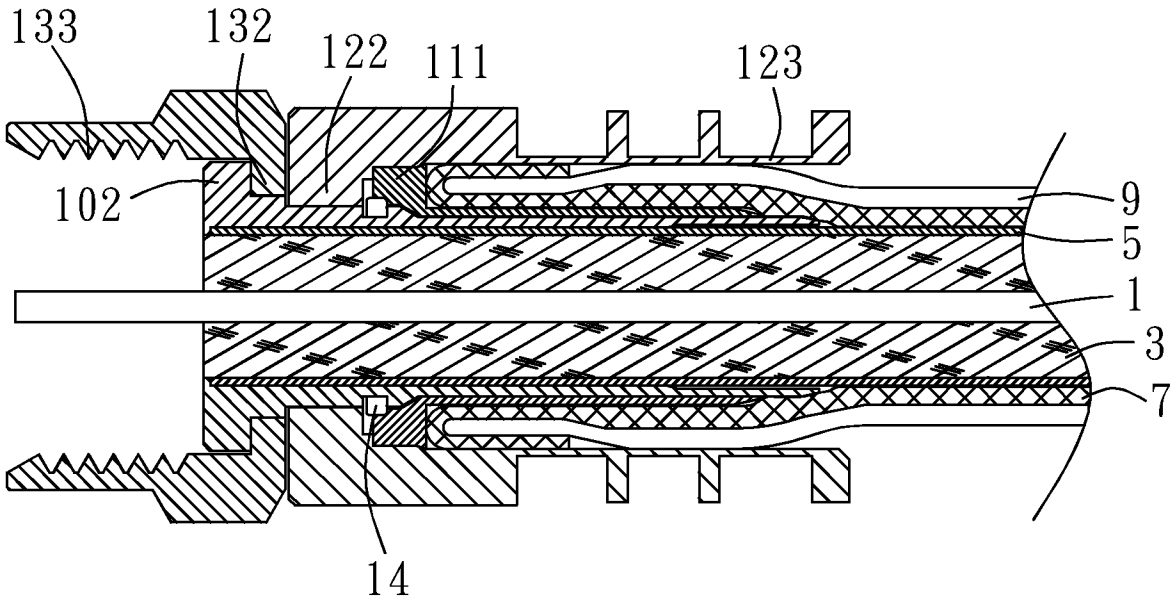
FIG. 2*e* shows a cross-sectional view of the coaxial cable connector assembled with a coaxial cable in accordance with the first embodiment of the present invention.

Referring to FIG. 2*e*, for assembling the coaxial cable as illustrated in FIG. 1 with the coaxial cable connector as illustrated in the first embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the first inner sleeve 10 into a through hole 101 in the first inner sleeve 10 and the folded front portion of the metal braided film 7 and the plastic jacket 9 are inserted from a back end of the outer sleeve 12 into the annular space between the rear extension portion 112 of the second inner sleeve 11 and the rear extension portion 123 of the outer sleeve 12. The metal wire 1 extends through the through hole 101 in the first inner sleeve 10 and to a space, surrounded by the inner thread 133 of the nut 13, outside the through hole 101. Next, a radial force may be applied to the outer sleeve 12 to be inwardly deformed such that the outer sleeve 12 and the second inner sleeve 11 may tightly clamp the coaxial cable in the annular space between the rear extension portions 112 and 123. Thereby, the coaxial cable connector may be assembled with the coaxial cable and good electrical ground connection between the nut 13 and the metal braided film 7 may be provided.

Figure 2F:
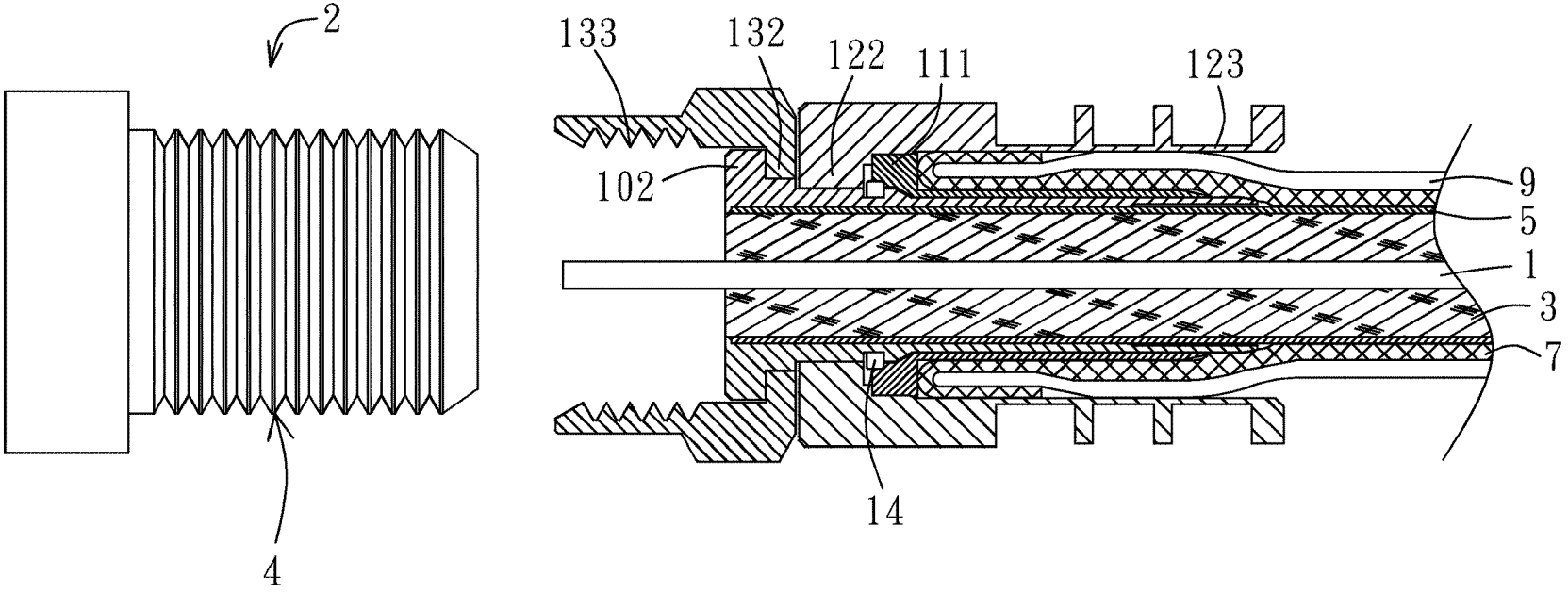
FIGS. 2*f* and 2*g* shows cross-sectional views of the coaxial cable connector before and after assembled with an externally threaded connector in accordance with the first embodiment of the present invention.
Figure 2G:
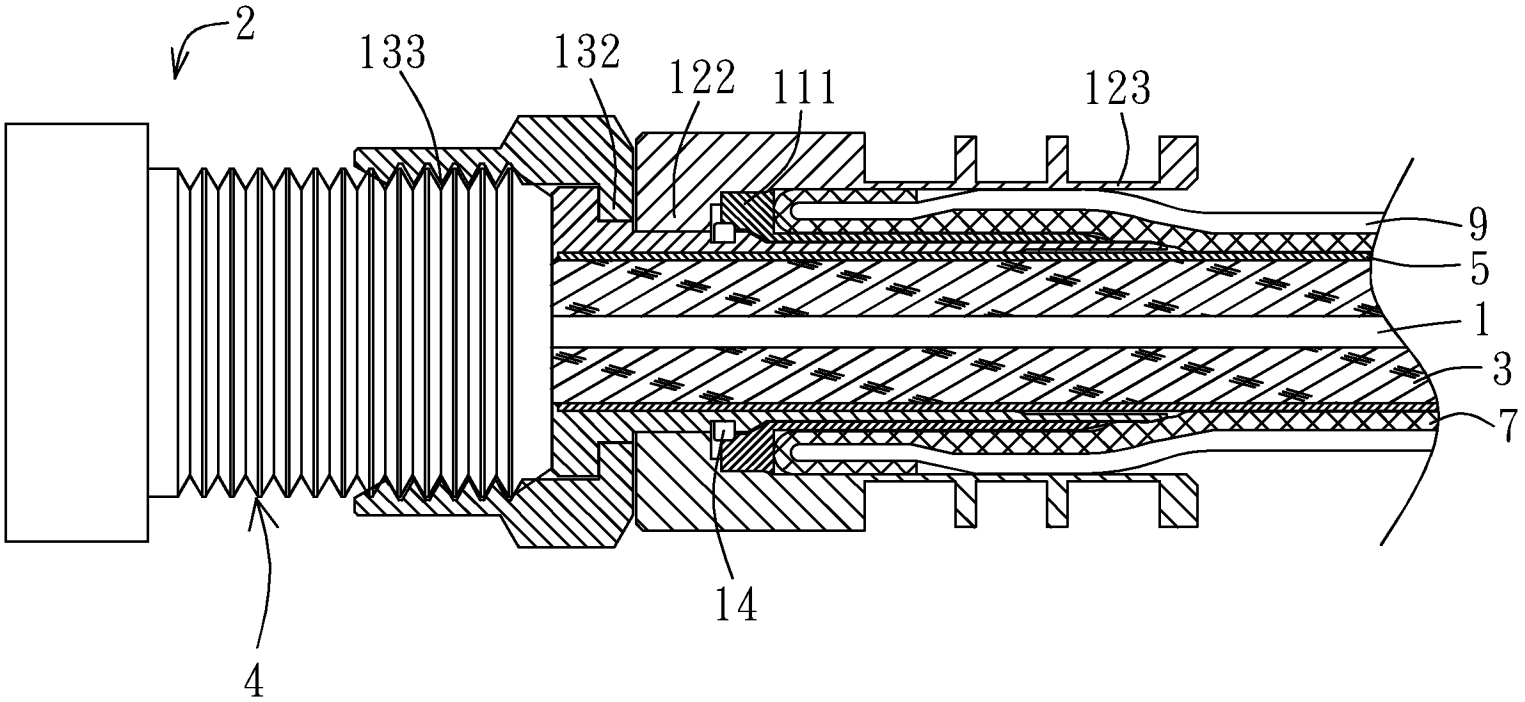

Referring to FIGS. 2*f* and 2*g*, the coaxial cable connector may be locked to an externally threaded connector 2 mounted on an electronic device or an adapter, such as a T-shaped or F-shaped adaptor, for connecting the coaxial cable to another coaxial cable. The coaxial cable assembled with the coaxial cable connector may have the metal wire 1 to be inserted into a hole in the externally threaded connector 2 and the nut 13 has the inner thread 133 engaging with an outer thread 4 of the externally threaded connector 2 so as to be screwed on the externally threaded connector 2. When the nut 13 is being screwed on the externally threaded connector 2, the first inner sleeve 10 has the rear extension portion 106 rotating in the annular space between the plastic jacket 9 of the coaxial cable and the insulating layer 3 of the coaxial cable, due to the nut 13 being firmly fixed with the first inner sleeve 10, and the outer flange 102 of the first inner sleeve 10 may move to the externally threaded connector 2 in the axial direction until the outer flange 102 of the first inner sleeve 10 abuts against a front end of the externally threaded connector 2. Thereby, the nut 13 may be firmly fixed with the first inner sleeve 10 so as to provide good connection between the nut 13 and the first inner sleeve 10. Accordingly, when the nut 13 accompanying with the first inner sleeve 10 is rotated relatively to the outer sleeve 12 and the second inner sleeve 11, the first inner sleeve 10 may have good electrical ground connection to the metal braided layer 7. No matter whether the nut 13 is fully or loosely locked to the externally threaded connector 2, good electrical ground connection may be provided to ensure good signal transmission.

Figure 2H:
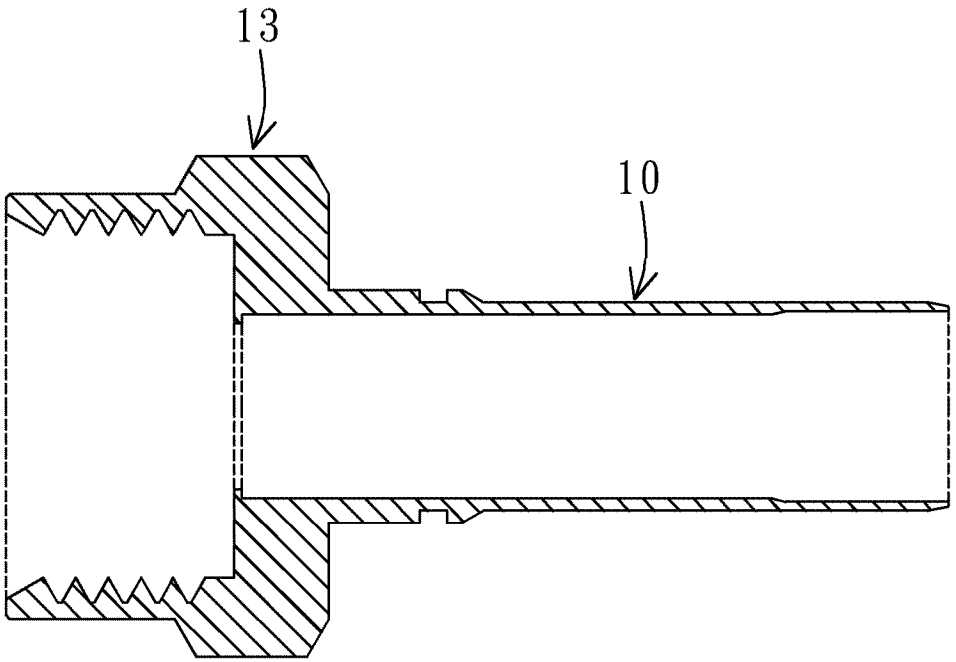
FIG. 2*h* shows a cross-sectional view of the coaxial cable connector having an inner-sleeve portion, i.e., first inner sleeve, and a nut portion integrally formed as a single part in accordance with the first embodiment of the present invention.

Alternatively, the first inner sleeve 10 and the nut 13 may be integrally formed as a single part, as shown in FIG. 2*h*. The single part may be divided into a net portion, derived from the net 13, and an inner-sleeve portion, derived from the first inner sleeve 10. The net portion and the inner-sleeve portion may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the single part.

The first inner sleeve, second inner sleeve, outer sleeve, nut and locking ring mentioned in the following embodiments may have the same material as the first inner sleeve 10, second inner sleeve 11, outer sleeve 12, nut 13 and locking ring 14 mentioned in the first embodiment.

Second Embodiment

Figure 3A:
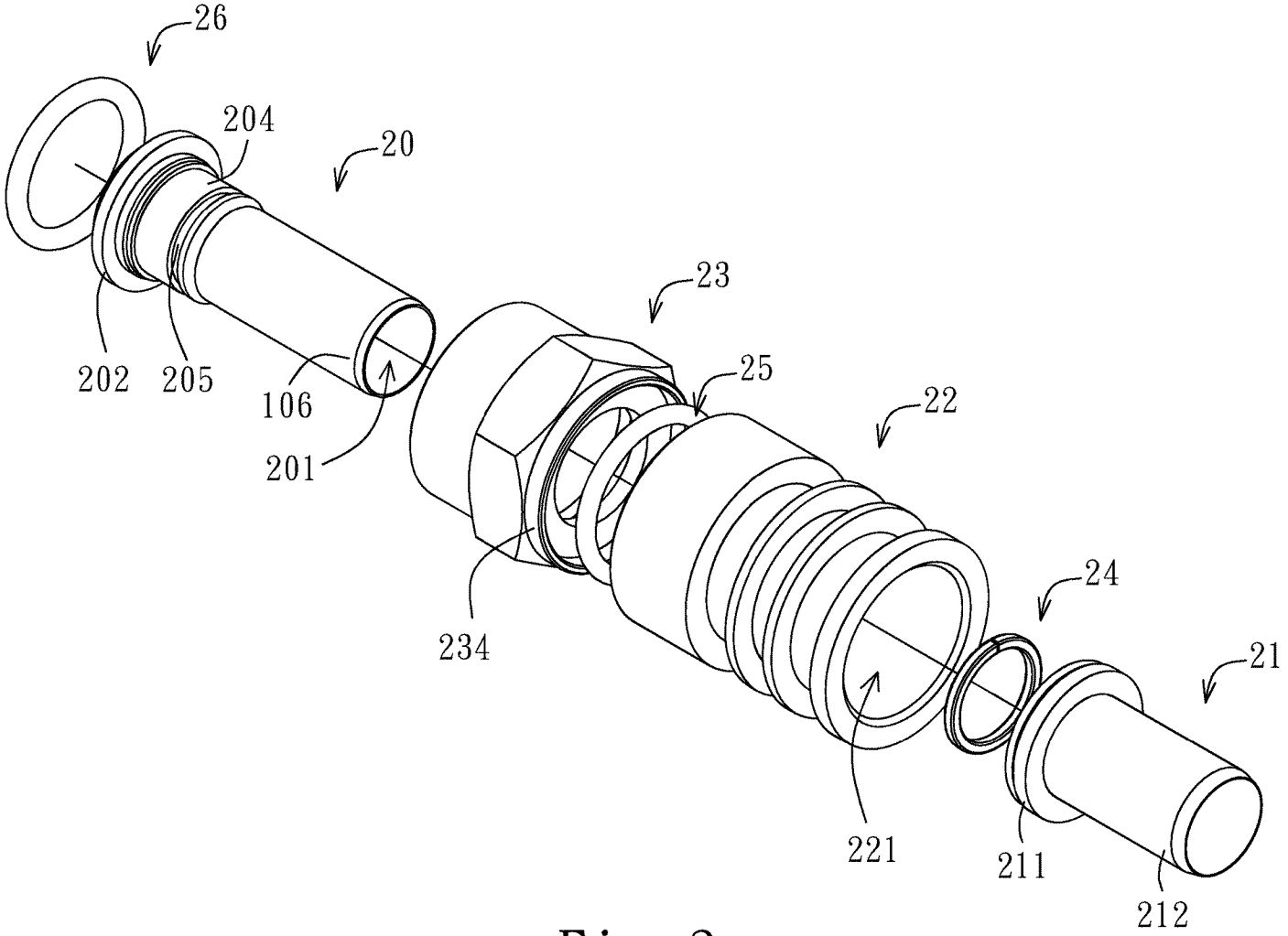
FIG. 3*a* shows a perspective exploded view of a coaxial cable connector in accordance with a second embodiment of the present invention.
Figure 3B:
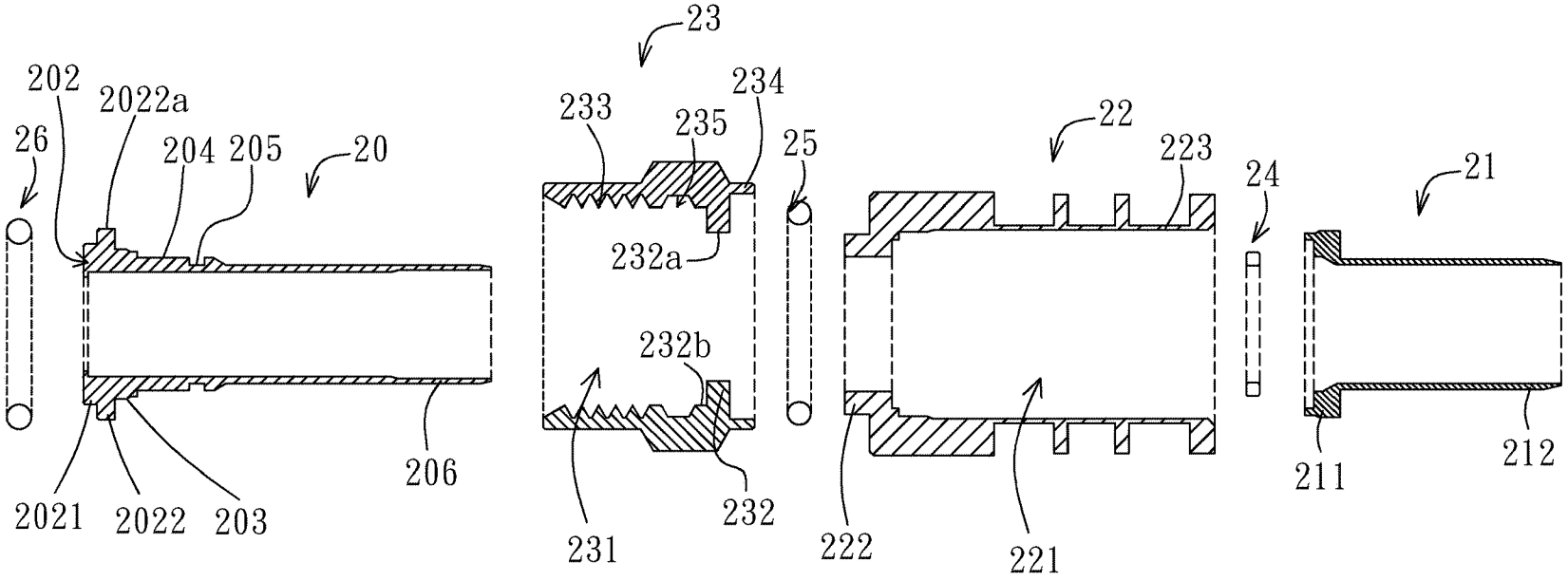
FIG. 3*b* shows a cross-sectional view of each element of the coaxial cable connector in accordance with the second embodiment of the present invention.
Figure 3C:
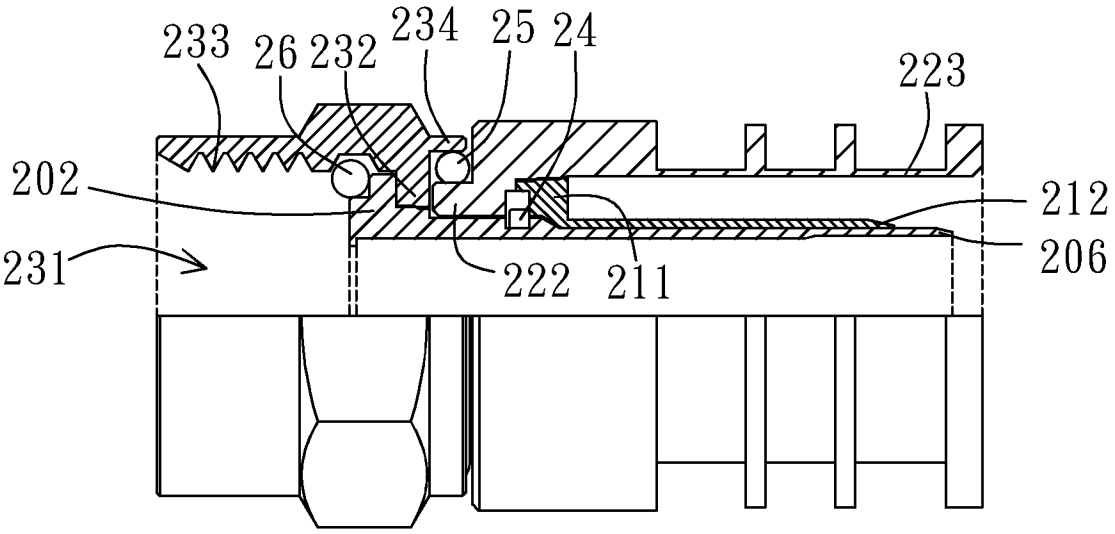
FIG. 3*c* shows a cross-sectional view of the coaxial cable connector in accordance with the second embodiment of the present invention.
Figure 3D:
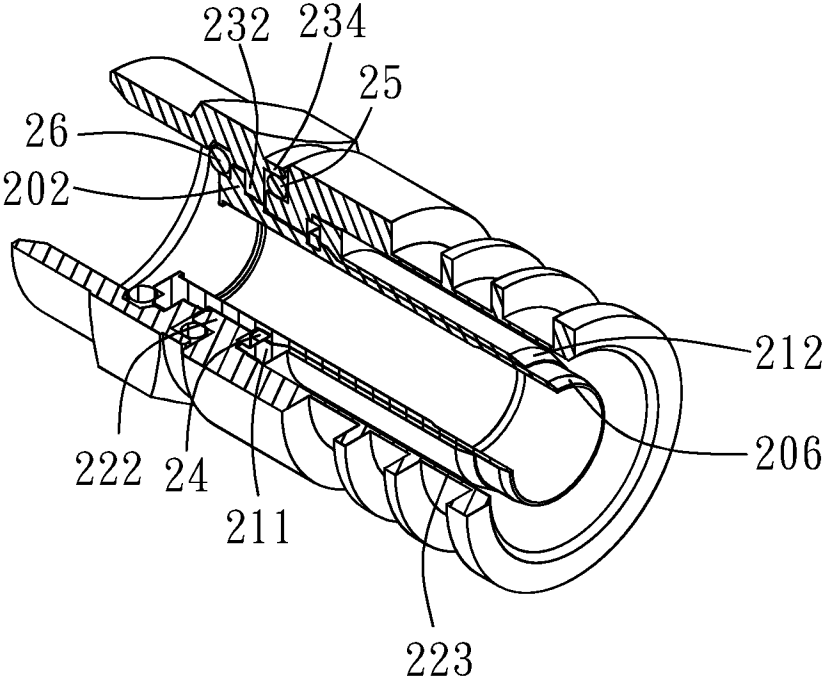
FIG. 3*d* shows a three-quarter cross-sectional perspective view of the coaxial cable connector in accordance with the second embodiment of the present invention.

FIG. 3*a* shows a perspective exploded view of a coaxial cable connector in accordance with a second embodiment of the present invention. FIG. 3*b* shows a cross-sectional view of each element of the coaxial cable connector in accordance with the second embodiment of the present invention. FIG. 3*c* shows a cross-sectional view of the coaxial cable connector in accordance with the second embodiment of the present invention. FIG. 3*d* shows a three-quarter cross-sectional perspective view of the coaxial cable connector in accordance with the second embodiment of the present invention. Referring to FIGS. 3*a*-3*d*, the coaxial cable connector includes a first inner sleeve 20, a second inner sleeve 21, an outer sleeve 22, a nut 23, a locking ring 24, a first elastic ring 25 and a second elastic ring 26 coaxially arranged. The first and second elastic rings 25 and 26 may be made of a rubber, a non-conductive polymer, a conductive polymer or conductive rubber. The locking ring 14 may be a C-shaped metal ring.

The first inner sleeve 20 may include an outer flange 202, a first cylindrical surface 203, a second cylindrical surface 204 and an rear extension portion 206, wherein the outer flange 202 includes a first protruding portion 2021 and a second protruding portion 2022 composing an annular step, and the second protruding portion 2022 has an outer diameter greater than that of the first protruding portion 2021. The second protruding portion 2022 is formed between the first protruding portion 2021 and the first cylindrical surface 203 in the axial direction; the first cylindrical surface 203 is formed between the second protruding portion 2022 and the second cylindrical surface 204 in the axial direction; the second cylindrical surface 204 is formed between the first cylindrical surface 203 and a groove 205 in the axial direction; the groove 205 is circumferentially formed in an outer cylindrical wall of the first inner sleeve 20 and between the second cylindrical surface 204 and the rear extension portion 206 in the axial direction. The second inner sleeve 21 may include an outer flange 211 and a rear extension portion 212. The nut 23 includes an inner flange 232, an inner thread 233, a rear extension portion 234 and a recess portion 235, wherein the recess portion 235 is circumferentially formed in an inner cylindrical wall of the nut 23 and between the inner flange 232 and the inner thread 233 in the axial direction. The outer sleeve 22 includes an inner flange 222 and a rear extension portion 223, wherein the rear extension portion 223 has an inner diameter greater than an outer diameter of the rear extension portion 206 and then an outer diameter of the rear extension portion 212, and the rear extension portion 212 has an inner diameter greater than an outer diameter of the rear extension portion 206. The rear extension portion 212 has an axial length less than that of the rear extension portion 206. The nut 23 may be a hex nut, square nut, ring nut, wing nut or any other type of nut, which may be assembled with an externally threaded connector of an electronic device using a wrench or other tools.

The assembly for the coaxial cable connector in the second embodiment is mentioned as below. First, the first inner sleeve 20 has the rear extension portion 206 inserted into a through hole 231 in the nut 23 from a front end of the nut 23 and then the nut 23 is fixed, e.g., by way of tightly fitting, tolerance fitting, sintered metal bonding or adhesive bonding, with the first inner sleeve 20 such that the inner flange 232 of the nut 23 has an inner cylindrical surface 232*a* tightly fitted with or securely fixed with the first cylindrical surface 203 of the first inner sleeve 20 and the second protruding portion 2022 has an outer cylindrical surface 2022*a* tightly fitted with or securely fixed with an inner cylindrical surface 232*b* of the nut 23. The inner cylindrical surface 232*b* is formed between the recess portion 235 and the inner flange 232 in the axial direction. Next, the first elastic ring 25 is inserted into an annular space between the rear extension portion 234 of the nut 23 and the second cylindrical surface 204 of the first inner sleeve 20 and abuts against an inner cylindrical surface of the rear extension portion 234 of the nut 23. Next, the rear extension portion 206 is inserted into a through hole 221 in the outer sleeve 22 such that the outer sleeve 22 has the inner flange 222 sleeved around the second cylindrical surface 204 of the first inner sleeve 20 and the first elastic ring 25 may be fixed by an annular step of the outer sleeve 22 and an annular step of the nut 23 in order to prevent water vapor from penetrating into the coaxial cable connector. Next, the locking ring 24 is moved into the through hole 221 in the outer sleeve 22 from the rear extension portion 223 of the outer sleeve 22 so as to be fixed in the groove 205 circumferentially formed in the outer cylindrical wall of the first inner sleeve 20. Thereby, the locking ring 24 may abut against the the inner flange 222 of the outer sleeve 22 to lock the inner flange 222 around the second cylindrical surface 204 of the first inner sleeve 20 and to prevent the outer sleeve 22 from moving in the axial direction away from the nut 23. Next, the second inner sleeve 21 is moved into the through hole 221 in the outer sleeve 22 from the rear extension portion 223 of the outer sleeve 22 so as to be arranged in an annular space between the first inner sleeve 20 and the outer sleeve 22. The outer flange 211 of the second inner sleeve 21 may have an outer cylindrical surface to be fixed, e.g., by way of tightly fitting, tolerance fitting, sintered metal bonding or adhesive bonding, with an inner cylindrical wall of the outer sleeve 22. The way to fix the outer flange 211 of the second inner sleeve 21 with the inner cylindrical wall of the outer sleeve 22 may be the same as the way to fix the nut 23 with the first inner sleeve 20. The locking ring 24 is arranged between the inner flange 222 of the outer sleeve 22 and the outer flange 211 of the second inner sleeve 21 and to prevent the first inner sleeve 20 from moving in the axial direction relatively to the outer sleeve 22. The rear extension portion 206 is concentrically surrounded by the rear extension portion 212 that is concentrically surrounded by the rear extension portion 223. When the nut 23 is rotated relatively to the second inner sleeve 21 and the outer sleeve 22, the first inner sleeve 20 may also rotate relatively to both of the second inner sleeve 21 and the outer sleeve 22 due to the rear extension portion 212 having an inner diameter greater than an outer diameter of the rear extension portion 206 and the nut 23 being fixed with the first inner sleeve 20. Next, the second elastic ring 26 may be locked in an annular space formed by the recess portion 235 of the nut 23 and the first and second protruding portions 2021 and 2022 of the first inner sleeve 20 in order to prevent water vapor from penetrating into the coaxial cable connector.

Figure 3E:
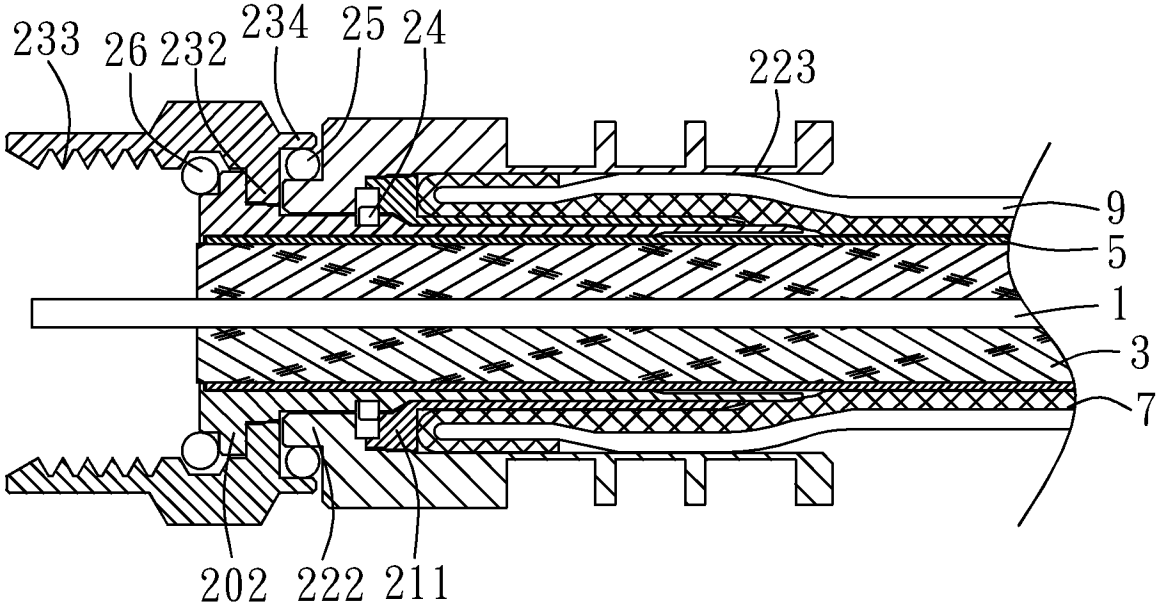
FIG. 3*e* shows a cross-sectional view of the coaxial cable connector assembled with a coaxial cable in accordance with the second embodiment of the present invention.

Referring to FIG. 3*e*, for assembling the coaxial cable as illustrated in FIG. 1 with the coaxial cable connector as illustrated in the second embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the first inner sleeve 20 into a through hole 201 in the first inner sleeve 20 and the folded front portion of the metal braided film 7 and the plastic jacket 9 are inserted from a back end of the outer sleeve 22 into the annular space between the rear extension portion 212 of the second inner sleeve 21 and the rear extension portion 223 of the outer sleeve 22. The metal wire 1 extends through the through hole 201 in the first inner sleeve 20 and to a space, surrounded by the inner thread 233 of the nut 23, outside the through hole 201. Next, a radial force may be applied to the outer sleeve 22 to be inwardly deformed such that the outer sleeve 22 and the second inner sleeve 21 may tightly clamp the coaxial cable in the annular space between the rear extension portions 212 and 223. Thereby, the coaxial cable connector may be assembled with the coaxial cable and good electrical ground connection between the nut 23 and the metal braided film 7 may be provided.

The coaxial cable connector as illustrated in the second embodiment may be screwed onto the externally threaded connector 2, which may refer to the first embodiment, to be firmly fixed with the externally threaded connector 2. When the nut 23 is being screwed on the externally threaded connector 2, the first inner sleeve 20 has the rear extension portion 206 rotating in the annular space between the plastic jacket 9 of the coaxial cable and the insulating layer 3 of the coaxial cable due to the nut 23 being firmly fixed with the first inner sleeve 20. Accordingly, when the nut 23 accompanying with the first inner sleeve 20 is rotated relatively to the outer sleeve 22 and the second inner sleeve 21, the first inner sleeve 20 may have good electrical ground connection to the metal braided layer 7. No matter whether the nut 23 is fully or loosely locked to the externally threaded connector 2, good electrical ground connection may be provided to ensure good signal transmission.

Figure 3F:
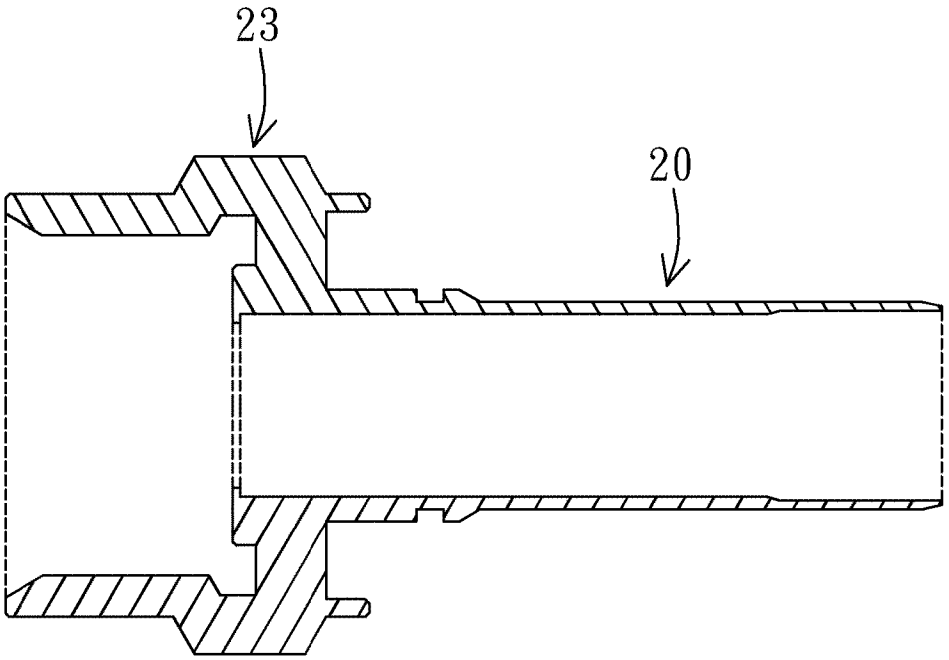
FIG. 3*f* shows a cross-sectional view of the coaxial cable connector having an inner-sleeve portion, i.e., first inner sleeve, and a nut portion integrally formed as a single part in accordance with the second embodiment of the present invention.

Alternatively, the first inner sleeve 20 and the nut 23 may be integrally formed as a single part, as shown in FIG. 3*f*. The single part may be divided into a net portion, derived from the net 23, and an inner-sleeve portion, derived from the first inner sleeve 20. The net portion and the inner-sleeve portion may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the single part.

Third Embodiment

Figure 4A:
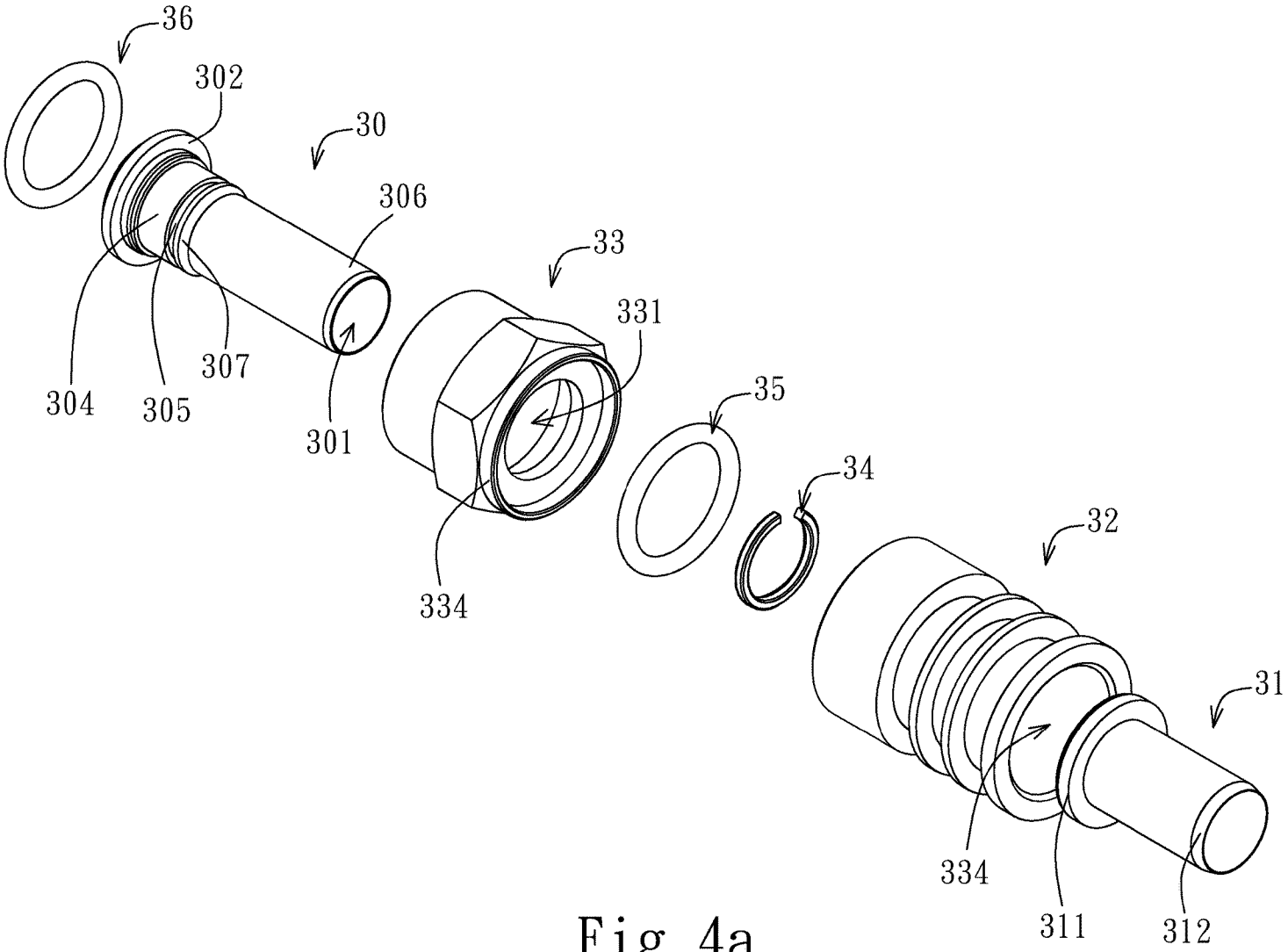
FIG. 4*a* shows a perspective exploded view of a coaxial cable connector in accordance with a third embodiment of the present invention.
Figure 4B:
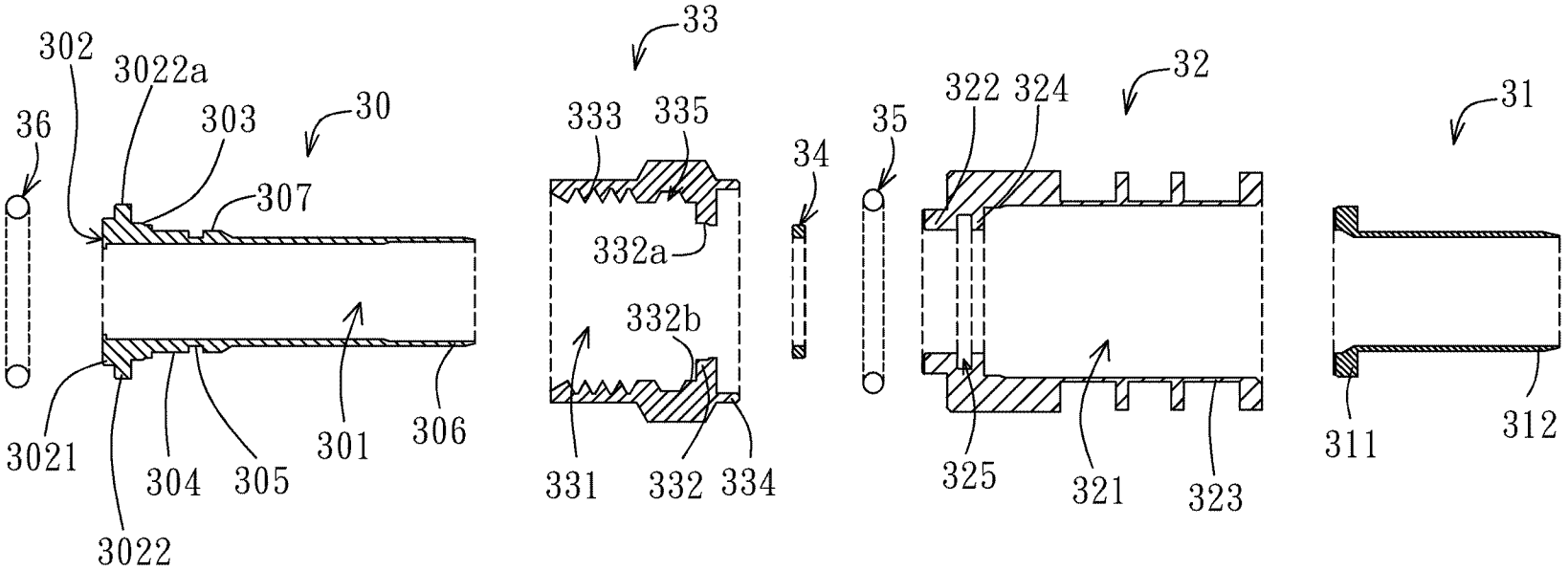
FIG. 4*b* shows a cross-sectional view of each element of the coaxial cable connector in accordance with the third embodiment of the present invention.
Figure 4C:
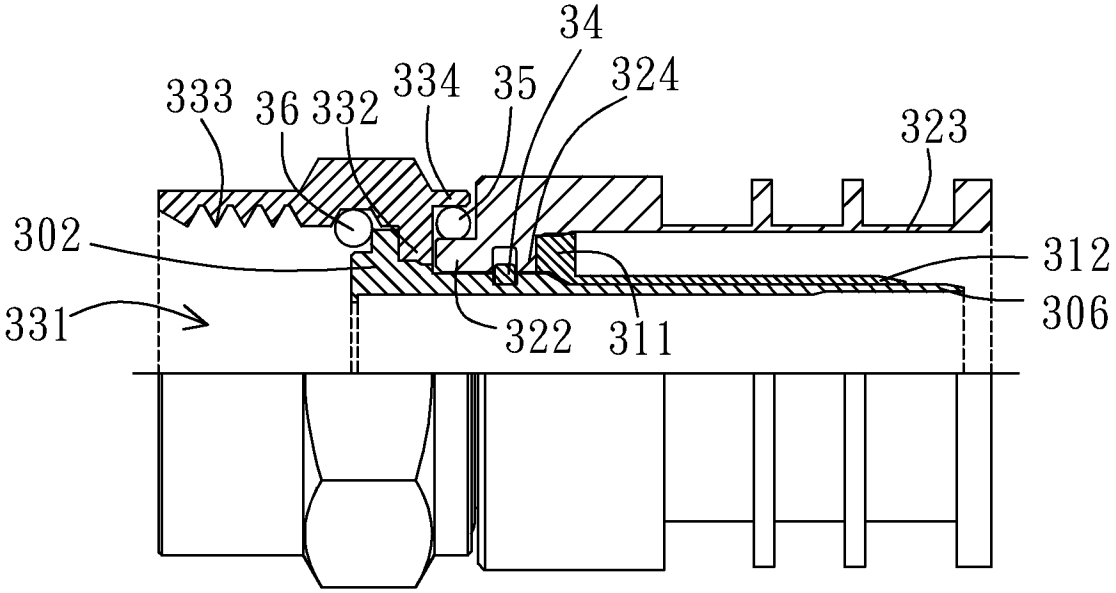
FIG. 4*c* shows a cross-sectional view of the coaxial cable connector in accordance with the third embodiment of the present invention.
Figure 4D:
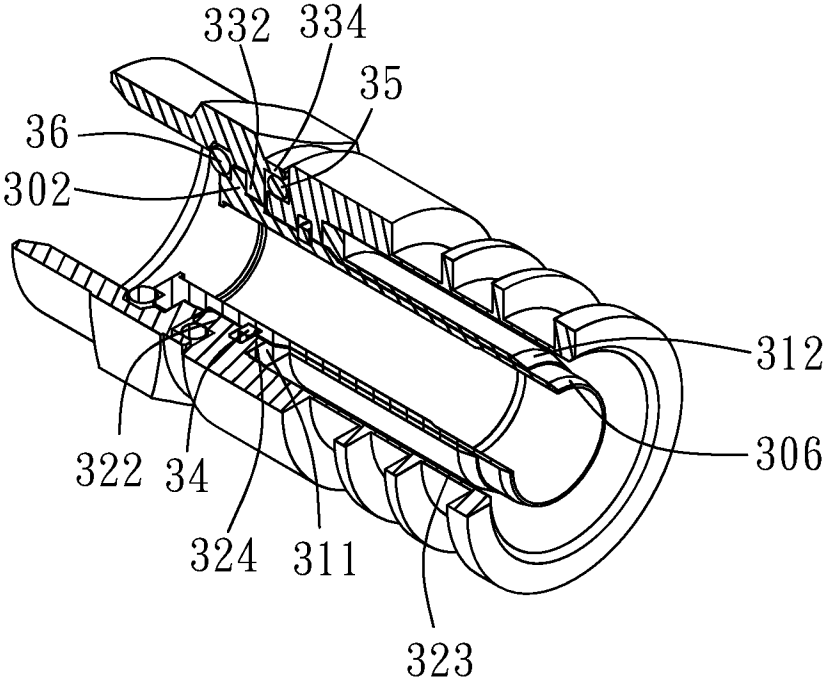
FIG. 4*d* shows a three-quarter cross-sectional perspective view of the coaxial cable connector in accordance with the third embodiment of the present invention.

FIG. 4*a* shows a perspective exploded view of a coaxial cable connector in accordance with a third embodiment of the present invention. FIG. 4*b* shows a cross-sectional view of each element of the coaxial cable connector in accordance with the third embodiment of the present invention. FIG. 4*c* shows a cross-sectional view of the coaxial cable connector in accordance with the third embodiment of the present invention. FIG. 4*d* shows a three-quarter cross-sectional perspective view of the coaxial cable connector in accordance with the third embodiment of the present invention. Referring to FIGS. 4*a*-4*d*, the coaxial cable connector includes a first inner sleeve 30, a second inner sleeve 31, an outer sleeve 32, a nut 33, a locking ring 34, a first elastic ring 35 and a second elastic ring 36 coaxially arranged. The first and second elastic rings 35 and 36 may be made of a rubber, a non-conductive polymer, a conductive polymer or conductive rubber. The locking ring 34 may be a C-shaped metal ring.

The first inner sleeve 30 may include an outer flange 302, a first cylindrical surface 303, a second cylindrical surface 304, an rear extension portion 306 and a third cylindrical surface 307, wherein the outer flange 302 includes a first protruding portion 3021 and a second protruding portion 3022 composing an annular step, and the second protruding portion 3022 has an outer diameter greater than that of the first protruding portion 3021. The second protruding portion 3022 is formed between the first protruding portion 3021 and the first cylindrical surface 303 in the axial direction; the first cylindrical surface 303 is formed between the second protruding portion 3022 and the second cylindrical surface 304 in the axial direction; the second cylindrical surface 304 is formed between the first cylindrical surface 303 and a groove 305 in the axial direction; the groove 305 is circumferentially formed in an outer cylindrical wall of the first inner sleeve 30 and between the second cylindrical surface 304 and the third cylindrical surface 307 in the axial direction; the third cylindrical surface 307 is formed between the groove 305 and the rear extension portion 306 in the axial direction. The second inner sleeve 31 may include an outer flange 311 and a rear extension portion 312. The nut 33 includes a through hole 331, an inner flange 332, an inner thread 333, a rear extension portion 334 and a recess portion 335, wherein the recess portion 335 is circumferentially formed in an inner cylindrical wall of the nut 33 and between the inner flange 332 and the inner thread 333 in the axial direction. The outer sleeve 32 includes a first inner flange 322, a rear extension portion 323 and a second inner flange 324, wherein a groove 325 is circumferentially formed in an inner cylindrical wall of the outer sleeve 32 and between the first and second inner flanges 322 and 324. The rear extension portion 323 has an inner diameter greater than an outer diameter of the rear extension portion 306 and then an outer diameter of the rear extension portion 312, and the rear extension portion 312 has an inner diameter greater than an outer diameter of the rear extension portion 306. The rear extension portion 312 has an axial length less than that of the rear extension portion 306. The nut 33 may be a hex nut, square nut, ring nut, wing nut or any other type of nut, which may be assembled with an externally threaded connector of an electronic device using a wrench or other tools.

The assembly for the coaxial cable connector in the third embodiment is mentioned as below. First, the first inner sleeve 30 has the rear extension portion 306 inserted into a through hole 331 in the nut 33 from a front end of the nut 33 and then the nut 33 is fixed, e.g., by way of tightly fitting, tolerance fitting, sintered metal bonding or adhesive bonding, with the first inner sleeve 30 such that the inner flange 332 of the nut 33 has an inner cylindrical surface 332*a* tightly fitted with or securely fixed with the first cylindrical surface 303 of the first inner sleeve 30 and the second protruding portion 3022 has an outer cylindrical surface 3022*a* tightly fitted with or securely fixed with an inner cylindrical surface 332*b* of the nut 33. The inner cylindrical surface 332*b* is formed between the recess portion 335 and the inner flange 332 in the axial direction. Next, the locking ring 34 is secured to the groove 325 circumferentially formed in the inner cylindrical wall of the outer sleeve 32. Next, the first elastic ring 35 is sleeved around and abuts against an outer cylindrical surface of of the outer sleeve 32 at an annular step thereof. Next, the rear extension portion 306 of the first inner sleeve 30 is inserted into a through hole 321 in the outer sleeve 32 assembled with the locking ring 34 and the first elastic ring 35 such that the outer sleeve 32 may have the first inner flange 322 sleeved around the second cylindrical surface 304 of the first inner sleeve 30 and the second flange 324 sleeved around the second cylindrical surface 307 of the first inner sleeve 30. Besides, the locking ring 34 may be locked to the groove 305 circumferentially formed in the outer cylindrical wall of the first inner sleeve 30 such that the locking ring 34 fixed in the grooves 305 and 325 may abut against the first and second inner flanges 322 and 324 of the outer sleeve 32 to constrain the outer sleeve 32 from moving in the axial direction relatively to the first inner sleeve 33. Further, the first elastic ring 35 may be fixed by the annular step of the outer sleeve 32 and an annular step of the nut 33 in order to prevent water vapor from penetrating into the coaxial cable connector. Next, the second inner sleeve 31 is moved into the through hole 321 in the outer sleeve 32 from the rear extension portion 323 of the outer sleeve 32 so as to be arranged in an annular space between the first inner sleeve 30 and the outer sleeve 32. The outer flange 311 of the second inner sleeve 31 may have an outer cylindrical surface to be fixed, e.g., by way of tightly fitting, tolerance fitting, sintered metal bonding or adhesive bonding, with an inner cylindrical wall of the outer sleeve 32. The way to fix the outer flange 311 of the second inner sleeve 31 with the inner cylindrical wall of the outer sleeve 32 may be the same as the way to fix the nut 33 with the first inner sleeve 30. The rear extension portion 306 is concentrically surrounded by the rear extension portion 312 that is concentrically surrounded by the rear extension portion 323. When the nut 33 is rotated relatively to the second inner sleeve 31 and the outer sleeve 32, the first inner sleeve 30 may also rotate relatively to both of the second inner sleeve 31 and the outer sleeve 32 due to the rear extension portion 312 having an inner diameter greater than an outer diameter of the rear extension portion 306 and the nut 33 being fixed with the first inner sleeve 30. Next, the second elastic ring 36 may be locked in an annular space formed by the recess portion 335 of the nut 33 and the first and second protruding portions 3021 and 3022 of the first inner sleeve 30 in order to prevent water vapor from penetrating into the coaxial cable connector.

Figure 4E:
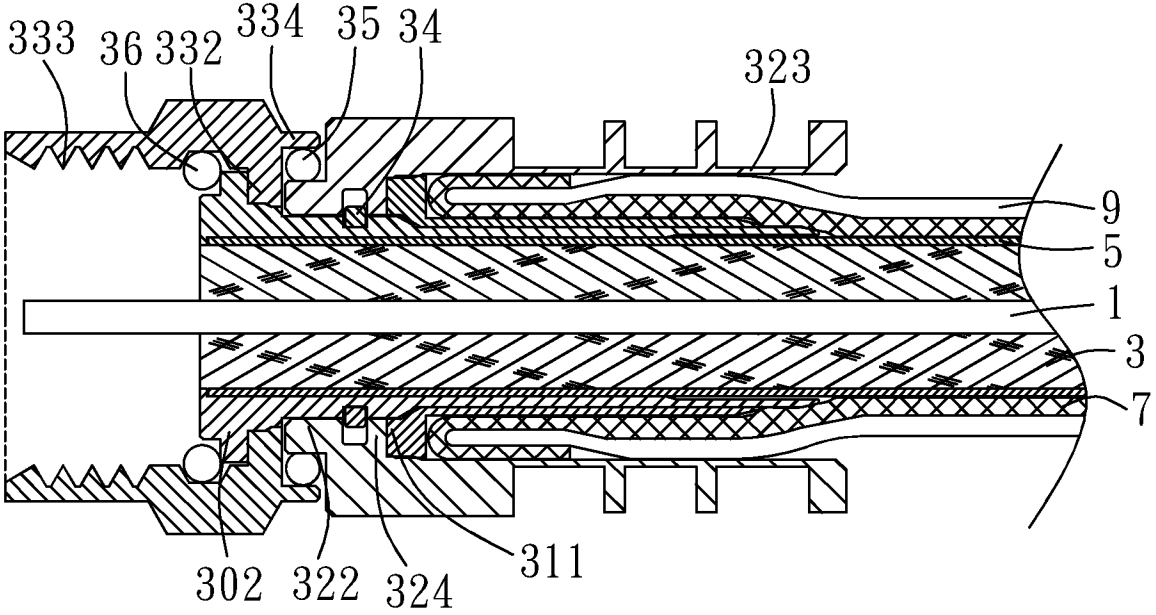
FIG. 4*e* shows a cross-sectional view of the coaxial cable connector assembled with a coaxial cable in accordance with the third embodiment of the present invention.

Referring to FIG. 4*e*, for assembling the coaxial cable as illustrated in FIG. 1 with the coaxial cable connector as illustrated in the third embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the first inner sleeve 30 into a through hole 301 in the first inner sleeve 30 and the folded front portion of the metal braided film 7 and the plastic jacket 9 are inserted from a back end of the outer sleeve 32 into the annular space between the rear extension portion 312 of the second inner sleeve 31 and the rear extension portion 323 of the outer sleeve 32. The metal wire 1 extends through the through hole 301 in the first inner sleeve 30 and to a space, surrounded by the inner thread 333 of the nut 33, outside the through hole 301. Next, a radial force may be applied to the outer sleeve 32 to be inwardly deformed such that the outer sleeve 32 and the second inner sleeve 31 may tightly clamp the coaxial cable in the annular space between the rear extension portions 312 and 323. Thereby, the coaxial cable connector may be assembled with the coaxial cable and good electrical ground connection between the nut 33 and the metal braided film 7 may be provided.

The coaxial cable connector as illustrated in the third embodiment may be screwed onto the externally threaded connector 2, which may refer to the first embodiment, to be firmly fixed with the externally threaded connector 2. When the nut 33 is being screwed on the externally threaded connector 2, the first inner sleeve 30 has the rear extension portion 306 rotating in the annular space between the plastic jacket 9 of the coaxial cable and the insulating layer 3 of the coaxial cable due to the nut 33 being firmly fixed with the first inner sleeve 30. Accordingly, when the nut 33 accompanying with the first inner sleeve 30 is rotated relatively to the outer sleeve 32 and the second inner sleeve 31, the first inner sleeve 30 may have good electrical ground connection to the metal braided layer 7. No matter whether the nut 33 is fully or loosely locked to the externally threaded connector 2, good electrical ground connection may be provided to ensure good signal transmission.

Figure 4F:
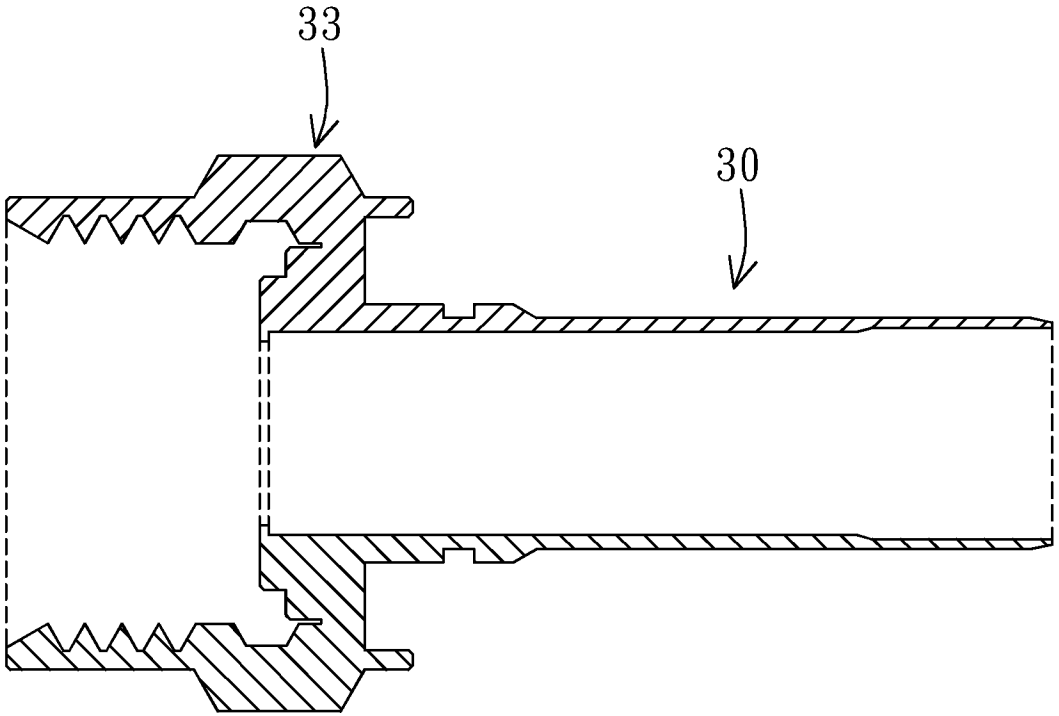
FIG. 4*f* shows a cross-sectional view of the coaxial cable connector having an inner-sleeve portion, i.e., first inner sleeve, and a nut portion integrally formed as a single part in accordance with the third embodiment of the present invention.

Alternatively, the first inner sleeve 30 and the nut 33 may be integrally formed as a single part, as shown in FIG. 4*f*. The single part may be divided into a net portion, derived from the net 33, and an inner-sleeve portion, derived from the first inner sleeve 30. The net portion and the inner-sleeve portion may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the single part.

Fourth Embodiment

Figure 5A:
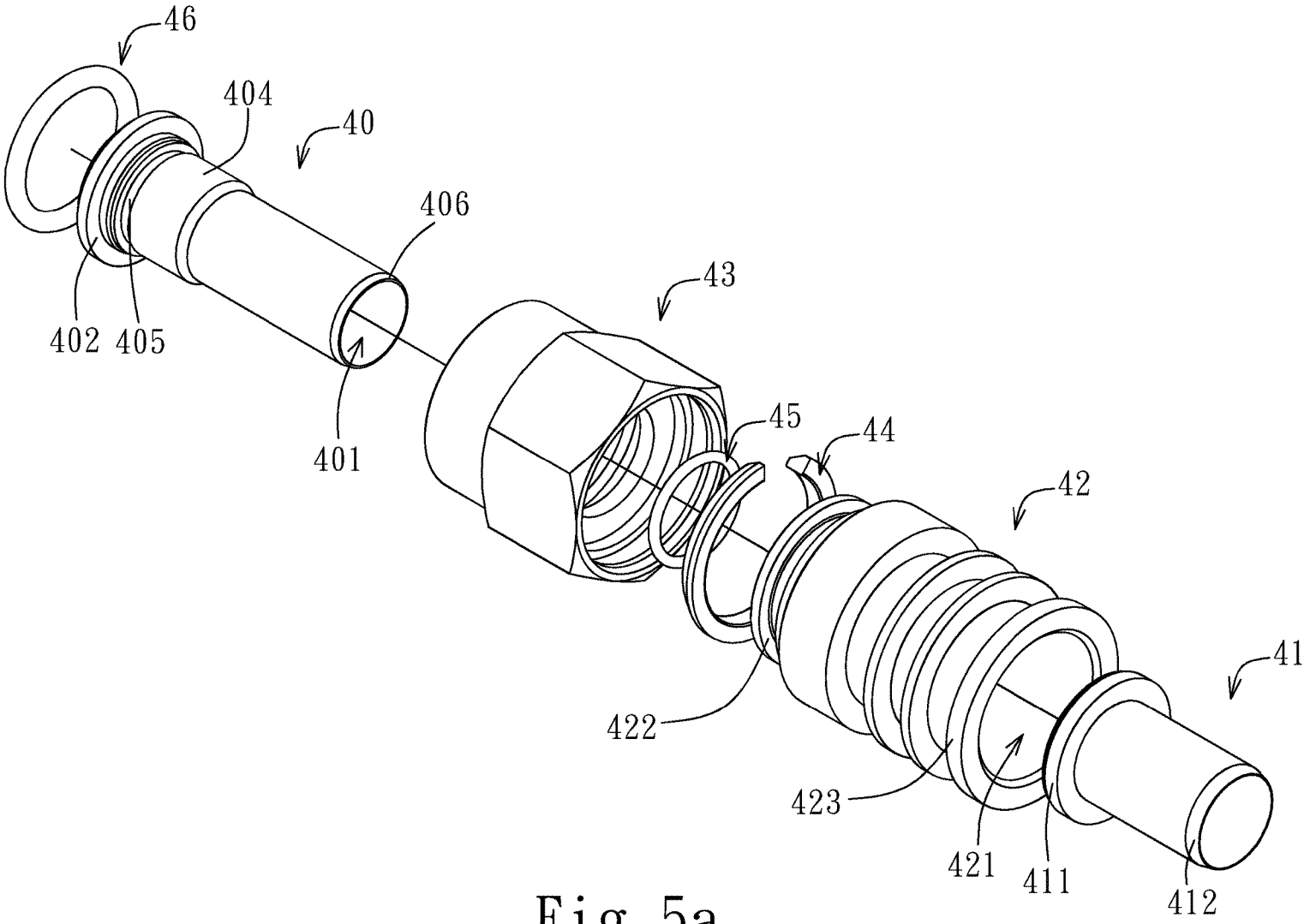
FIG. 5*a* shows a perspective exploded view of a coaxial cable connector in accordance with a fourth embodiment of the present invention.
Figure 5B:
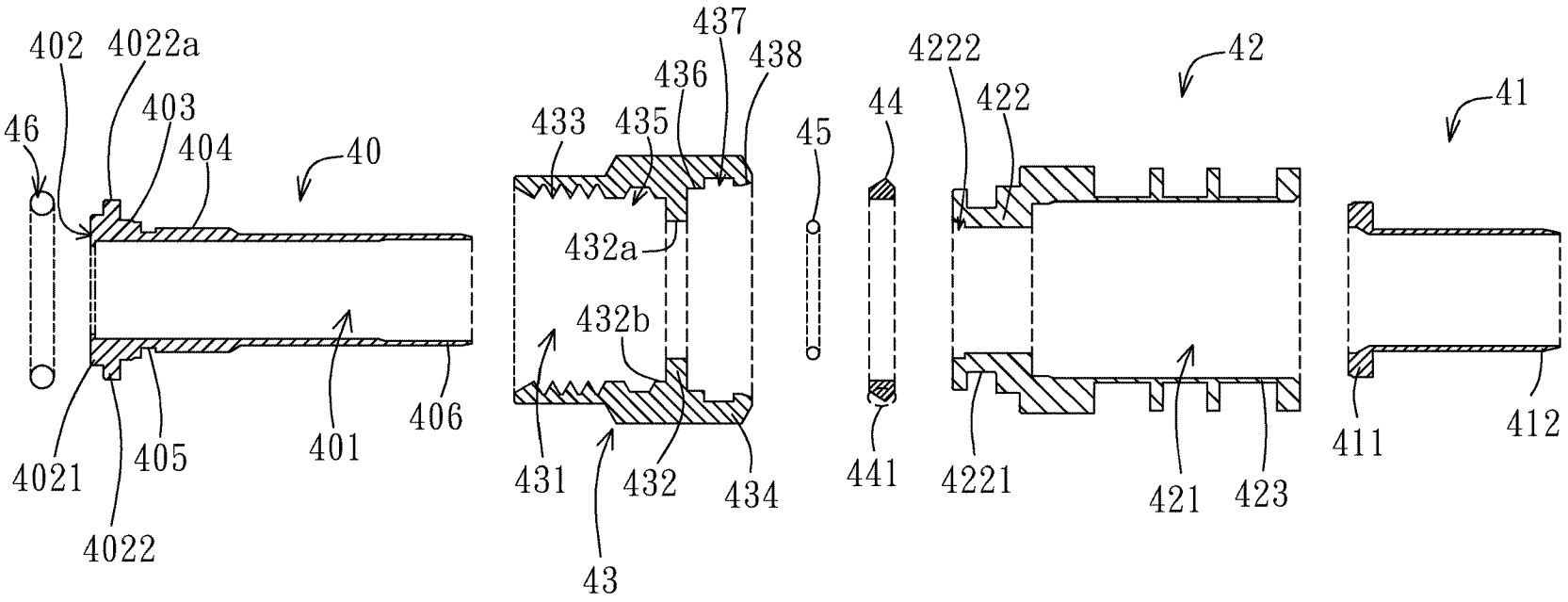
FIG. 5*b* shows a cross-sectional view of each element of the coaxial cable connector in accordance with the fourth embodiment of the present invention.
Figure 5C:
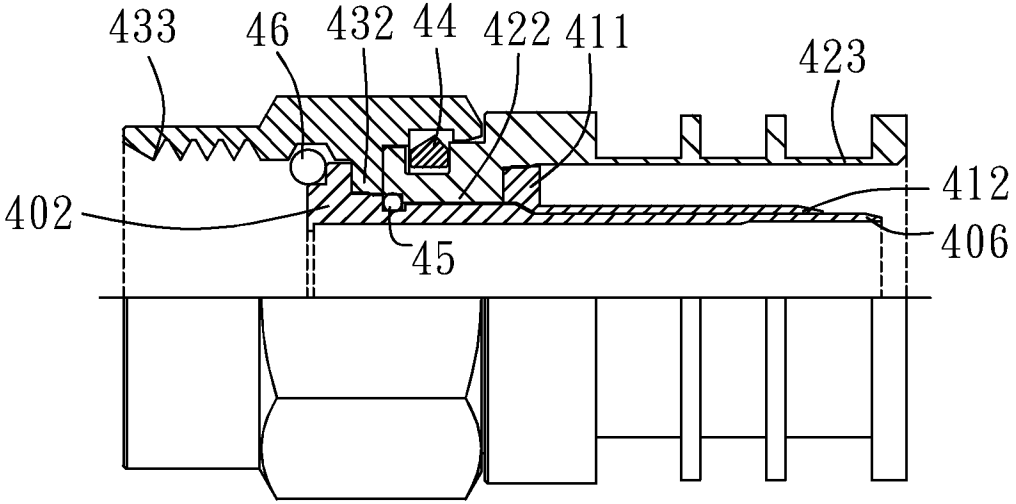
FIG. 5*c* shows a cross-sectional view of the coaxial cable connector in accordance with the fourth embodiment of the present invention.
Figure 5D:
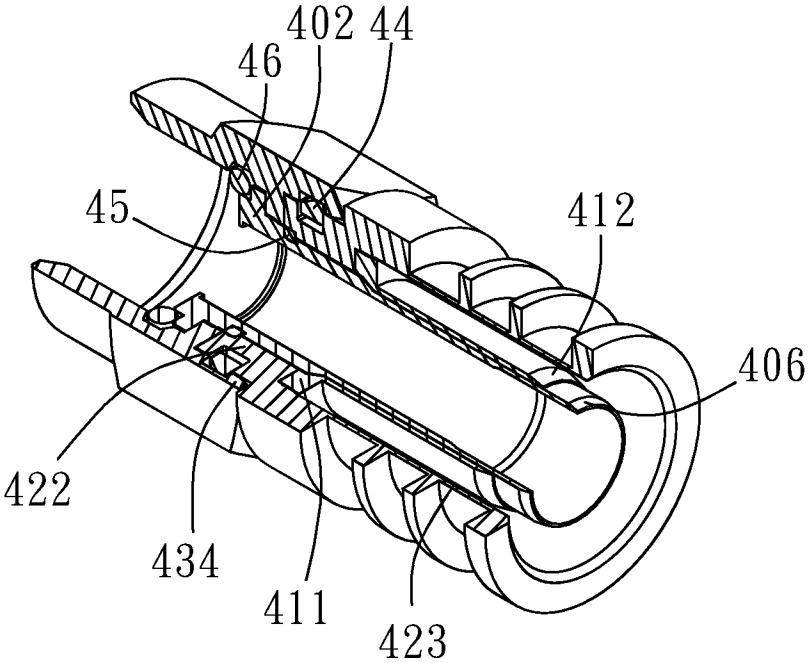
FIG. 5*d* shows a three-quarter cross-sectional perspective view of the coaxial cable connector in accordance with the fourth embodiment of the present invention.

FIG. 5*a* shows a perspective exploded view of a coaxial cable connector in accordance with a fourth embodiment of the present invention. FIG. 5*b* shows a cross-sectional view of each element of the coaxial cable connector in accordance with the fourth embodiment of the present invention. FIG. 5*c* shows a cross-sectional view of the coaxial cable connector in accordance with the fourth embodiment of the present invention. FIG. 5*d* shows a three-quarter cross-sectional perspective view of the coaxial cable connector in accordance with the fourth embodiment of the present invention. Referring to FIGS. 5*a*-5*d*, the coaxial cable connector includes a first inner sleeve 40, a second inner sleeve 41, an outer sleeve 42, a nut 43, a locking ring 44, a first elastic ring 45 and a second elastic ring 46 coaxially arranged. The first and second elastic rings 45 and 46 may be made of a rubber, a non-conductive polymer, a conductive polymer or conductive rubber. The locking ring 44 may be a C-shaped metal ring.

The first inner sleeve 40 may include an outer flange 402, a first cylindrical surface 403, a second cylindrical surface 404 and an rear extension portion 406, wherein the outer flange 402 includes a first protruding portion 4021 and a second protruding portion 4022 composing an annular step, and the second protruding portion 4022 has an outer diameter greater than that of the first protruding portion 4021. The second protruding portion 4022 is formed between the first protruding portion 4021 and the first cylindrical surface 403 in the axial direction; the first cylindrical surface 403 is formed between the second protruding portion 4022 and a groove 405 in the axial direction; the groove 405 is circumferentially formed in an outer cylindrical wall of the first inner sleeve 40 and between the first and second cylindrical surfaces 403 and 404 in the axial direction; the second cylindrical surface 404 is formed between the groove 405 and the rear extension portion 406 in the axial direction. The second inner sleeve 41 may include an outer flange 411 and a rear extension portion 412. The nut 43 includes an inner flange 432, an inner thread 433, a rear extension portion 434 and a recess portion 435, wherein the recess portion 435 is circumferentially formed in an inner cylindrical wall of the nut 43 and between the inner flange 432 and the inner thread 433 in the axial direction. The rear extension portion 434 of the nut 43 has an inner cylindrical surface 436 and a slope 438, wherein a groove 437 is circumferentially formed in an inner cylindrical wall of the rear extension portion 434 and between the inner cylindrical surface 436 and the slope 438 in the axial direction, and the inner cylindrical surface 436 is between the groove 437 and the inner flange 432 in the axial direction. The outer sleeve 42 includes an inner flange 422, a rear extension portion 423, a recess portion 4221 circumferentially formed in an outer cylindrical wall of the outer sleeve 42 and opposite to the inner flange 432, and an annular step 4222 circumferentially formed at a front side of the inner flange 422. The rear extension portion 423 has an inner diameter greater than an outer diameter of the rear extension portion 406 and then an outer diameter of the rear extension portion 412, and the rear extension portion 412 has an inner diameter greater than an outer diameter of the rear extension portion 406. The rear extension portion 412 has an axial length less than that of the rear extension portion 406. The nut 43 may be a hex nut, square nut, ring nut, wing nut or any other type of nut, which may be assembled with an externally threaded connector of an electronic device using a wrench or other tools.

The assembly for the coaxial cable connector in the fourth embodiment is mentioned as below. First, the first inner sleeve 40 has the rear extension portion 406 inserted into a through hole 431 in the nut 43 from a front end of the nut 43 and then the nut 43 is fixed, e.g., by way of tightly fitting, tolerance fitting, sintered metal bonding or adhesive bonding, with the first inner sleeve 40 such that the inner flange 432 of the nut 43 has an inner cylindrical surface 432*a* tightly fitted with or securely fixed with the first cylindrical surface 403 of the first inner sleeve 40 and the second protruding portion 4022 has an outer cylindrical surface 4022*a* tightly fitted with or securely fixed with an inner cylindrical surface 432*b* of the nut 43. The inner cylindrical surface 432*b* is formed between the recess portion 435 and the inner flange 432 in the axial direction. Next, the first elastic ring 45 is mounted into the groove 405.

Furthermore, the locking ring 44 may be mounted into the recess portion 4221 of the outer sleeve 42. The locking ring has a locking portion 441 protruding from the recess portion 4221 and having a radially outer diameter greater than a diameter of an outer cylindrical surface of the outer sleeve 42 adjacent to the recess portion 4221. After the nut 43 is assembled with the first inner sleeve 40, the rear extension portion 406 of the first inner sleeve 40 is inserted into a through hole 421 in the outer sleeve 42 assembled with the locking ring 44. In this time, the locking ring 44 may have a slope abutting against the slope 438 of the nut 43 and a force may be applied to the outer sleeve 42 to be moved in the axial direction relatively to the nut 43 until the locking ring 44 has the locking portion 441 locked into the groove 437 circumferentially formed in the inner cylindrical wall of the rear extension portion 434 of the nut 43. The locking ring 44 is arranged in an annular space formed by the recess portion 4221 and the groove 437 to lock the outer sleeve 42 and the nut 43. Thereby, the axial movement of the outer sleeve 42 relatively to the nut 43 may be constrained. The nut 43 has the inner cylindrical surface 436 sleeved around the outer cylindrical surface of the outer sleeve 42 and the inner flange 432 with a back radially extending surface in contact with a front radially extending surface of the outer sleeve 42. The annular step 4222 of the outer sleeve 42 is arranged circularly around the groove 405 and the first elastic ring 45 is fixed in an annular space formed by the groove 405 and annular step 4222.

Next, the second inner sleeve 41 is moved into the through hole 421 in the outer sleeve 42 from the rear extension portion 423 of the outer sleeve 42 so as to be arranged in an annular space between the first inner sleeve 40 and the outer sleeve 42. The outer flange 411 of the second inner sleeve 41 may have an outer cylindrical surface to be fixed, e.g., by way of tightly fitting, tolerance fitting, sintered metal bonding or adhesive bonding, with an inner cylindrical wall of the outer sleeve 42. The way to fix the outer flange 411 of the second inner sleeve 41 with the inner cylindrical wall of the outer sleeve 42 may be the same as the way to fix the nut 43 with the first inner sleeve 40. The rear extension portion 406 is concentrically surrounded by the rear extension portion 412 that is concentrically surrounded by the rear extension portion 423. When the nut 43 is rotated relatively to the second inner sleeve 41 and the outer sleeve 42, the first inner sleeve 40 may also rotate relatively to both of the second inner sleeve 41 and the outer sleeve 42 due to the rear extension portion 412 having an inner diameter greater than an outer diameter of the rear extension portion 406 and the nut 43 being fixed with the first inner sleeve 40. Next, the second elastic ring 46 may be locked in an annular space formed by the recess portion 435 of the nut 43 and the first and second protruding portions 4021 and 4022 of the first inner sleeve 40 in order to prevent water vapor from penetrating into the coaxial cable connector.

Figure 5E:
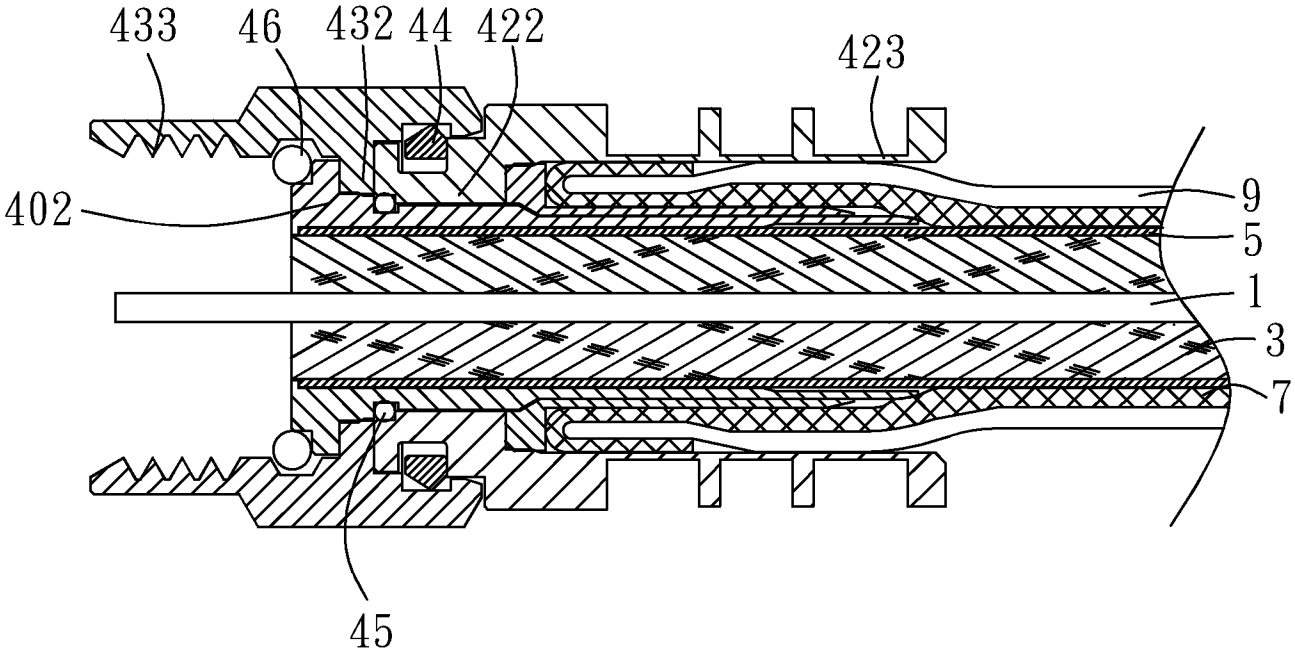
FIG. 5*e* shows a cross-sectional view of the coaxial cable connector assembled with a coaxial cable in accordance with the fourth embodiment of the present invention.

Referring to FIG. 5*e*, for assembling the coaxial cable as illustrated in FIG. 1 with the coaxial cable connector as illustrated in the fourth embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the first inner sleeve 40 into a through hole 401 in the first inner sleeve 40 and the folded front portion of the metal braided film 7 and the plastic jacket 9 are inserted from a back end of the outer sleeve 42 into the annular space between the rear extension portion 412 of the second inner sleeve 41 and the rear extension portion 423 of the outer sleeve 42. The metal wire 1 extends through the through hole 401 in the first inner sleeve 40 and to a space, surrounded by the inner thread 433 of the nut 43, outside the through hole 401. Next, a radial force may be applied to the outer sleeve 42 to be inwardly deformed such that the outer sleeve 42 and the second inner sleeve 41 may tightly clamp the coaxial cable in the annular space between the rear extension portions 412 and 423. Thereby, the coaxial cable connector may be assembled with the coaxial cable and good electrical ground connection between the nut 43 and the metal braided film 7 may be provided.

The coaxial cable connector as illustrated in the fourth embodiment may be screwed onto the externally threaded connector 2, which may refer to the first embodiment, to be firmly fixed with the externally threaded connector 2. When the nut 43 is being screwed on the externally threaded connector 2, the first inner sleeve 40 has the rear extension portion 406 rotating in the annular space between the plastic jacket 9 of the coaxial cable and the insulating layer 3 of the coaxial cable due to the nut 43 being firmly fixed with the first inner sleeve 40. Accordingly, when the nut 43 accompanying with the first inner sleeve 40 is rotated relatively to the outer sleeve 42 and the second inner sleeve 41, the first inner sleeve 40 may have good electrical ground connection to the metal braided layer 7. No matter whether the nut 43 is fully or loosely locked to the externally threaded connector 2, good electrical ground connection may be provided to ensure good signal transmission.

Figure 5F:
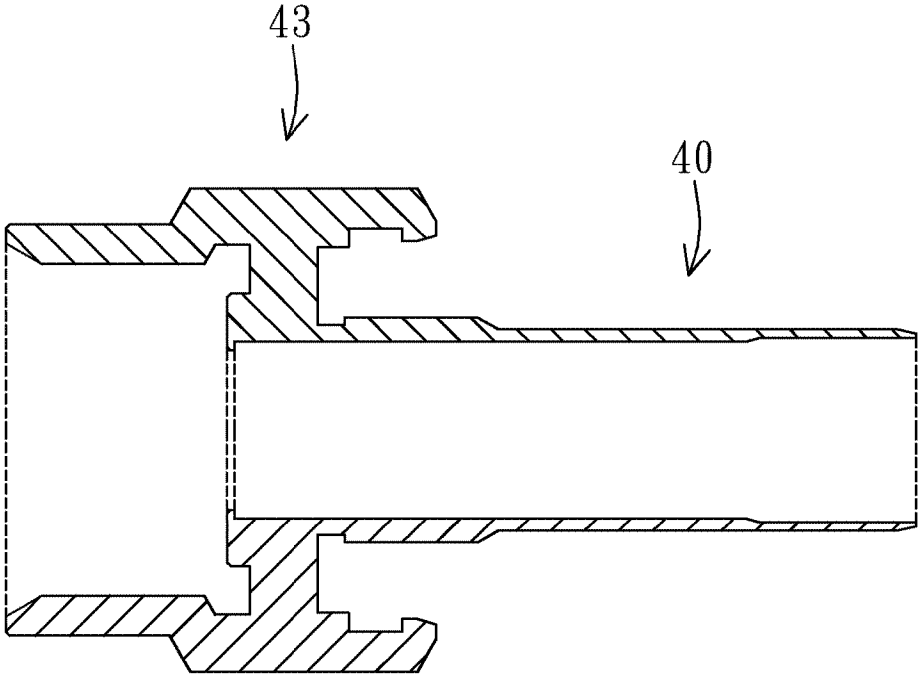
FIG. 5*f* shows a cross-sectional view of the coaxial cable connector having an inner-sleeve portion, i.e., first inner sleeve, and a nut portion integrally formed as a single part in accordance with the fourth embodiment of the present invention.

Alternatively, the first inner sleeve 40 and the nut 43 may be integrally formed as a single part, as shown in FIG. 5*f*. The single part may be divided into a net portion, derived from the net 43, and an inner-sleeve portion, derived from the first inner sleeve 40. The net portion and the inner-sleeve portion may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the single part.

Fifth Embodiment

Figure 6A:
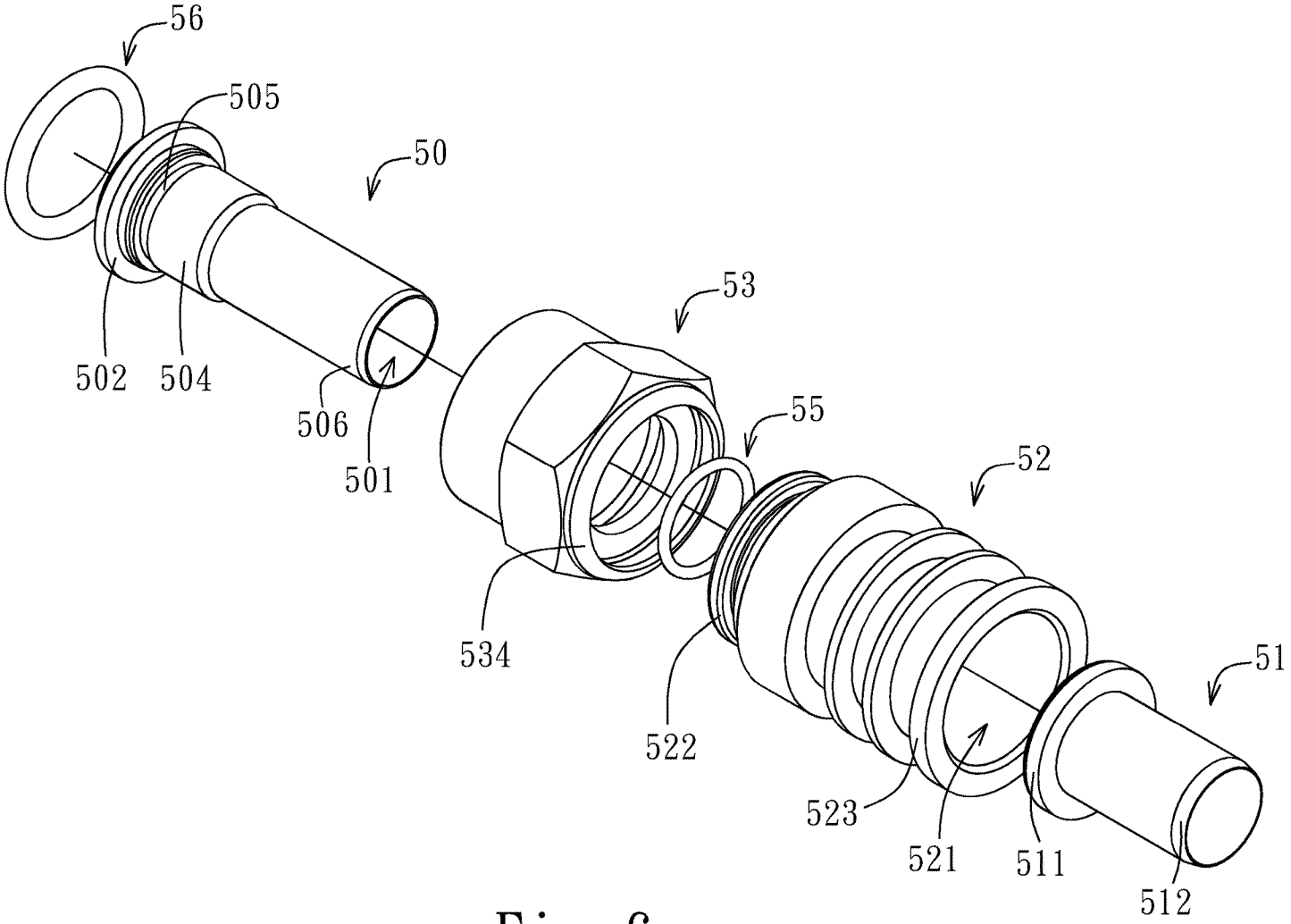
FIG. 6*a* shows a perspective exploded view of a coaxial cable connector in accordance with a fifth embodiment of the present invention.
Figure 6B:
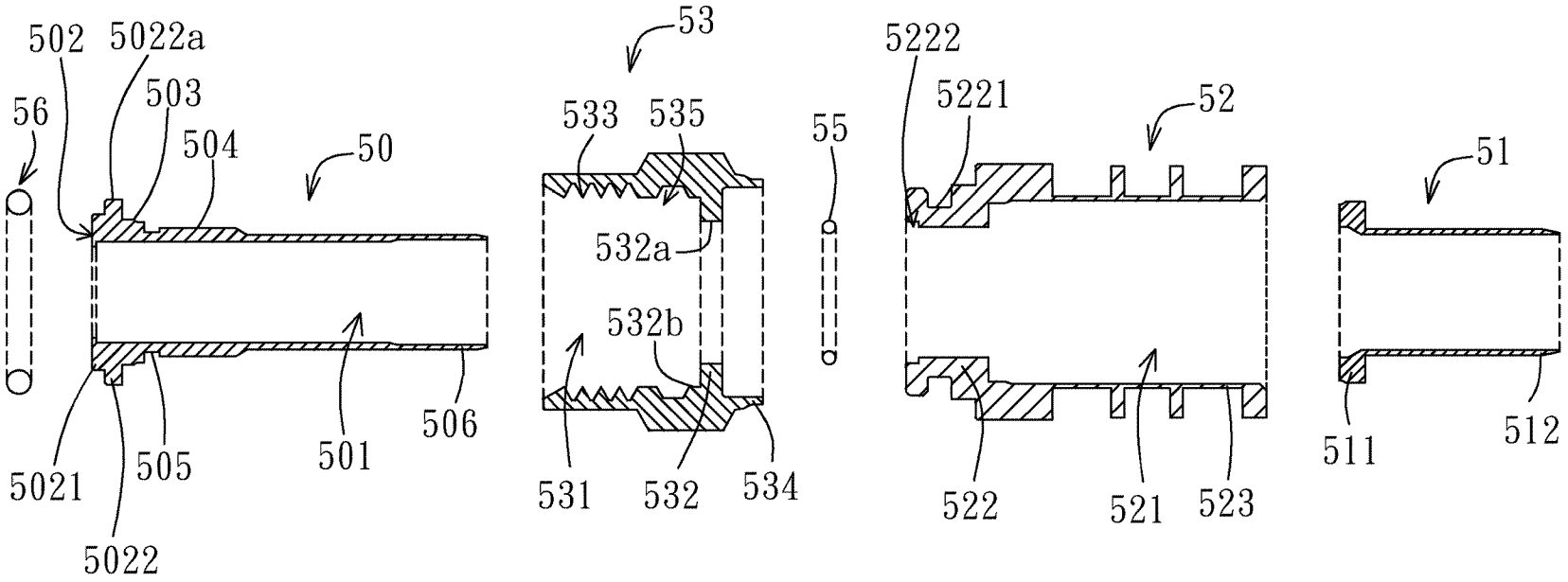
FIG. 6*b* shows a cross-sectional view of each element of the coaxial cable connector in accordance with the fifth embodiment of the present invention.
Figure 6C:
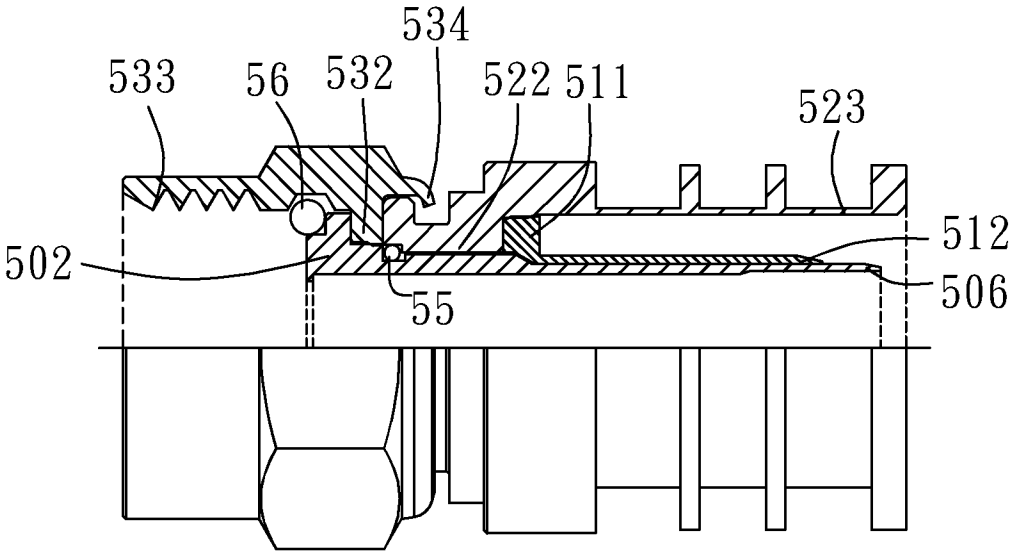
FIG. 6*c* shows a cross-sectional view of the coaxial cable connector in accordance with the fifth embodiment of the present invention.
Figure 6D:
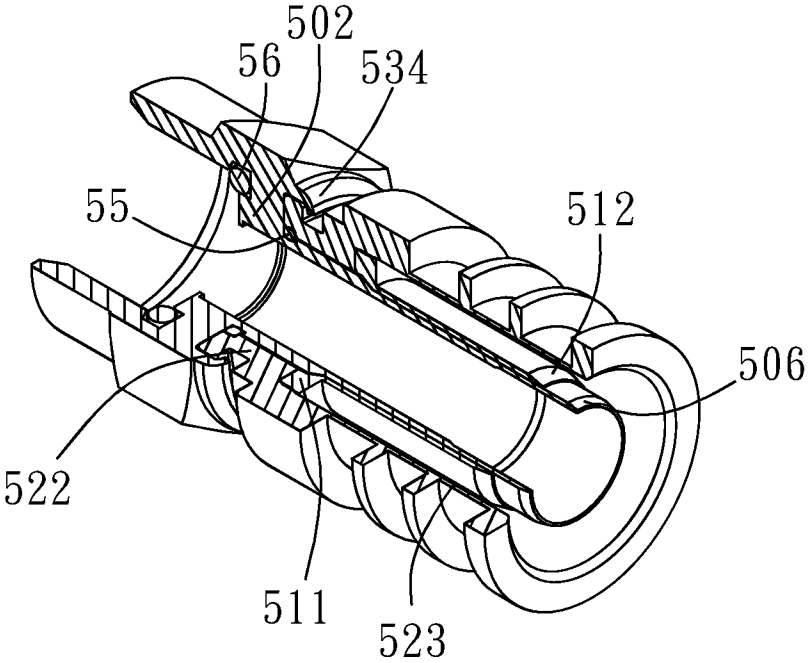
FIG. 6*d* shows a three-quarter cross-sectional perspective view of the coaxial cable connector in accordance with the fifth embodiment of the present invention.

FIG. 6*a* shows a perspective exploded view of a coaxial cable connector in accordance with a fifth embodiment of the present invention. FIG. 6*b* shows a cross-sectional view of each element of the coaxial cable connector in accordance with the fifth embodiment of the present invention. FIG. 6*c* shows a cross-sectional view of the coaxial cable connector in accordance with the fifth embodiment of the present invention. FIG. 6*d* shows a three-quarter cross-sectional perspective view of the coaxial cable connector in accordance with the fifth embodiment of the present invention. Referring to FIGS. 6*a*-6*d*, the coaxial cable connector includes a first inner sleeve 50, a second inner sleeve 51, an outer sleeve 52, a nut 53, a first elastic ring 55 and a second elastic ring 56 coaxially arranged. The first and second elastic rings 55 and 56 may be made of a rubber, a non-conductive polymer, a conductive polymer or conductive rubber.

The first inner sleeve 50 may include an outer flange 502, a first cylindrical surface 503, a second cylindrical surface 504 and an rear extension portion 506, wherein the outer flange 502 includes a first protruding portion 5021 and a second protruding portion 5022 composing an annular step, and the second protruding portion 5022 has an outer diameter greater than that of the first protruding portion 5021. The second protruding portion 5022 is formed between the first protruding portion 5021 and the first cylindrical surface 503 in the axial direction; the first cylindrical surface 503 is formed between the second protruding portion 5022 and a groove 505 in the axial direction; the groove 505 is circumferentially formed in an outer cylindrical wall of the first inner sleeve 50 and between the first and second cylindrical surfaces 503 and 504 in the axial direction; the second cylindrical surface 504 is formed between the groove 505 and the rear extension portion 506 in the axial direction. The second inner sleeve 51 may include an outer flange 511 and a rear extension portion 512. The nut 53 includes an inner flange 532, an inner thread 533, a rear extension portion 534 and a recess portion 535, wherein the recess portion 535 is circumferentially formed in an inner cylindrical wall of the nut 53 and between the inner flange 532 and the inner thread 533 in the axial direction. The outer sleeve 52 includes an inner flange 522, a rear extension portion 523, a recess portion 5221 circumferentially formed in an outer cylindrical wall of the outer sleeve 52 and opposite to the inner flange 532, and an annular step S222 circumferentially formed at a front side of the inner flange 522. The rear extension portion 523 has an inner diameter greater than an outer diameter of the rear extension portion 506 and then an outer diameter of the rear extension portion 512, and the rear extension portion 512 has an inner diameter greater than an outer diameter of the rear extension portion 506. The rear extension portion 512 has an axial length less than that of the rear extension portion 506. The nut 53 may be a hex nut, square nut, ring nut, wing nut or any other type of nut, which may be assembled with an externally threaded connector of an electronic device using a wrench or other tools.

The assembly for the coaxial cable connector in the fifth embodiment is mentioned as below. First, the first inner sleeve 50 has the rear extension portion 506 inserted into a through hole 531 in the nut 53 from a front end of the nut 53 and then the nut 53 is fixed, e.g., by way of tightly fitting, tolerance fitting, sintered metal bonding or adhesive bonding, with the first inner sleeve 50 such that the inner flange 532 of the nut 53 has an inner cylindrical surface 532*a* tightly fitted with or securely fixed with the first cylindrical surface 503 of the first inner sleeve 50 and the second protruding portion 5022 has an outer cylindrical surface 5022*a* tightly fitted with or securely fixed with an inner cylindrical surface 532*b* of the nut 53. The inner cylindrical surface 532*b* is formed between the recess portion 535 and the inner flange 532 in the axial direction. Next, the first elastic ring 55 is mounted into the groove 505.

Next, the rear extension portion 506 of the first inner sleeve 50 is inserted into a through hole 521 in the outer sleeve 52 such that the nut 53 has the inner flange 532 with a back radially extending surface in contact with a front radially extending surface of the outer sleeve 52. The annular step S222 of the outer sleeve 52 is arranged circularly around the groove 505 and the first elastic ring 55 is fixed in an annular space formed by the groove 505 and annular step S222. The rear extension portion 534 of the nut 53 is moved to have a rear terminal circumferentially around the recess portion 5221 of the outer sleeve 52. Next, the rear terminal of the rear extension portion 534 is radially deformed by pressing and rolling into the recess portion 5221 so as to restrict the outer sleeve 52 from moving in the axial direction relatively to the first inner sleeve 50 but allow the outer sleeve 52 to rotate relatively to the first inner sleeve 50. Next, the second inner sleeve 51 is moved into the through hole 521 in the outer sleeve 52 from the rear extension portion 523 of the outer sleeve 52 so as to be arranged in an annular space between the first inner sleeve 50 and the outer sleeve 52. The outer flange 511 of the second inner sleeve 51 may have an outer cylindrical surface to be fixed, e.g., by way of tightly fitting, tolerance fitting, sintered metal bonding or adhesive bonding, with an inner cylindrical wall of the outer sleeve 52. The way to fix the outer flange 511 of the second inner sleeve 51 with the inner cylindrical wall of the outer sleeve 52 may be the same as the way to fix the nut 53 with the first inner sleeve 50. The rear extension portion 506 is concentrically surrounded by the rear extension portion 512 that is concentrically surrounded by the rear extension portion 523. When the nut 53 is rotated relatively to the second inner sleeve 51 and the outer sleeve 52, the first inner sleeve 50 may also rotate relatively to both of the second inner sleeve 51 and the outer sleeve 52 due to the rear extension portion 512 having an inner diameter greater than an outer diameter of the rear extension portion 506 and the nut 53 being fixed with the first inner sleeve 50. Next, the second elastic ring 56 may be locked in an annular space formed by the recess portion 535 of the nut 53 and the first and second protruding portions 5021 and 5022 of the first inner sleeve 50 in order to prevent water vapor from penetrating into the coaxial cable connector.

Figure 6E:
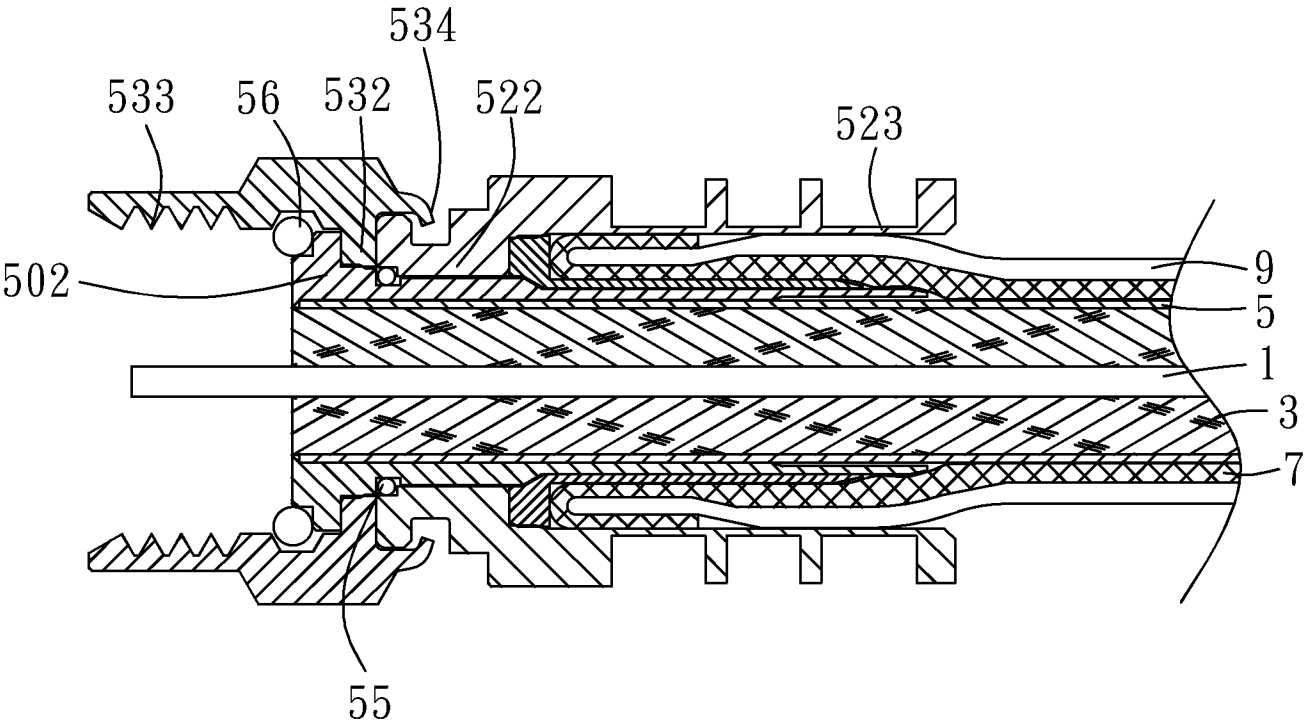
FIG. 6*e* shows a cross-sectional view of the coaxial cable connector assembled with a coaxial cable in accordance with the fifth embodiment of the present invention.

Referring to FIG. 6*e*, for assembling the coaxial cable as illustrated in FIG. 1 with the coaxial cable connector as illustrated in the fifth embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the first inner sleeve 50 into a through hole 501 in the first inner sleeve 50 and the folded front portion of the metal braided film 7 and the plastic jacket 9 are inserted from a back end of the outer sleeve 52 into the annular space between the rear extension portion 512 of the second inner sleeve 51 and the rear extension portion 523 of the outer sleeve 52. The metal wire 1 extends through the through hole 501 in the first inner sleeve 50 and to a space, surrounded by the inner thread 533 of the nut 53, outside the through hole 501. Next, a radial force may be applied to the outer sleeve 52 to be inwardly deformed such that the outer sleeve 52 and the second inner sleeve 51 may tightly clamp the coaxial cable in the annular space between the rear extension portions 512 and 523.

Accordingly, when the nut 53 accompanying with the first inner sleeve 50 is rotated relatively to the outer sleeve 52 and the second inner sleeve 51, good electrical ground connection between the nut 53 and the metal braided film 7 may be provided. No matter whether the nut 53 is fully or loosely locked to the externally threaded connector 2, good electrical ground connection may be provided to ensure good signal transmission.

Figure 6F:
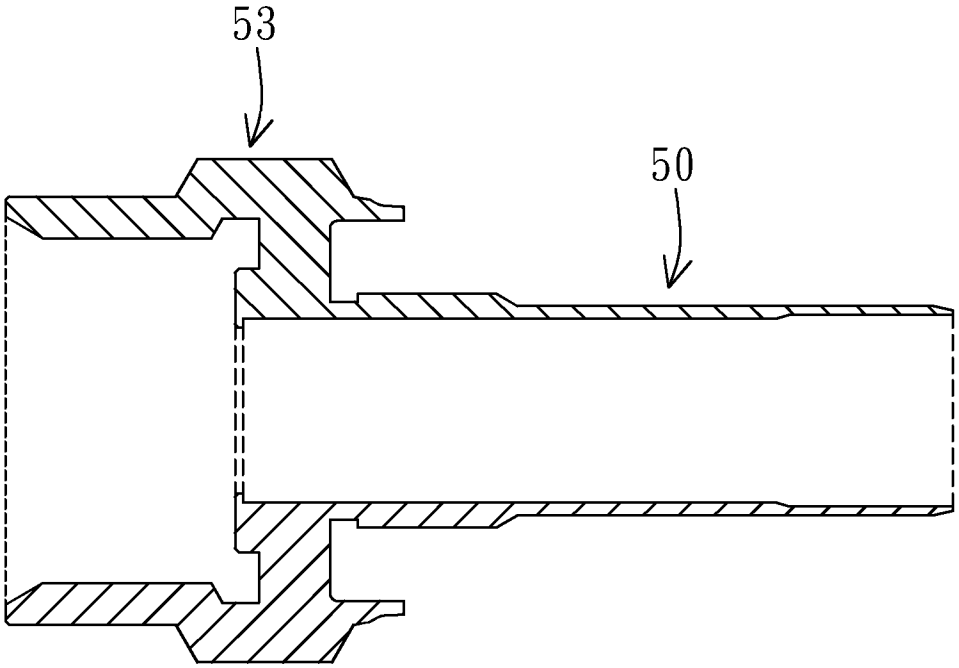
FIG. 6*f* shows a cross-sectional view of the coaxial cable connector having an inner-sleeve portion, i.e., first inner sleeve, and a nut portion integrally formed as a single part in accordance with the fifth embodiment of the present invention.

Alternatively, the first inner sleeve 50 and the nut 53 may be integrally formed as a single part, as shown in FIG. 6*f*. The single part may be divided into a net portion, derived from the net 53, and an inner-sleeve portion, derived from the first inner sleeve 50. The net portion and the inner-sleeve portion may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the single part.

Sixth Embodiment

Figure 7A:
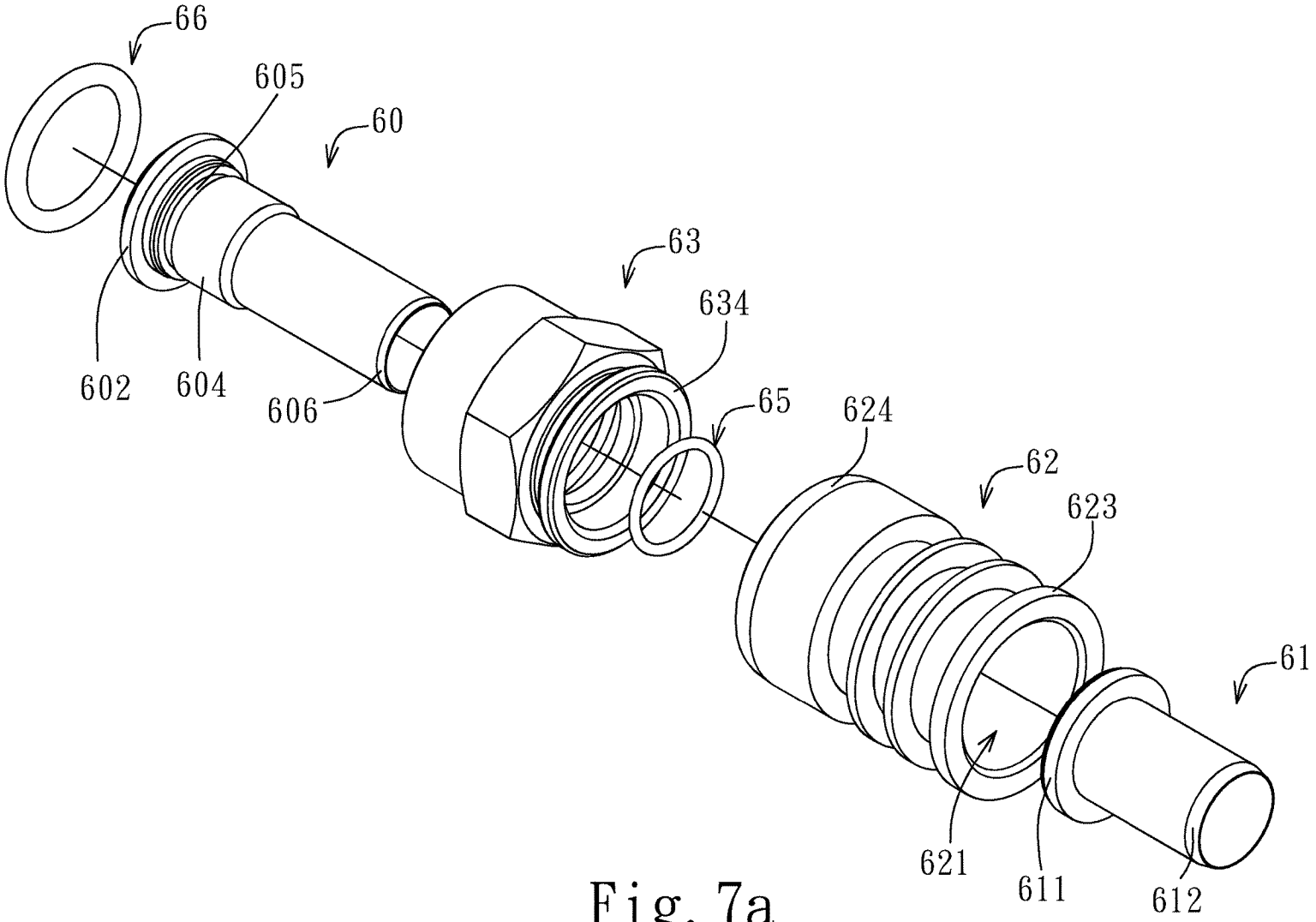
FIG. 7*a* shows a perspective exploded view of a coaxial cable connector in accordance with a sixth embodiment of the present invention.
Figure 7B:
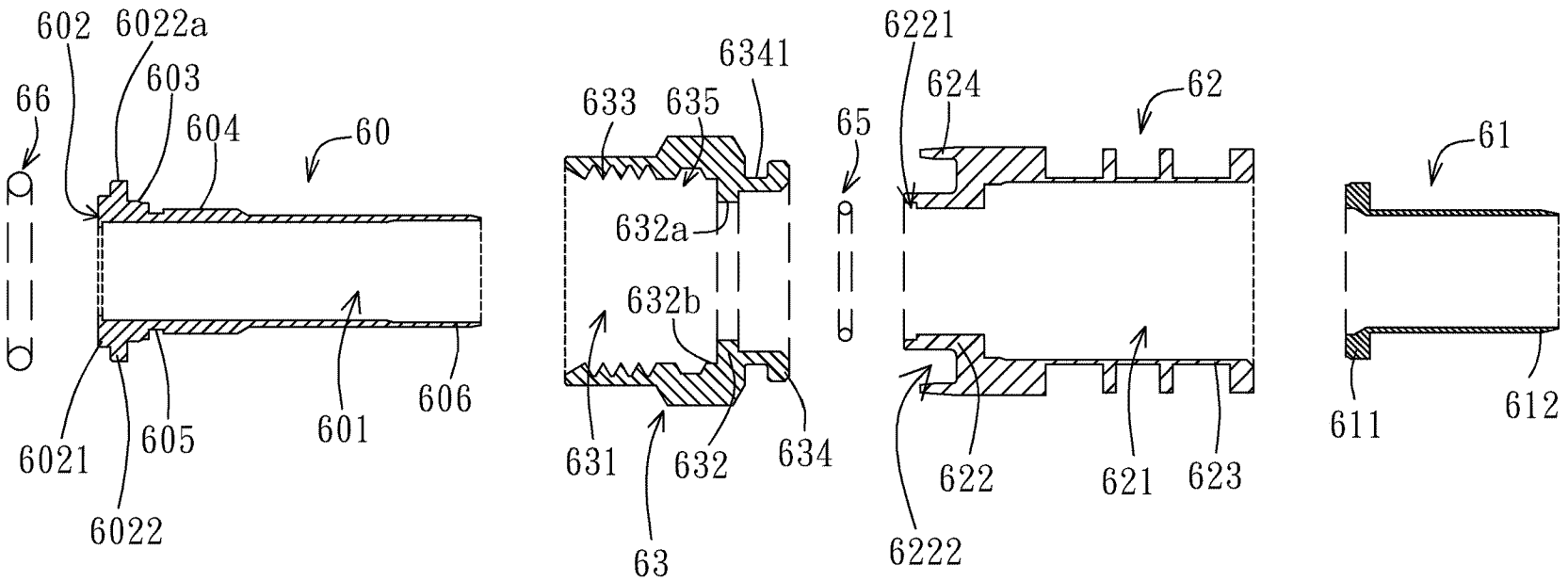
FIG. 7*b* shows a cross-sectional view of each element of the coaxial cable connector in accordance with the sixth embodiment of the present invention.
Figure 7C:
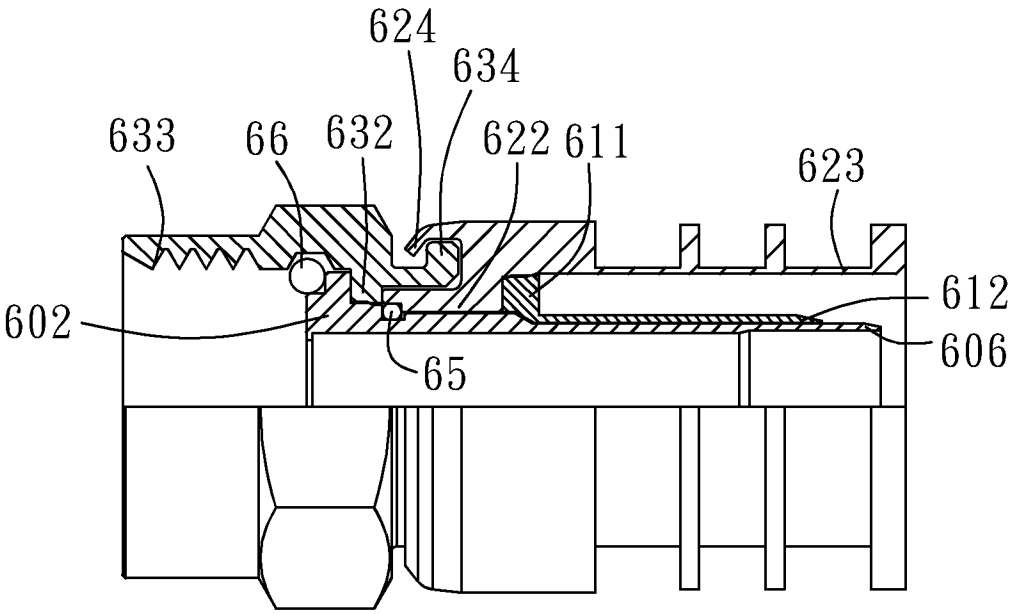
FIG. 7*c* shows a cross-sectional view of the coaxial cable connector in accordance with the sixth embodiment of the present invention.
Figure 7D:
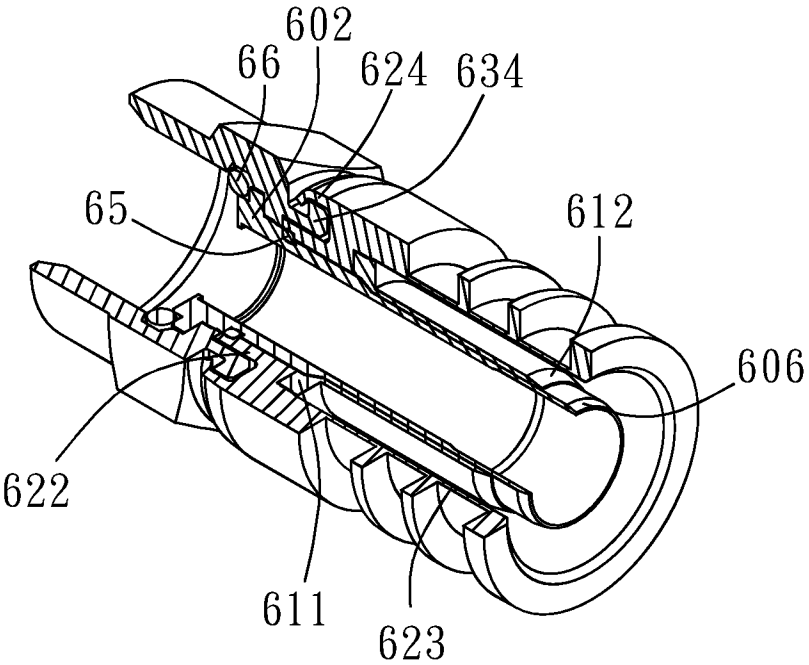
FIG. 7*d* shows a three-quarter cross-sectional perspective view of the coaxial cable connector in accordance with the sixth embodiment of the present invention.

FIG. 7*a* shows a perspective exploded view of a coaxial cable connector in accordance with a sixth embodiment of the present invention. FIG. 7*b* shows a cross-sectional view of each element of the coaxial cable connector in accordance with the sixth embodiment of the present invention. FIG. 7*c* shows a cross-sectional view of the coaxial cable connector in accordance with the sixth embodiment of the present invention. FIG. 7*d* shows a three-quarter cross-sectional perspective view of the coaxial cable connector in accordance with the sixth embodiment of the present invention. Referring to FIGS. 7*a*-7*d*, the coaxial cable connector includes a first inner sleeve 60, a second inner sleeve 61, an outer sleeve 62, a nut 63, a first elastic ring 65 and a second elastic ring 66 coaxially arranged. The first and second elastic rings 65 and 66 may be made of a rubber, a non-conductive polymer, a conductive polymer or conductive rubber.

The first inner sleeve 60 may include an outer flange 602, a first cylindrical surface 603, a second cylindrical surface 604 and an rear extension portion 606, wherein the outer flange 602 includes a first protruding portion 6021 and a second protruding portion 6022 composing an annular step, and the second protruding portion 6022 has an outer diameter greater than that of the first protruding portion 6021. The second protruding portion 6022 is formed between the first protruding portion 6021 and the first cylindrical surface 603 in the axial direction; the first cylindrical surface 603 is formed between the second protruding portion 6022 and a groove 605 in the axial direction; the groove 605 is circumferentially formed in an outer cylindrical wall of the first inner sleeve 60 and between the first and second cylindrical surfaces 603 and 604 in the axial direction; the second cylindrical surface 604 is formed between the groove 605 and the rear extension portion 606 in the axial direction. The second inner sleeve 61 may include an outer flange 611 and a rear extension portion 612. The nut 63 includes an inner flange 632, an inner thread 633, a rear extension portion 634 and a recess portion 635, wherein a groove 6341 may be circumferentially formed in an outer cylindrical wall of the rear extension portion 634 and the recess portion 635 is circumferentially formed in an inner cylindrical wall of the nut 63 and between the inner flange 632 and the inner thread 633 in the axial direction. The outer sleeve 62 includes an inner flange 622, a rear extension portion 623, a front extension portion 624 and an annular step 6221 circumferentially formed at a front side of the inner flange 622, wherein a groove 6222 is circumferentially formed at a radially inner side of the front extension portion 624 and opens towards a front side of the outer sleeve 62 for receiving the rear extension portion 634 of the nut 63. The rear extension portion 623 has an inner diameter greater than an outer diameter of the rear extension portion 606 and then an outer diameter of the rear extension portion 612, and the rear extension portion 612 has an inner diameter greater than an outer diameter of the rear extension portion 606. The rear extension portion 612 has an axial length less than that of the rear extension portion 606. The nut 63 may be a hex nut, square nut, ring nut, wing nut or any other type of nut, which may be assembled with an externally threaded connector of an electronic device using a wrench or other tools.

The assembly for the coaxial cable connector in the sixth embodiment is mentioned as below. First, the first inner sleeve 60 has the rear extension portion 606 inserted into a through hole 631 in the nut 63 from a front end of the nut 63 and then the nut 63 is fixed, e.g., by way of tightly fitting, tolerance fitting, sintered metal bonding or adhesive bonding, with the first inner sleeve 60 such that the inner flange 632 of the nut 63 has an inner cylindrical surface 632*a* tightly fitted with or securely fixed with the first cylindrical surface 603 of the first inner sleeve 60 and the second protruding portion 6022 has an outer cylindrical surface 6022*a* tightly fitted with or securely fixed with an inner cylindrical surface 632*b* of the nut 63. The inner cylindrical surface 632*b* is formed between the recess portion 635 and the inner flange 632 in the axial direction. Next, the first elastic ring 65 is mounted into the groove 605.

Next, the rear extension portion 606 of the first inner sleeve 60 is inserted into a through hole 621 in the outer sleeve 62 such that the nut 63 has the inner flange 632 with a back radially extending surface in contact with a front radially extending surface of the outer sleeve 62. The annular step 6221 of the outer sleeve 62 is arranged circularly around the groove 605 and the first elastic ring 65 is fixed in an annular space formed by the groove 605 and annular step 6221. The groove 6222 receives the rear extending portion 634 and the front extending portion 624 has a front terminal circumferentially arranged at a radially outer side of the groove 6341. Next, the front terminal of the front extending portion 624 is radially deformed by pressing and rolling into the groove 6341 so as to restrict the outer sleeve 62 from moving in the axial direction relatively to the first inner sleeve 60 but allow the outer sleeve 62 to rotate relatively to the first inner sleeve 60.

Next, the second inner sleeve 61 is moved into the through hole 621 in the outer sleeve 62 from the rear extension portion 623 of the outer sleeve 62 so as to be arranged in an annular space between the first inner sleeve 60 and the outer sleeve 62. The outer flange 611 of the second inner sleeve 61 may have an outer cylindrical surface to be fixed, e.g., by way of tightly fitting, tolerance fitting, sintered metal bonding or adhesive bonding, with an inner cylindrical wall of the outer sleeve 62. The way to fix the outer flange 611 of the second inner sleeve 61 with the inner cylindrical wall of the outer sleeve 62 may be the same as the way to fix the nut 63 with the first inner sleeve 60. The rear extension portion 606 is concentrically surrounded by the rear extension portion 612 that is concentrically surrounded by the rear extension portion 623. When the nut 63 is rotated relatively to the second inner sleeve 61 and the outer sleeve 62, the first inner sleeve 60 may also rotate relatively to both of the second inner sleeve 61 and the outer sleeve 62 due to the rear extension portion 612 having an inner diameter greater than an outer diameter of the rear extension portion 606 and the nut 63 being fixed with the first inner sleeve 60. Next, the second elastic ring 66 may be locked in an annular space formed by the recess portion 635 of the nut 63 and the first and second protruding portions 6021 and 6022 of the first inner sleeve 60 in order to prevent water vapor from penetrating into the coaxial cable connector.

Figure 7E:
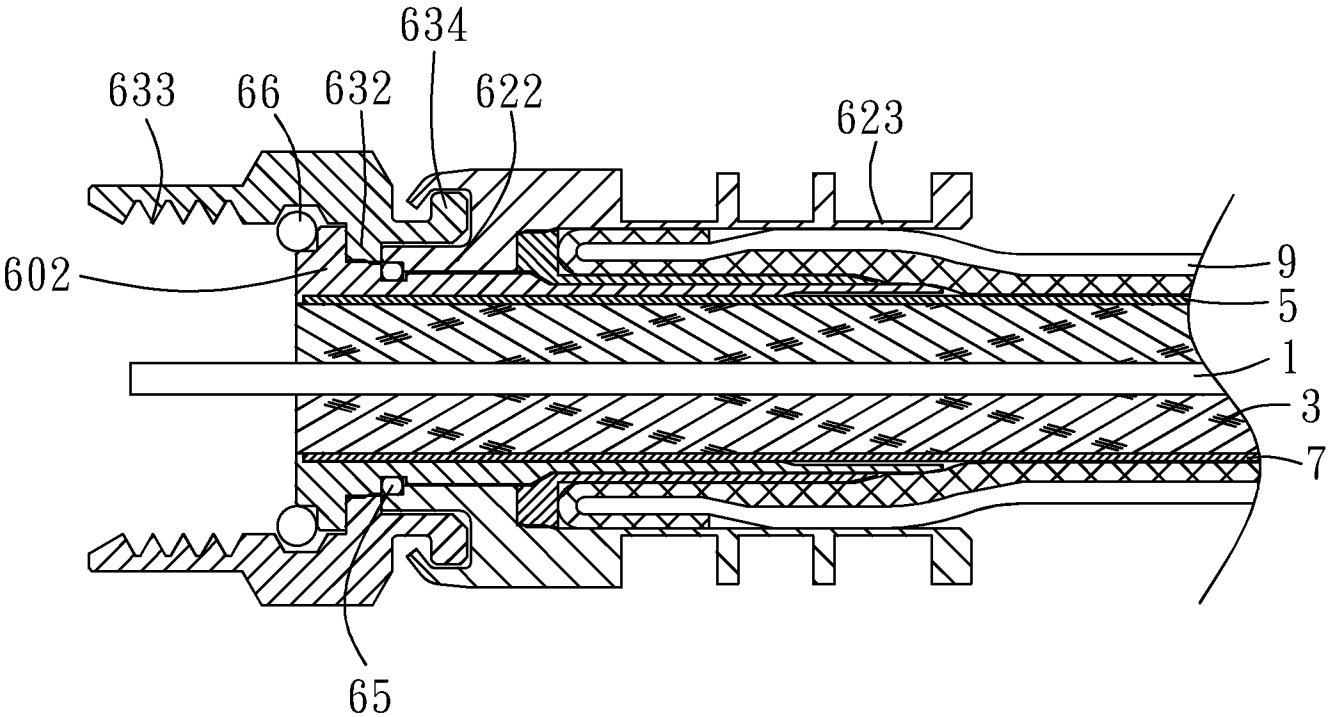
FIG. 7*e* shows a cross-sectional view of the coaxial cable connector assembled with a coaxial cable in accordance with the sixth embodiment of the present invention.

Referring to FIG. 7*e*, for assembling the coaxial cable as illustrated in FIG. 1 with the coaxial cable connector as illustrated in the sixth embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the first inner sleeve 60 into a through hole 601 in the first inner sleeve 60 and the folded front portion of the metal braided film 7 and the plastic jacket 9 are inserted from a back end of the outer sleeve 62 into the annular space between the rear extension portion 612 of the second inner sleeve 61 and the rear extension portion 623 of the outer sleeve 62. The metal wire 1 extends through the through hole 601 in the first inner sleeve 60 and to a space, surrounded by the inner thread 633 of the nut 63, outside the through hole 601. Next, a radial force may be applied to the outer sleeve 62 to be inwardly deformed such that the outer sleeve 62 and the second inner sleeve 61 may tightly clamp the coaxial cable in the annular space between the rear extension portions 612 and 623.

Accordingly, when the nut 63 accompanying with the first inner sleeve 60 is rotated relatively to the outer sleeve 62 and the second inner sleeve 61, good electrical ground connection between the nut 63 and the metal braided film 7 may be provided. No matter whether the nut 63 is fully or loosely locked to the externally threaded connector 2, good electrical ground connection may be provided to ensure good signal transmission.

Figure 7F:
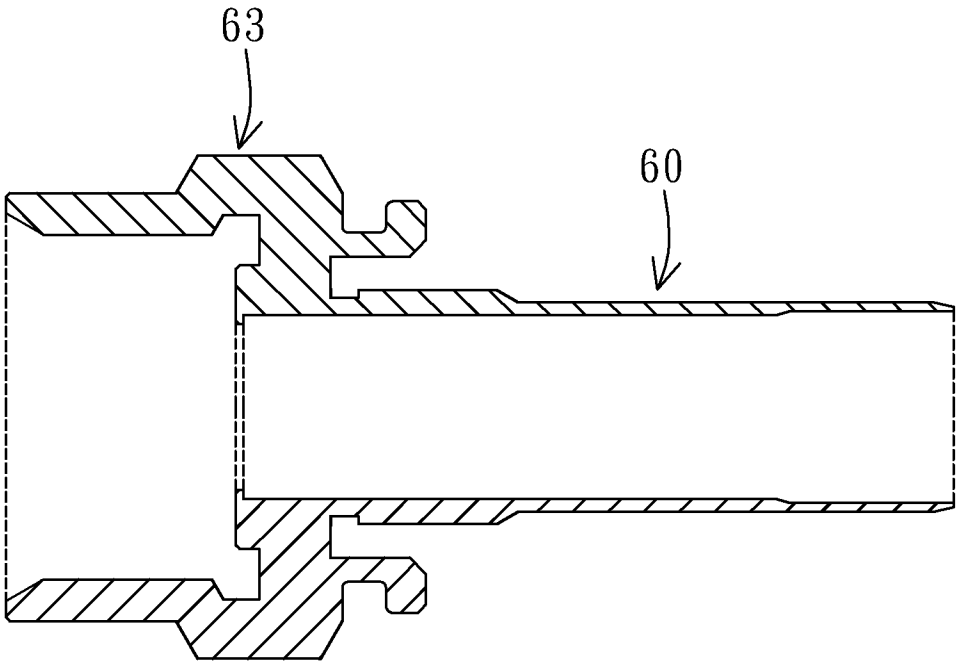
FIG. 7*f* shows a cross-sectional view of the coaxial cable connector having an inner-sleeve portion, i.e., first inner sleeve, and a nut portion integrally formed as a single part in accordance with the sixth embodiment of the present invention.

Alternatively, the first inner sleeve 60 and the nut 63 may be integrally formed as a single part, as shown in FIG. 7*f*. The single part may be divided into a net portion, derived from the net 63, and an inner-sleeve portion, derived from the first inner sleeve 60. The net portion and the inner-sleeve portion may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the single part.

Seventh Embodiment

Figure 8A:
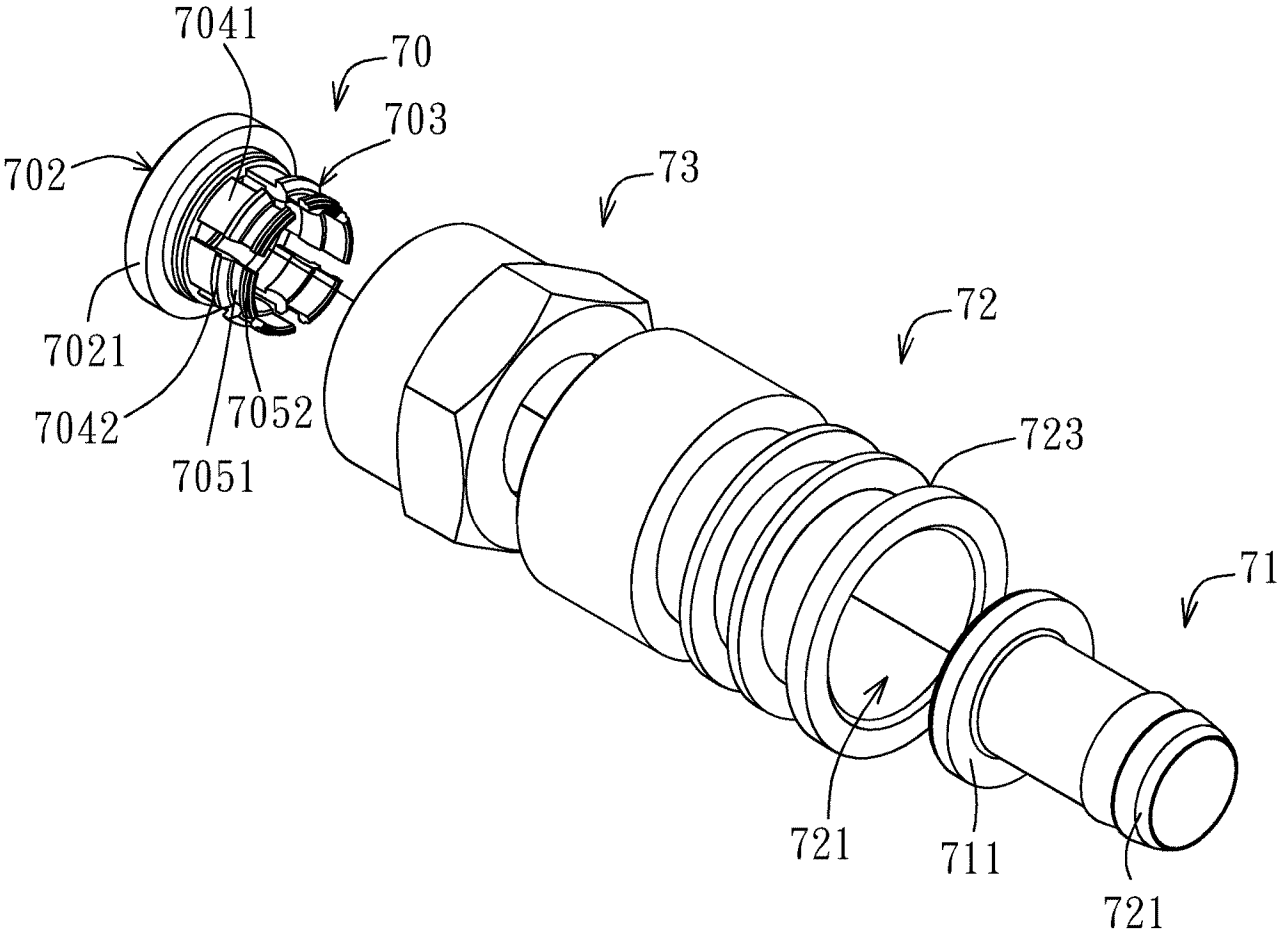
FIG. 8*a* shows a perspective exploded view of a coaxial cable connector in accordance with a seventh embodiment of the present invention.
Figure 8B:
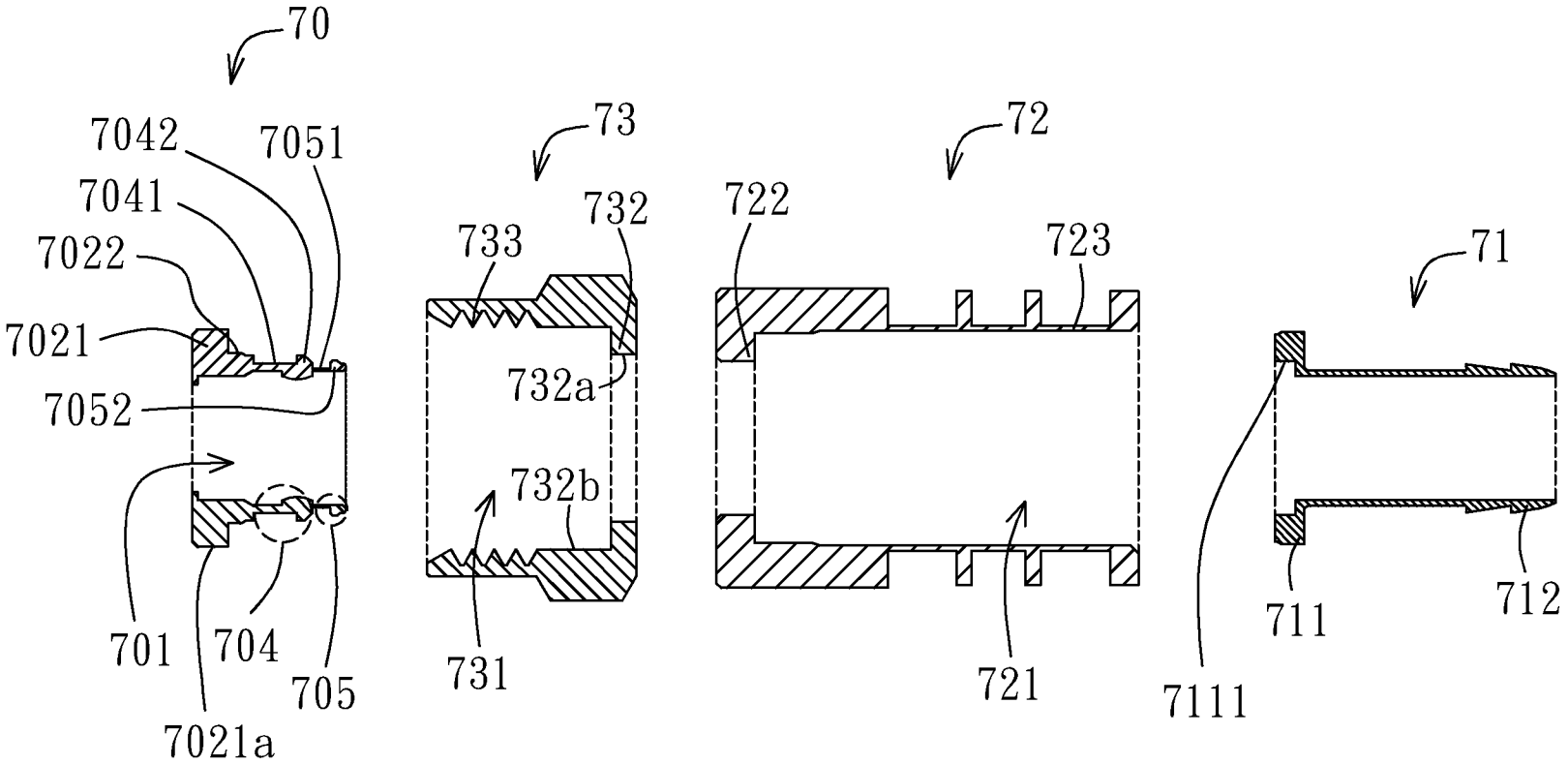
FIG. 8*b* shows a cross-sectional view of each element of the coaxial cable connector in accordance with the seventh embodiment of the present invention.
Figure 8C:
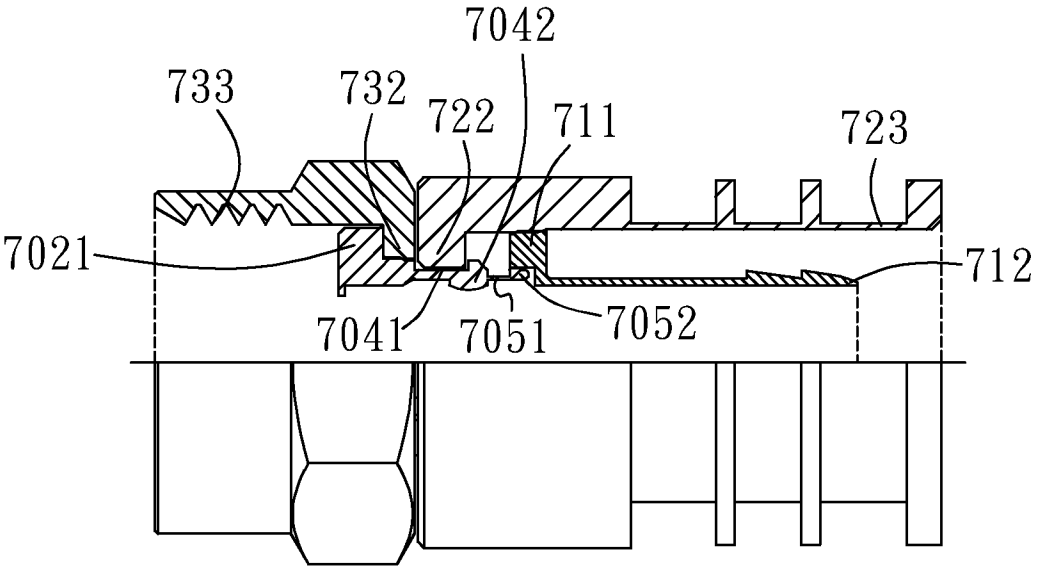
FIG. 8*c* shows a cross-sectional view of the coaxial cable connector in accordance with the seventh embodiment of the present invention.
Figure 8D:
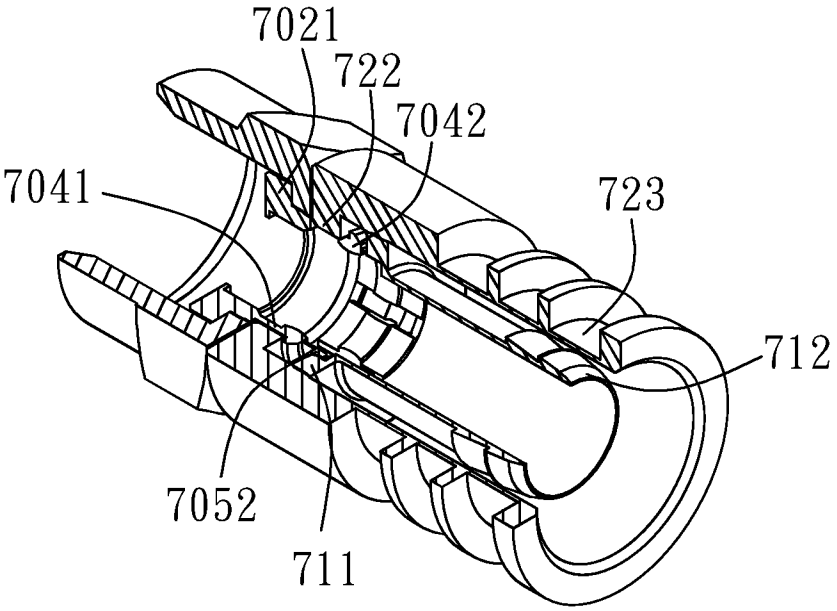
FIG. 8*d* shows a three-quarter cross-sectional perspective view of the coaxial cable connector in accordance with the seventh embodiment of the present invention.

FIG. 8*a* shows a perspective exploded view of a coaxial cable connector in accordance with a seventh embodiment of the present invention. FIG. 8*b* shows a cross-sectional view of each element of the coaxial cable connector in accordance with the seventh embodiment of the present invention. FIG. 8*c* shows a cross-sectional view of the coaxial cable connector in accordance with the seventh embodiment of the present invention. FIG. 8*d* shows a three-quarter cross-sectional perspective view of the coaxial cable connector in accordance with the seventh embodiment of the present invention. Referring to FIGS. 8*a*-8*d*, the coaxial cable connector includes a first inner sleeve 70, a second inner sleeve 71, an outer sleeve 72 and a nut 73.

The first inner sleeve 70 may include a main body 702 and multiple flexible locking tongues 703 having front ends joining a rear side of the main body 702. The flexible locking tongues 703 are arranged in a circle about the axial direction with an equal arcuate gap between each neighboring two of the flexible locking tongues 703. The main body 702 includes an outer flange 7021 and a first cylindrical surface 7022. Each of the flexible locking tongues 703 includes a first extending portion 704 and a second extending portion 705, wherein its first extending portion 704 includes a recess portion 7041 and a locking portion 7042, its second extending portion 705 includes a recess portion 7051 and a locking portion 7052. Each of the flexible locking tongues 703 may have its first extending portion 704 arranged between its second extending portion 705 and the main body 702, its locking portion 7042 arranged between its recess portions 7041 and 7051 and its locking portion 7052 arranged at a rear end thereof. The second inner sleeve 71 may include an outer flange 711 and a rear extension portion 712. The nut 73 includes an inner flange 732 and an inner thread 733. The outer sleeve 72 includes an inner flange 722 and a rear extension portion 723. The rear extension portion 723 has an inner diameter greater than an outer diameter of each of the flexible locking tongues 703 and then an outer diameter of the rear extension portion 712, and the rear extension portion 712 has an inner diameter substantially equal to an inner diameter of each of the flexible locking tongues 703. Each of the flexible locking tongues 703 may have an axial length less than that of the rear extension portion 712. The nut 73 may be a hex nut, square nut, ring nut, wing nut or any other type of nut, which may be assembled with an externally threaded connector of an electronic device using a wrench or other tools.

The assembly for the coaxial cable connector in the seventh embodiment is mentioned as below. First, the first inner sleeve 70 has the flexible locking tongues 703 inserted into a through hole 731 in the nut 73 from a front end of the nut 73 and then the nut 73 is fixed, e.g., by way of tightly fitting, tolerance fitting, sintered metal bonding or adhesive bonding, with the first inner sleeve 70 such that the inner flange 732 of the nut 73 has an inner cylindrical surface 732*a* tightly fitted with or securely fixed with the first cylindrical surface 7022 of the first inner sleeve 70 and the outer flange 7021 of the first inner sleeve 70 has an outer cylindrical surface 7021*a* tightly fitted with or securely fixed with an inner cylindrical surface 732*b* of the nut 73. The inner cylindrical surface 732*b* is formed between the inner thread 733 and the inner flange 732 in the axial direction. Next, the flexible locking tongues 703 of the first inner sleeve 70 is inserted into a through hole 721 in the outer sleeve 72, during which each of the flexible locking tongues 703 has its first extending portion 704 radially inwardly deformed due to its locking portion 7042 pressed by the inner flange 722 of the outer sleeve 72, such that the inner flange 722 of the outer sleeve 72 may be engaged with its recess portion 7041 and the nut 73 has the inner flange 732 with a back radially extending surface in contact with a front radially extending surface of the outer sleeve 72. Thereby, the outer sleeve 72 may be restricted from moving in the axial direction relatively to the first inner sleeve 70 but allow the outer sleeve 72 to rotate relatively to the first inner sleeve 70. Next, the second inner sleeve 71 is moved into the through hole 721 in the outer sleeve 72 from the rear extension portion 723 of the outer sleeve 72, during which each of the flexible locking tongues 703 has its second extending portion 705 radially inwardly deformed due to its locking portion 7052 pressed by an annular step 7111 of the second inner sleeve 71 circumferentially formed at a front side of an inner cylindrical wall of the second inner sleeve 71, such that the annular step 7111 of the second inner sleeve 71 may be engaged with its locking portion 7052 and the outer flange 711 may be moved to a gap between its locking portion 7052 and an inner cylindrical wall of the outer sleeve 72. The outer flange 711 of the second inner sleeve 71 may have an outer cylindrical surface to be fixed, e.g., by way of tightly fitting, tolerance fitting, sintered metal bonding or adhesive bonding, with the inner cylindrical wall of the outer sleeve 72. The way to fix the outer flange 711 of the second inner sleeve 71 with the inner cylindrical wall of the outer sleeve 72 may be the same as the way to fix the nut 73 with the first inner sleeve 70. The rear extension portion 712 is concentrically surrounded by the rear extension portion 723. Each of the flexible locking tongues 703 may have its second extending portion 705 formed to be flexible so as to have its locking portion 7052 always abutting against the annular step 7111 of the second inner sleeve 71. Thereby, when the nut 73 is rotated relatively to the second inner sleeve 71 and the outer sleeve 72, the first inner sleeve 70 may also rotate relatively to both of the second inner sleeve 71 and the outer sleeve 72.

Figure 8E:
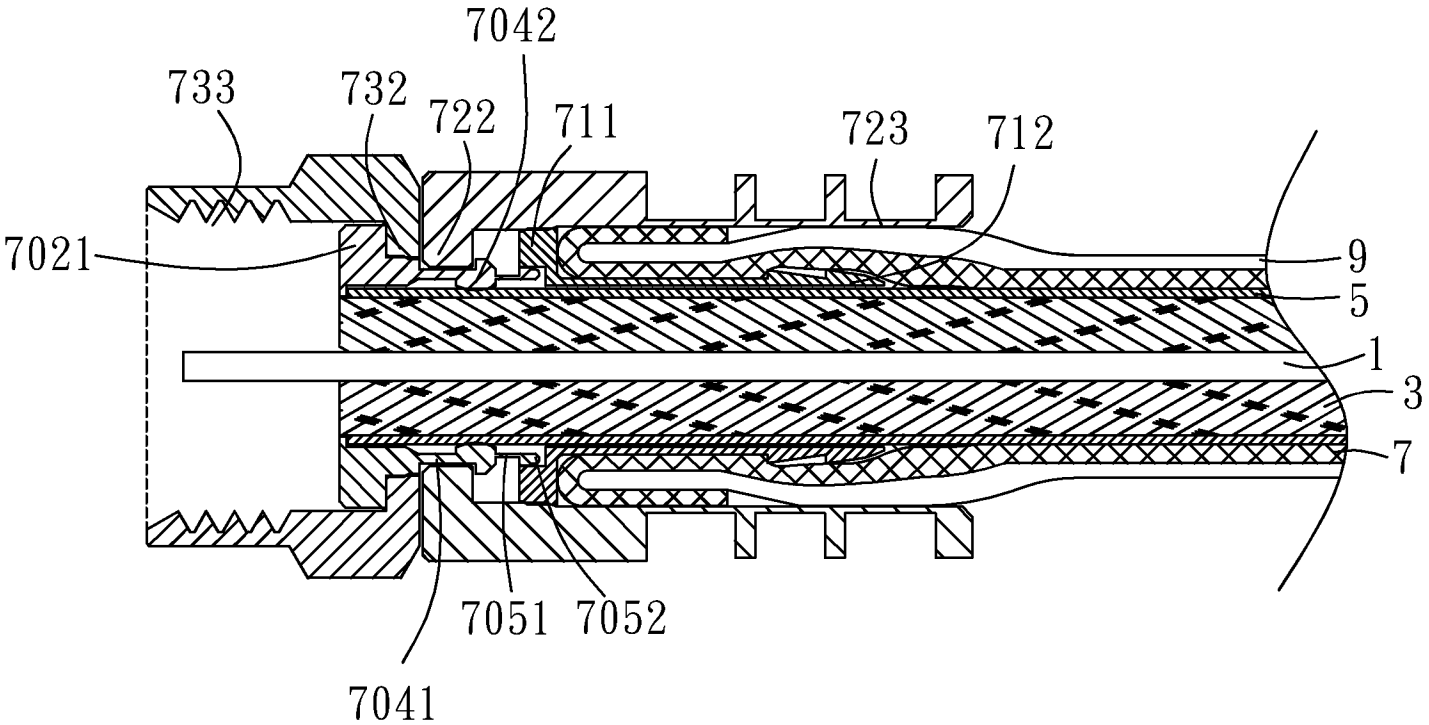
FIG. 8*e* shows a cross-sectional view of the coaxial cable connector assembled with a coaxial cable in accordance with the seventh embodiment of the present invention.

Referring to FIG. 8*e*, for assembling the coaxial cable as illustrated in FIG. 1 with the coaxial cable connector as illustrated in the seventh embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the second inner sleeve 71 into a through hole 713 in the second inner sleeve 71 and then into a through hole 701 in the first inner sleeve 70, and the folded front portion of the metal braided film 7 and the plastic jacket 9 are inserted from a back end of the outer sleeve 72 into the annular space between the rear extension portion 712 of the second inner sleeve 71 and the rear extension portion 723 of the outer sleeve 72. The metal wire 1 extends through the through hole 701 in the first inner sleeve 70 and the through hole 713 in the second inner sleeve 71 and to a space, surrounded by the inner thread 733 of the nut 73, outside the through hole 701. Next, a radial force may be applied to the outer sleeve 72 to be inwardly deformed such that the outer sleeve 72 and the second inner sleeve 71 may tightly clamp the coaxial cable in the annular space between the rear extension portions 712 and 723. Thereby, each of the flexible locking tongues 703 may have its second extending portion 705 formed to be flexible so as to have its locking portion 7052 always abutting against the annular step 7111 of the second inner sleeve 71 and have its first extending portion 704 with an inner arcuate surface always abutting against the thin metal film 5 of the coaxial cable, and the second inner sleeve 71 may have its rear extension portion 712 contacting the metal braided film 7 of the coaxial cable for grounding. Thus, good electrical ground connection for the nut 73 and the first inner sleeve 70 may be provided.

Accordingly, when the nut 73 accompanying with the first inner sleeve 70 is rotated relatively to the outer sleeve 72 and the second inner sleeve 71, good electrical ground connection between the nut 73 and the metal braided film 7 may be provided. No matter whether the nut 73 is fully or loosely locked to the externally threaded connector 2, good electrical ground connection may be provided to ensure good signal transmission.

Figure 8F:
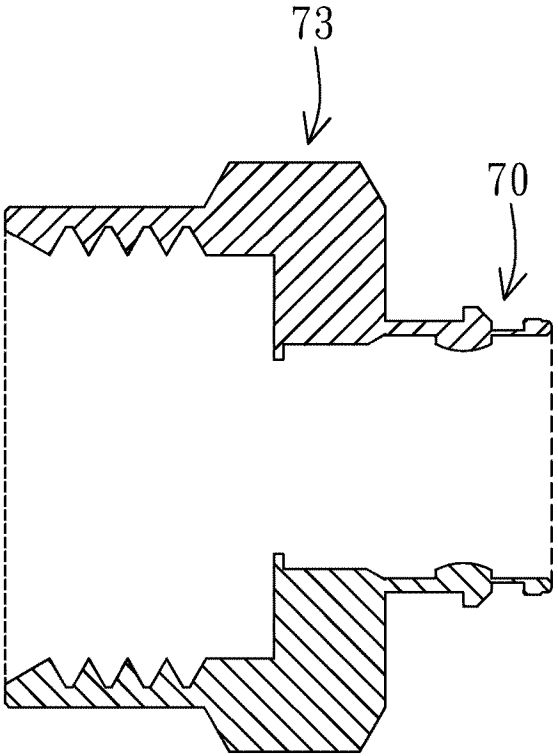
FIG. 8*f* shows a cross-sectional view of the coaxial cable connector having an inner-sleeve portion, i.e., first inner sleeve, and a nut portion integrally formed as a single part in accordance with the seventh embodiment of the present invention.

Alternatively, the first inner sleeve 70 and the nut 73 may be integrally formed as a single part, as shown in FIG. 8*f*. The single part may be divided into a net portion, derived from the net 73, and an inner-sleeve portion, derived from the first inner sleeve 70. The net portion and the inner-sleeve portion may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the single part.

Eighth Embodiment

Figure 9A:
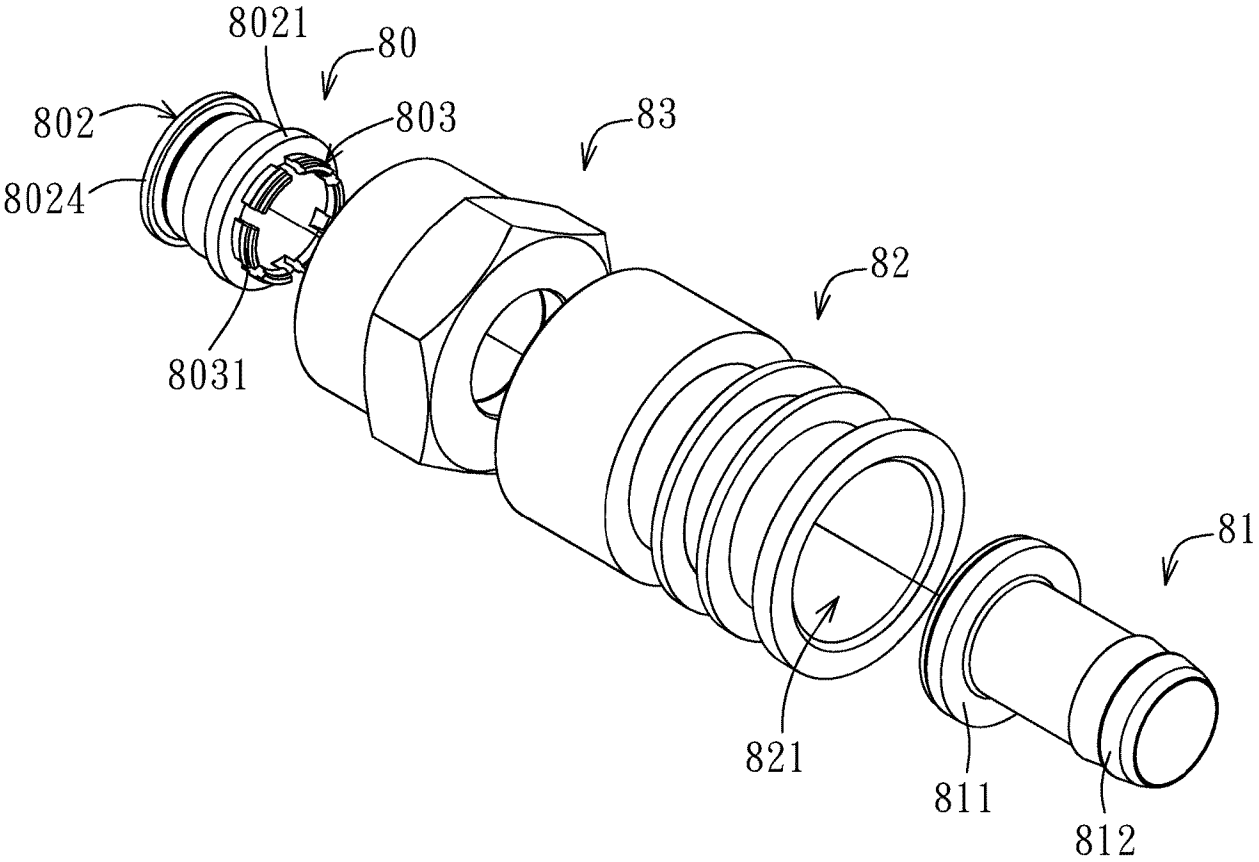
FIG. 9*a* shows a perspective exploded view of a coaxial cable connector in accordance with an eighth embodiment of the present invention.
Figure 9B:
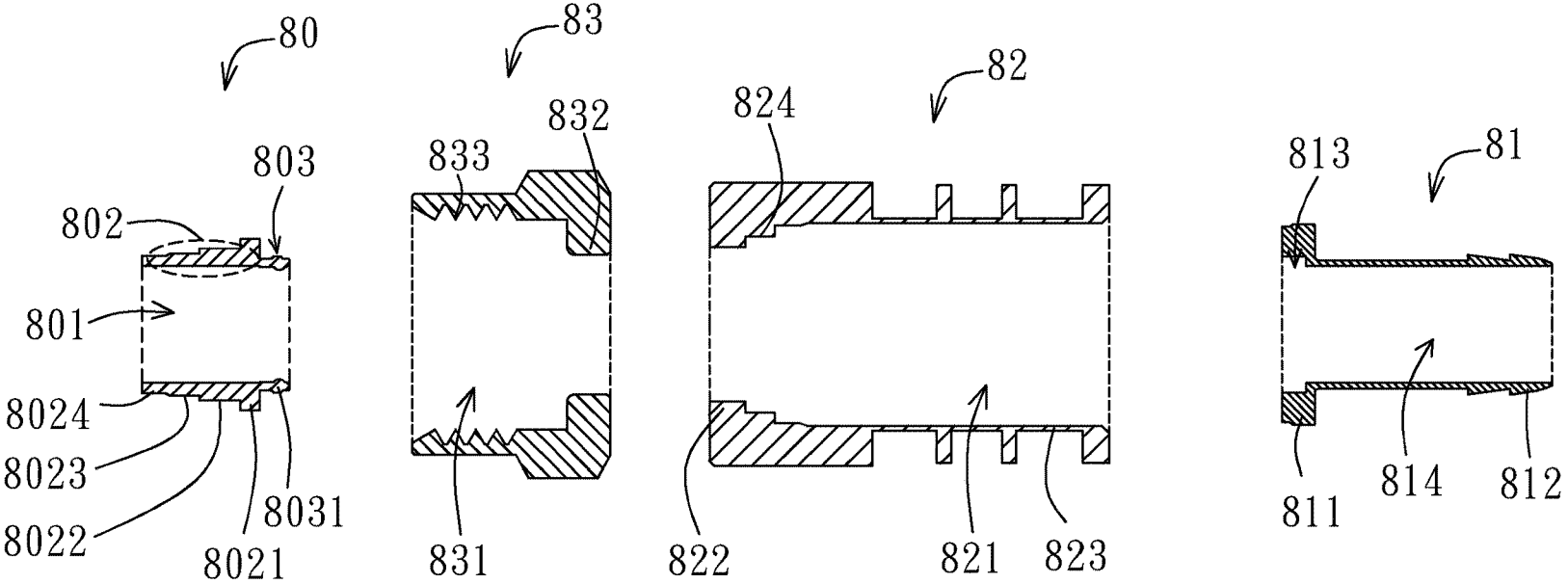
FIG. 9*b* shows a cross-sectional view of each element of the coaxial cable connector in accordance with the eighth embodiment of the present invention.
Figure 9C:
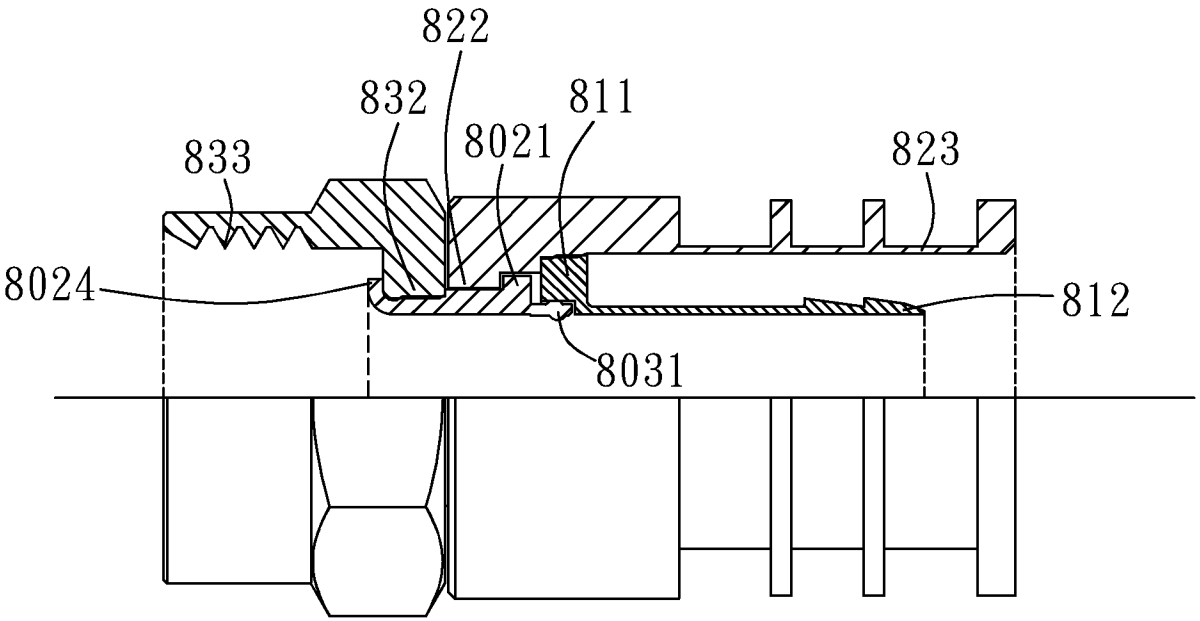
FIG. 9*c* shows a cross-sectional view of the coaxial cable connector in accordance with the eighth embodiment of the present invention.
Figure 9D:
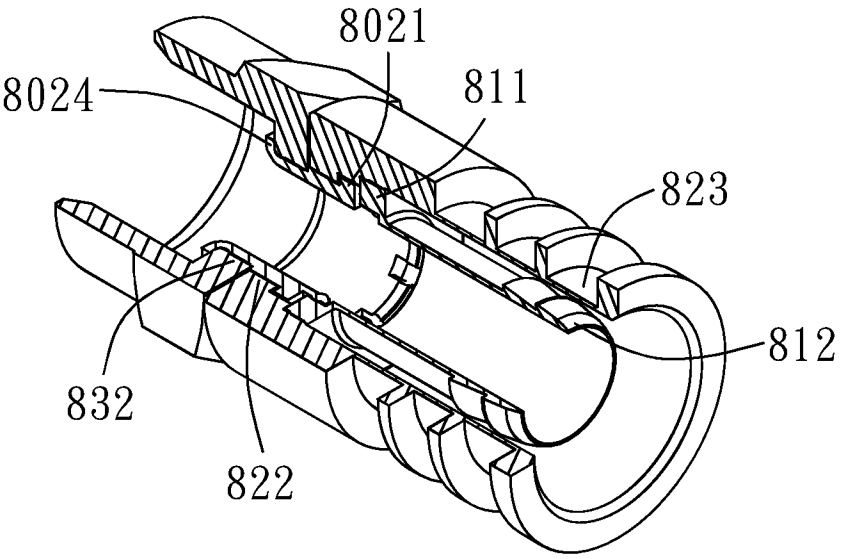
FIG. 9*d* shows a three-quarter cross-sectional perspective view of the coaxial cable connector in accordance with the eighth embodiment of the present invention.
Figure 9E:
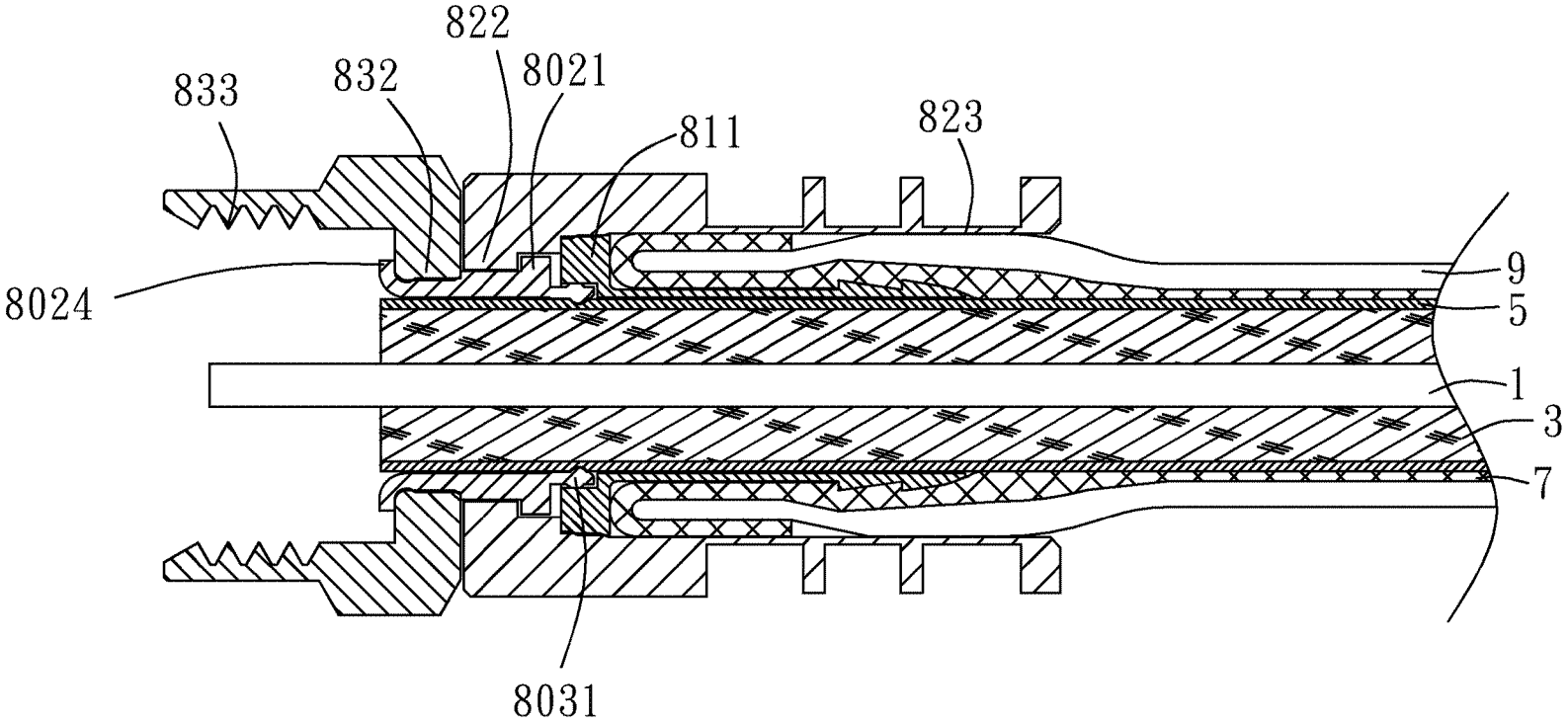
FIG. 9*e* shows a cross-sectional view of the coaxial cable connector assembled with a coaxial cable in accordance with the eighth embodiment of the present invention.

FIG. 9*a* shows a perspective exploded view of a coaxial cable connector in accordance with an eighth embodiment of the present invention. FIG. 9*b* shows a cross-sectional view of each element of the coaxial cable connector in accordance with the eighth embodiment of the present invention. FIG. 9*c* shows a cross-sectional view of the coaxial cable connector in accordance with the eighth embodiment of the present invention. FIG. 9*d* shows a three-quarter cross-sectional perspective view of the coaxial cable connector in accordance with the eighth embodiment of the present invention. Referring to FIGS. 9*a*-9*d*, the coaxial cable connector includes a first inner sleeve 80, a second inner sleeve 81, an outer sleeve 82 and a nut 83.

The first inner sleeve 80 may include a main body 802 and multiple flexible locking tongues 803 having front ends joining a rear side of the main body 802. The flexible locking tongues 803 are arranged in a circle about the axial direction with an equal arcuate gap between each neighboring two of the flexible locking tongues 803. Each of the flexible locking tongues 803 includes a locking portion 8031 at a rear end thereof. The main body 802 includes an outer flange 8021, a first cylindrical surface 8022, a second cylindrical surface 8023 and a front extension portion 8024, which compose annular steps at an outer cylindrical wall of the main body 802. The first cylindrical surface 8022 is arranged between the outer flange 8021 and the second cylindrical surface 8023 in the axial direction; the second cylindrical surface 8023 is arranged between the front extension portion 8024 and the first cylindrical surface 8022 in the axial direction. The second inner sleeve 81 may include an outer flange 811, a rear extension portion 812 and an annular step 813 circumferentially formed at a front side of an inner cylindrical wall of the second inner sleeve 81. The nut 83 includes an inner flange 832 and an inner thread 833. The outer sleeve 82 includes an inner flange 822, a rear extension portion 823 and a first cylindrical surface 824, wherein the first cylindrical surface 824 is between the inner flange 822 and the rear extension portion 823 in the axial direction. The rear extension portion 823, the first cylindrical surface 824 and the inner flange 822 compose annular steps at an inner cylindrical wall of the outer sleeve 82. The rear extension portion 823 has an inner diameter greater than an outer diameter of each of the flexible locking tongues 803 and then an outer diameter of the rear extension portion 812, and the rear extension portion 812 has an inner diameter substantially equal to an inner diameter of each of the flexible locking tongues 803. Each of the flexible locking tongues 803 may have an axial length less than that of the rear extension portion 812. The nut 83 may be a hex nut, square nut, ring nut, wing nut or any other type of nut, which may be assembled with an externally threaded connector of an electronic device using a wrench or other tools.

The assembly for the coaxial cable connector in the eighth embodiment is mentioned as below. First, the first inner sleeve 80 is inserted into a through hole 821 in the outer sleeve 82 from a rear end of the outer sleeve 82 such that the inner flange 822 of the outer sleeve 82 has a rear radially extending surface against a front radially extending surface of the outer flange 8021 of the first inner sleeve 80. Next, the first inner sleeve 80 is inserted into a through hole 831 in the nut 83 from a rear end of the nut 83 such that the inner flange 832 of the nut 83 has a rear radially extending surface against a front radially extending surface of an annular step of the first inner sleeve 80 between the first and second cylindrical surfaces 8022 and 8023 with the front extension portion 8024 inwardly protruding from a front radially extending surface of inner flange 832 of the nut 83. Next, the front extension portion 8024 may be outwardly deformed by a riveting process so as to have a front terminal contacting the front radially extending surface of the inner flange 832. Thereby, the nut 83 may be fixed with the first inner sleeve 80 and the inner flange 832 of the nut 83 may have an inner cylindrical surface circumferentially around the second cylindrical surface 8023 of the first inner sleeve 80. The inner flange 822 of the outer sleeve 82 may have an inner cylindrical surface circumferentially around the first cylindrical surface 8022 of the first inner sleeve 80. Thereby, the outer sleeve 82 may be restricted from moving in the axial direction relatively to the first inner sleeve 80 but allow the outer sleeve 82 to rotate relatively to the first inner sleeve 80. Next, the second inner sleeve 81 is moved into the through hole 821 in the outer sleeve 82 from the rear extension portion 823 of the outer sleeve 82, during which each of the flexible locking tongues 803 may be radially inwardly deformed due to its locking portion 8031 pressed by the annular step 813 of the second inner sleeve 81 such that the annular step 813 of the second inner sleeve 81 may be engaged with its locking portion 8031 and the outer flange 811 may be moved to a gap between its locking portion 8031 and an inner cylindrical wall of the outer sleeve 82. The outer flange 811 of the second inner sleeve 81 may have an outer cylindrical surface to be fixed, e.g., by way of tightly fitting, tolerance fitting, sintered metal bonding or adhesive bonding, with the inner cylindrical wall of the outer sleeve 82. The rear extension portion 812 is concentrically surrounded by the rear extension portion 823. Each of the flexible locking tongues 803 may be formed to be flexible so as to have its locking portion 8031 always abutting against the annular step 811 of the second inner sleeve 81. Thereby, when the nut 83 is rotated relatively to the second inner sleeve 81 and the outer sleeve 82, the first inner sleeve 80 may also rotate relatively to both of the second inner sleeve 81 and the outer sleeve 82.

Referring to FIG. 8*e*, for assembling the coaxial cable as illustrated in FIG. 1 with the coaxial cable connector as illustrated in the eighth embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the second inner sleeve 81 into a through hole 814 in the second inner sleeve 81 and then into a through hole 801 in the first inner sleeve 80, and the folded front portion of the metal braided film 7 and the plastic jacket 9 are inserted from a back end of the outer sleeve 82 into the annular space between the rear extension portion 812 of the second inner sleeve 81 and the rear extension portion 823 of the outer sleeve 82. The metal wire 1 extends through the through hole 801 in the first inner sleeve 80 and the through hole 814 in the second inner sleeve 81 and to a space, surrounded by the inner thread 833 of the nut 83, outside the through hole 801. Next, a radial force may be applied to the outer sleeve 82 to be inwardly deformed such that the outer sleeve 82 and the second inner sleeve 81 may tightly clamp the coaxial cable in the annular space between the rear extension portions 812 and 823. Thereby, each of the flexible locking tongues 803 may be flexible so as to have its locking portion 8031 always abutting against the annular step 813 of the second inner sleeve 81 and have an inner arcuate surface always abutting against the thin metal film 5 of the coaxial cable, and the second inner sleeve 81 may have its rear extension portion 812 contacting the metal braided film 7 of the coaxial cable for grounding. Thus, good electrical ground connection for the nut 83 and the first inner sleeve 80 may be provided.

Accordingly, when the nut 83 accompanying with the first inner sleeve 80 is rotated relatively to the outer sleeve 82 and the second inner sleeve 81, good electrical ground connection between the nut 83 and the metal braided film 7 may be provided. No matter whether the nut 83 is fully or loosely locked to the externally threaded connector 2, good electrical ground connection may be provided to ensure good signal transmission.

Ninth Embodiment

Figure 10A:
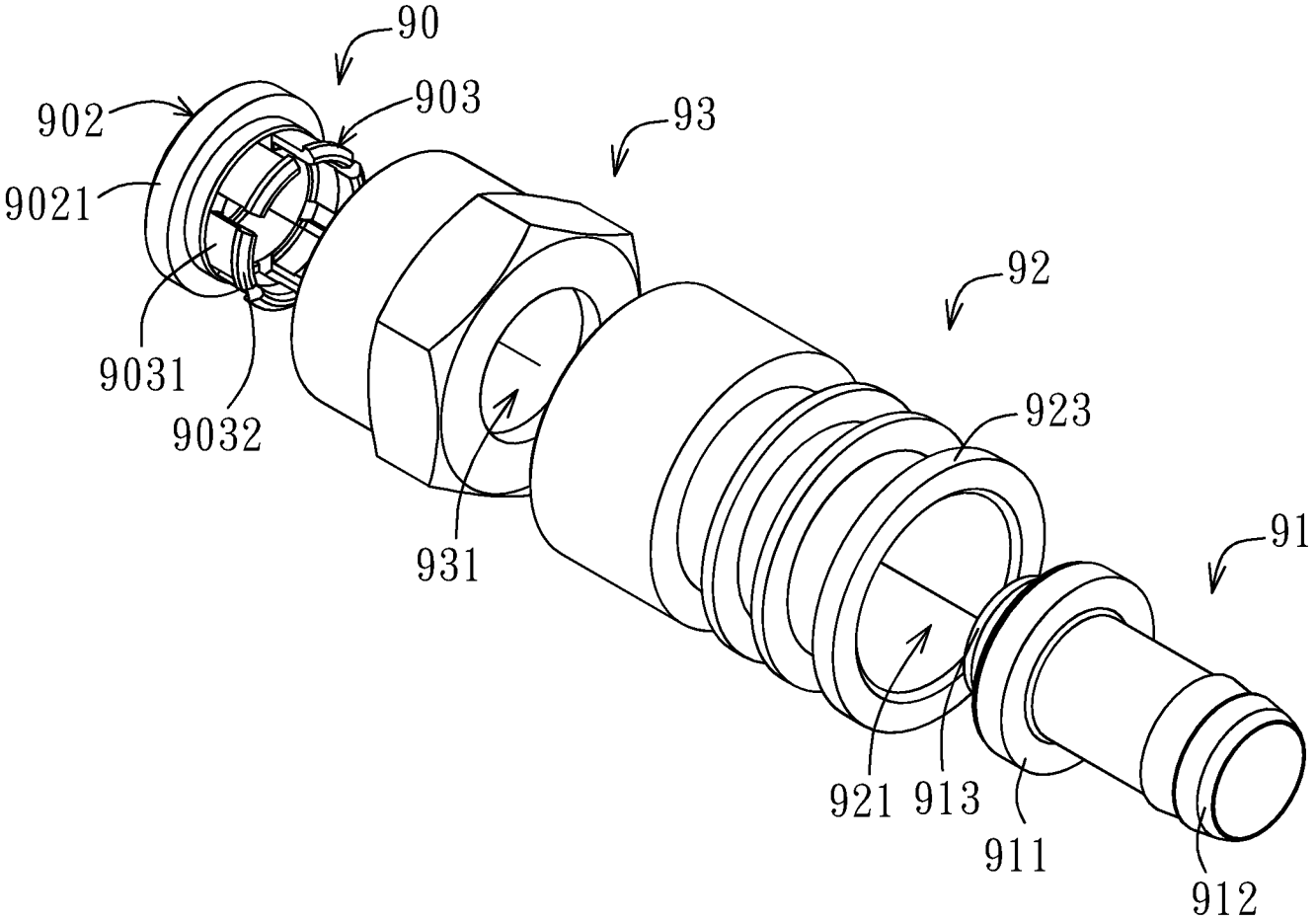
FIG. 10*a* shows a perspective exploded view of a coaxial cable connector in accordance with a ninth embodiment of the present invention.
Figure 10B:
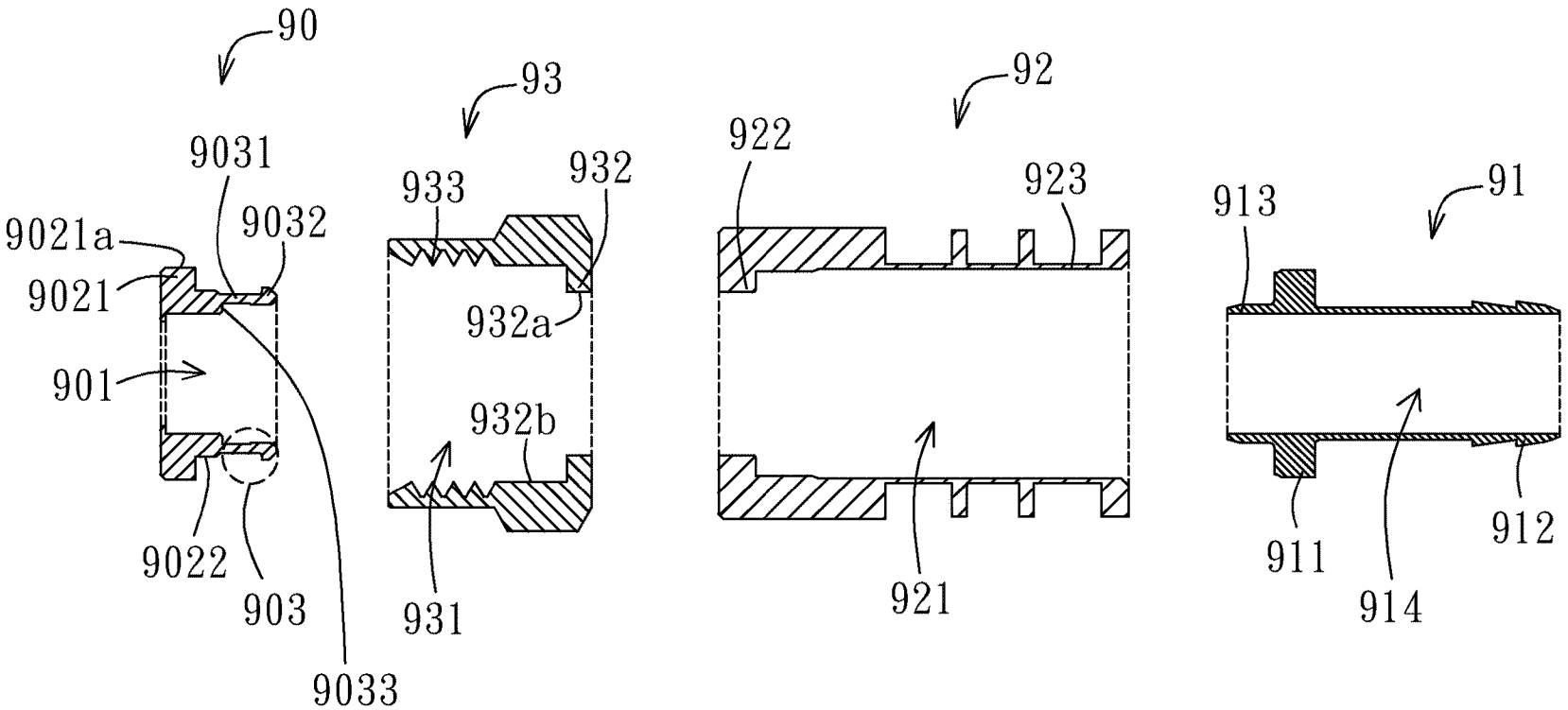
FIG. 10*b* shows a cross-sectional view of each element of the coaxial cable connector in accordance with the ninth embodiment of the present invention.
Figure 10C:
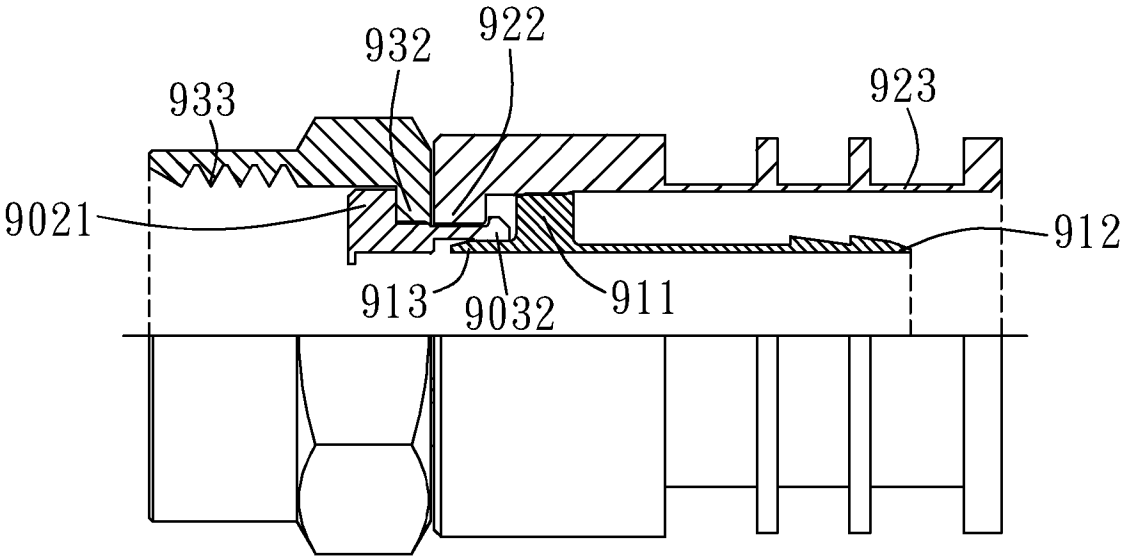
FIG. 10*c* shows a cross-sectional view of the coaxial cable connector in accordance with the ninth embodiment of the present invention.
Figure 10D:
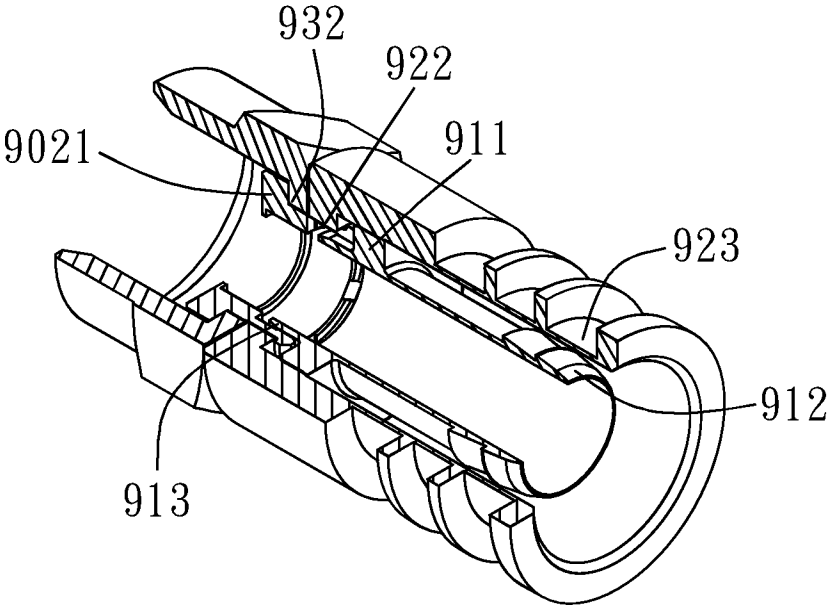
FIG. 10*d* shows a three-quarter cross-sectional perspective view of the coaxial cable connector in accordance with the ninth embodiment of the present invention.

FIG. 10*a* shows a perspective exploded view of a coaxial cable connector in accordance with a ninth embodiment of the present invention. FIG. 10*b* shows a cross-sectional view of each element of the coaxial cable connector in accordance with the ninth embodiment of the present invention. FIG. 10*c* shows a cross-sectional view of the coaxial cable connector in accordance with the ninth embodiment of the present invention. FIG. 10*d* shows a three-quarter cross-sectional perspective view of the coaxial cable connector in accordance with the ninth embodiment of the present invention. Referring to FIGS. 10*a*-10*d*, the coaxial cable connector includes a first inner sleeve 90, a second inner sleeve 91, an outer sleeve 92 and a nut 93.

The first inner sleeve 90 may include a main body 902 and multiple flexible locking tongues 903 having front ends joining a rear side of the main body 902. The flexible locking tongues 903 are arranged in a circle about the axial direction with an equal arcuate gap between each neighboring two of the flexible locking tongues 903. The main body 902 includes an outer flange 9021 and a first cylindrical surface 9022, and each of the flexible locking tongues 903 includes a recess portion 9031 and a locking portion 9032, wherein its recess portion 9031 is arranged between the first cylindrical surface 9022 and its locking portion 9032, and its locking portion 9032 is arranged at a rear end thereof. Multiple inner arcuate steps 9033 are formed at joints of the flexible locking tongues 903 and the main body 902. The second inner sleeve 91 may include an outer flange 911, a rear extension portion 912 and a front extension portion 913, wherein the outer flange 911 is arranged between the rear extension portion 912 and the front extension portion 913 in the axial direction. The nut 93 includes an inner flange 932 and an inner thread 933. The outer sleeve 92 includes an inner flange 922 and a rear extension portion 923. The rear extension portion 923 has an inner diameter greater than an outer diameter of each of the flexible locking tongues 903 and then an outer diameter of the rear extension portion 912, and each of the flexible locking tongues 903 has an inner diameter greater than an inner diameter of the rear extension portion 912 and then an inner diameter of the front extension portion 913. Each of the flexible locking tongues 903 may have an axial length less than that of the rear extension portion 912. The nut 93 may be a hex nut, square nut, ring nut, wing nut or any other type of nut, which may be assembled with an externally threaded connector of an electronic device using a wrench or other tools.

The assembly for the coaxial cable connector in the ninth embodiment is mentioned as below. First, the first inner sleeve 90 has the flexible locking tongues 903 inserted into a through hole 931 in the nut 93 from a front end of the nut 93 and then the nut 93 is fixed, e.g., by way of tightly fitting, tolerance fitting, sintered metal bonding or adhesive bonding, with the first inner sleeve 90 such that the inner flange 932 of the nut 93 has an inner cylindrical surface 932*a* tightly fitted with or securely fixed with the first cylindrical surface 9022 of the first inner sleeve 90 and the outer flange 9021 of the first inner sleeve 90 has an outer cylindrical surface 9021*a* tightly fitted with or securely fixed with an inner cylindrical surface 932*b* of the nut 93. The inner cylindrical surface 932*b* is formed between the inner thread 933 and the inner flange 932 in the axial direction. Next, the flexible locking tongues 903 of the first inner sleeve 90 is inserted into a through hole 921 in the outer sleeve 92, during which each of the flexible locking tongues 903 may be radially inwardly deformed due to its locking portion 9032 pressed by the inner flange 922 of the outer sleeve 92, such that the inner flange 922 of the outer sleeve 92 may be engaged with its recess portion 9031 and the nut 93 has the inner flange 932 with a back radially extending surface in contact with a front radially extending surface of the outer sleeve 92. Thereby, the outer sleeve 92 may be restricted from moving in the axial direction relatively to the first inner sleeve 90 but allow the outer sleeve 92 to rotate relatively to the first inner sleeve 90. Next, the second inner sleeve 91 is moved into the through hole 921 in the outer sleeve 92 from the rear extension portion 923 of the outer sleeve 92, during which the second inner sleeve 91 may have its front extension portion 913 with an outer cylindrical surface to be engaged with the inner arcuate steps 9033 of the flexible locking tongues 903. The outer flange 911 of the second inner sleeve 91 may have an outer cylindrical surface to be fixed, e.g., by way of tightly fitting, tolerance fitting, sintered metal bonding or adhesive bonding, with the inner cylindrical wall of the outer sleeve 92. The rear extension portion 912 is concentrically surrounded by the rear extension portion 923. Thereby, when the nut 93 is rotated relatively to the second inner sleeve 91 and the outer sleeve 92, the first inner sleeve 90 may also rotate relatively to both of the second inner sleeve 91 and the outer sleeve 92.

Figure 10E:
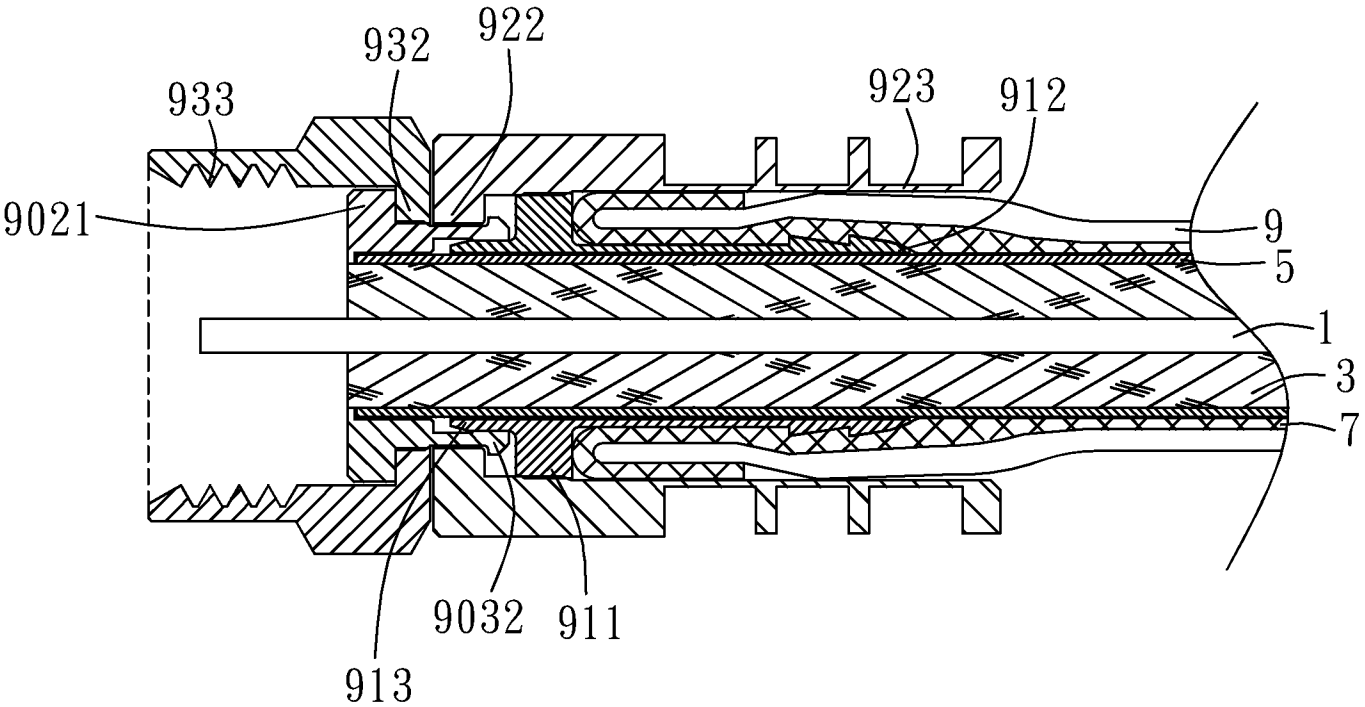
FIG. 10*e* shows a cross-sectional view of the coaxial cable connector assembled with a coaxial cable in accordance with the ninth embodiment of the present invention.

Referring to FIG. 10*e*, for assembling the coaxial cable as illustrated in FIG. 1 with the coaxial cable connector as illustrated in the ninth embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the second inner sleeve 91 into a through hole 914 in the second inner sleeve 91 and then into a through hole 901 in the first inner sleeve 90, and the folded front portion of the metal braided film 7 and the plastic jacket 9 are inserted from a back end of the outer sleeve 92 into the annular space between the rear extension portion 912 of the second inner sleeve 91 and the rear extension portion 923 of the outer sleeve 92. The metal wire 1 extends through the through hole 901 in the first inner sleeve 90 and the through hole 914 in the second inner sleeve 91 and to a space, surrounded by the inner thread 933 of the nut 93, outside the through hole 901. Next, a radial force may be applied to the outer sleeve 92 to be inwardly deformed such that the outer sleeve 92 and the second inner sleeve 91 may tightly clamp the coaxial cable in the annular space between the rear extension portions 912 and 923. Thereby, each of the flexible locking tongues 903 may always abut against the front extension portion 913 of the second inner sleeve 91 and the second inner sleeve 91 may have its rear extension portion 912 contacting the metal braided film 7 of the coaxial cable for grounding. Thus, good electrical ground connection for the nut 93 and the first inner sleeve 90 may be provided.

Accordingly, when the nut 93 accompanying with the first inner sleeve 90 is rotated relatively to the outer sleeve 92 and the second inner sleeve 91, good electrical ground connection between the nut 93 and the metal braided film 7 may be provided. No matter whether the nut 93 is fully or loosely locked to the externally threaded connector 2, good electrical ground connection may be provided to ensure good signal transmission.

Figure 10F:
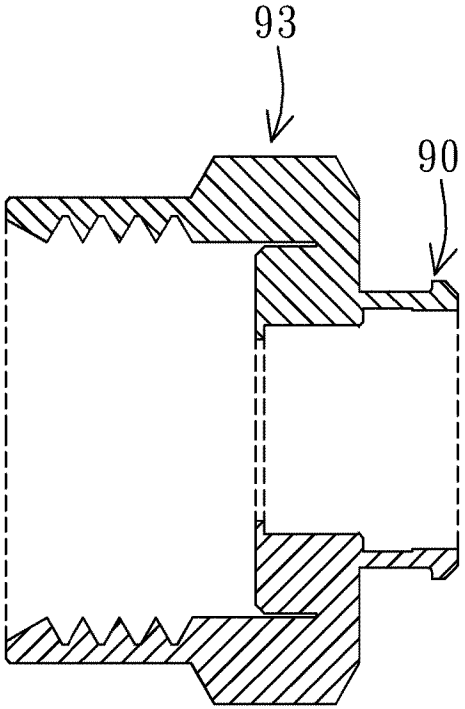
FIG. 10*f* shows a cross-sectional view of the coaxial cable connector having an inner-sleeve portion, i.e., first inner sleeve, and a nut portion integrally formed as a single part in accordance with the ninth embodiment of the present invention.

Alternatively, the first inner sleeve 90 and the nut 93 may be integrally formed as a single part, as shown in FIG. 10*f*. The single part may be divided into a net portion, derived from the net 93, and an inner-sleeve portion, derived from the first inner sleeve 90. The net portion and the inner-sleeve portion may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the single part.

Tenth Embodiment

In the first through sixth embodiments, each of the second inner sleeves 11, 21, 31, 41, 51 and 61 may have its rear extension portion 112, 212, 312, 412, 512 or 612 with a cylindrical inner wall having an inner diameter greater than an outer diameter of an outer wall of the rear extension portion 106, 206, 306, 406, 506 or 606 of the corresponding first inner sleeve 10, 20, 30, 40, 50 or 60, and each of the rear extension portions 112, 212, 312, 412, 512 and 612 may have its cylindrical inner wall not contacting the thin metal film 5 of the coaxial cable assembled with the corresponding coaxial cable connector. The structure may be improved as mentioned below. Alternatively, each of the second inner sleeves 11, 21, 31, 41, 51 and 61 may have its rear extension portion 112, 212, 312, 412, 512 or 612 with a cylindrical inner wall having an inner diameter substantially equal to that of a cylindrical inner wall of the rear extension portion 106, 206, 306, 406, 506 or 606 of the corresponding first inner sleeve 10, 20, 30, 40, 50 or 60. Each of the rear extension portions 112, 212, 312, 412, 512 and 612 may have its cylindrical inner wall configured to contact the thin metal film 5 of the coaxial cable connector assembled with the corresponding coaxial cable connector. The following paragraphs describe the improvement for the first embodiment, and the improvement may also be applied to the second through sixth embodiments.

First Improved Type of Coaxial Cable Connector

Figure 11A:
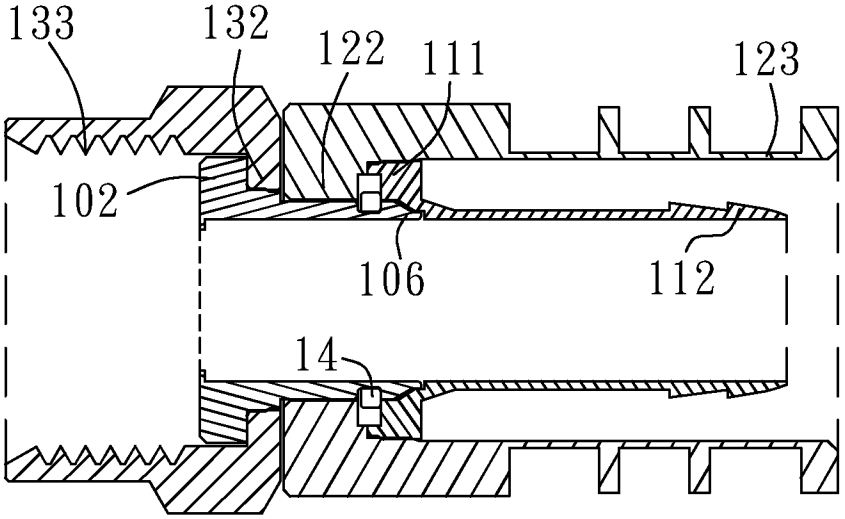
FIG. 11*a* shows a cross-sectional view of a first type of coaxial cable connector in accordance with a tenth embodiment of the present invention.

FIG. 11*a* shows a cross-sectional view of a first improved type of coaxial cable connector in accordance with a tenth embodiment of the present invention. Referring to FIG. 11*a*, an improved second inner sleeve, derived from the second inner sleeve 11 as illustrated in the first embodiment, has a rear extension portion 112 with a cylindrical inner wall having an inner diameter substantially equal to that of a cylindrical inner wall of a rear extension portion 106 of an improved first inner sleeve, derived from the first inner sleeve 10 as illustrated in the first embodiment, i.e. the second inner sleeve 11 of the improved coaxial cable connector may have the cylindrical inner wall coplanar with that of the first inner sleeve 10 of the improved coaxial cable connector, such that the improved coaxial cable connector when assembled with the coaxial cable shown in FIG. 1 may have its rear extension portion 112 with the cylindrical inner wall contacting the thin metal film 5 of the coaxial cable. Thereby, in comparison with the assembly as illustrated in FIGS. 2*a*-2*g*, the coaxial cable may be relatively firmly fixed to the improved coaxial cable connector and the improved first inner sleeve, when being rotated relatively to the improved second inner sleeve and the coaxial cable, may have relatively small friction to the improved second inner sleeve and the coaxial cable due to the relatively small contact areas between the improved first inner sleeve and the improved second inner sleeve and between the improved first inner sleeve and the thin metal film 5 of the coaxial cable. The improved first inner sleeve has the cylindrical inner wall with a cylindrical area, configured to contact the thin metal film 5 of the coaxial cable, less than a cylindrical area, configured to contact the thin metal film 5 of the coaxial cable, of the cylindrical inner wall of the improved second inner sleeve. An element shown in FIG. 11*a* having the same reference number as that illustrated in FIGS. 2*a*-2*g* may be referred to the description for that as illustrated in FIGS. 2*a*-2*g*. The improved first inner sleeve may include a material as illustrated for the first inner sleeve 10 in the first embodiment. The improved second inner sleeve may include a material as illustrated for the second inner sleeve 11 in the first embodiment.

Second Improved Type of Coaxial Cable Connector

Figure 11B:
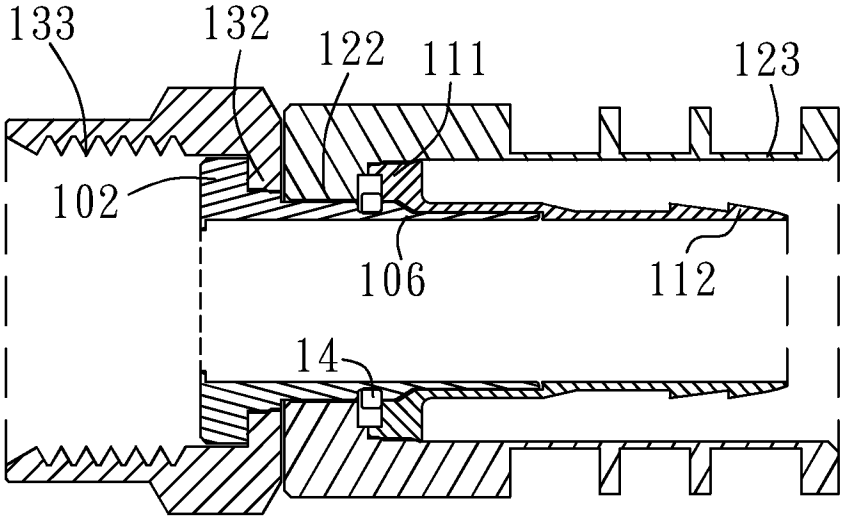
FIG. 11*b* shows a cross-sectional view of a second type of coaxial cable connector in accordance with the tenth embodiment of the present invention.

FIG. 11*b* shows a cross-sectional view of a second improved type of coaxial cable connector in accordance with a tenth embodiment of the present invention. Referring to FIG. 11*b*, an improved second inner sleeve, derived from the second inner sleeve 11 as illustrated in the first embodiment, has a rear extension portion 112 with a cylindrical inner wall having an inner diameter substantially equal to that of a cylindrical inner wall of a rear extension portion 106 of an improved first inner sleeve, derived from the first inner sleeve 10 as illustrated in the first embodiment, i.e. the second inner sleeve 11 of the improved coaxial cable connector may have the cylindrical inner wall coplanar with that of the first inner sleeve 10 of the improved coaxial cable connector, such that the improved coaxial cable connector when assembled with the coaxial cable shown in FIG. 1 may have its rear extension portion 112 with the cylindrical inner wall contacting the thin metal film 5 of the coaxial cable. Thereby, in comparison with the assembly as illustrated in FIGS. 2*a*-2*g*, the coaxial cable may be relatively firmly fixed to the improved coaxial cable connector and the improved first inner sleeve, when being rotated relatively to the improved second inner sleeve and the coaxial cable, may have relatively small friction to the improved second inner sleeve and the coaxial cable due to the relatively small contact areas between the improved first inner sleeve and the improved second inner sleeve and between the improved first inner sleeve and the thin metal film 5 of the coaxial cable. The improved first inner sleeve has the cylindrical inner wall with a cylindrical area, configured to contact the thin metal film 5 of the coaxial cable, greater than a cylindrical area, configured to contact the thin metal film 5 of the coaxial cable, of the cylindrical inner wall of the improved second inner sleeve. An element shown in FIG. 11*b* having the same reference number as that illustrated in FIGS. 2*a*-2*g* may be referred to the description for that as illustrated in FIGS. 2*a*-2*g*. The improved first inner sleeve may include a material as illustrated for the first inner sleeve 10 in the first embodiment. The improved second inner sleeve may include a material as illustrated for the second inner sleeve 11 in the first embodiment.

Figure 11C:
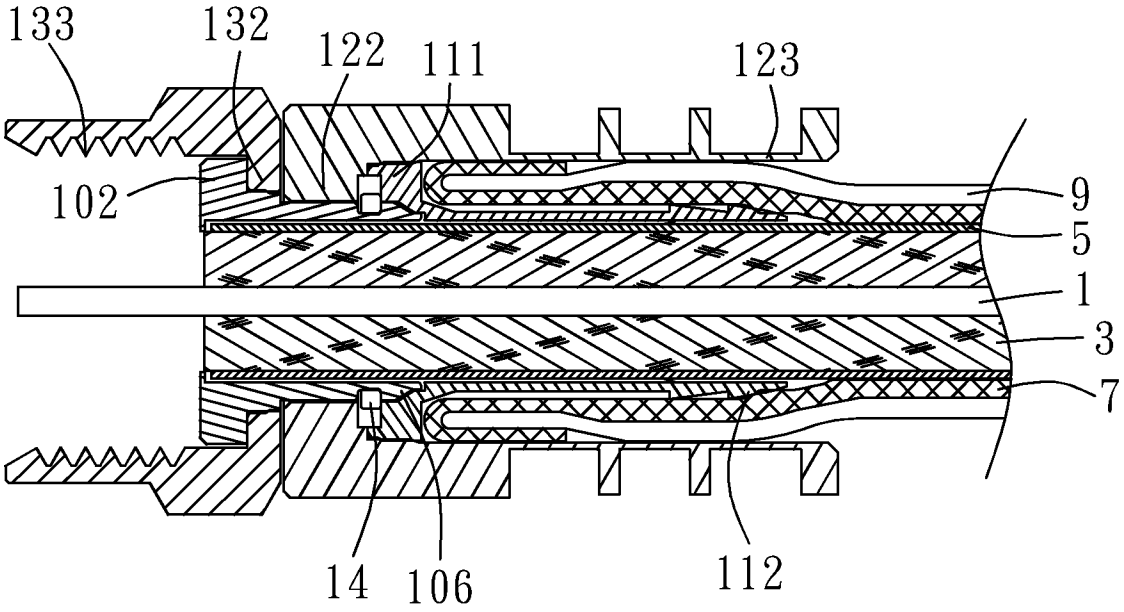
FIG. 11*c* shows a cross-sectional view of the first type of coaxial cable connector assembled with a coaxial cable in accordance with the tenth embodiment of the present invention.

Referring to FIG. 11*c*, for assembling the coaxial cable as illustrated in FIG. 1 with the improved coaxial cable connector as illustrated in the tenth embodiment, the metal braided film 7 has a front portion folded back over an outer cylindrical surface of the plastic jacket 9. Next, the coaxial cable has the metal wire 1, insulating layer 3 and thin metal film 5 to be inserted from a back end of the improved second inner sleeve into a through hole in the improved second inner sleeve and then into a through hole in the improved first inner sleeve and the folded front portion of the metal braided film 7 and the plastic jacket 9 are inserted from a back end of the outer sleeve 12 into the annular space between the rear extension portion 112 of the improved second inner sleeve 11 and the rear extension portion 123 of the outer sleeve 12. The metal wire 1 extends through the through holes in the improved first and second inner sleeves and to a space, surrounded by the inner thread 133 of the nut 13, outside the through holes in the improved first and second inner sleeves. Next, a radial force may be applied to the outer sleeve 12 to be inwardly deformed such that the outer sleeve 12 and the improved second inner sleeve may tightly clamp the coaxial cable in the annular space between the rear extension portions 112 and 123. Thereby, the coaxial cable connector may be assembled with the coaxial cable and good electrical ground connection between the nut 13 and the metal braided film 7 may be provided.

Also, each of the second inner sleeves 21, 31, 41, 51 and 61 respectively in the second through sixth embodiments may have its rear extension portion 212, 312, 412, 512 or 612 to be designed like the rear extension portion 112 of the improved second inner sleeve in the tenth embodiment. Each of the first inner sleeves 20, 30, 40, 50 and 60 respectively in the second through sixth embodiments may have its rear extension portion 206, 306, 406, 506 or 606 to be designed like the rear extension portion 106 of the improved first inner sleeve in the tenth embodiment.

In the above first through tenth embodiments, after each of the coaxial cable connectors is assembled with the externally threaded connector 2, the corresponding outer sleeve 12, 22, 32, 42, 52, 62, 72, 82 or 92 may rotates relatively to the corresponding nut 13, 23, 33, 43, 53, 63, 73, 83 or 93. However, for the requirements in some country, after a coaxial cable connector is assembled with the externally threaded connector 2, its outer sleeve is required not to rotate relatively to its nut. For meeting the requirement, the present invention provides some embodiments mentioned as below.

Eleventh Embodiment

Figure 12A:
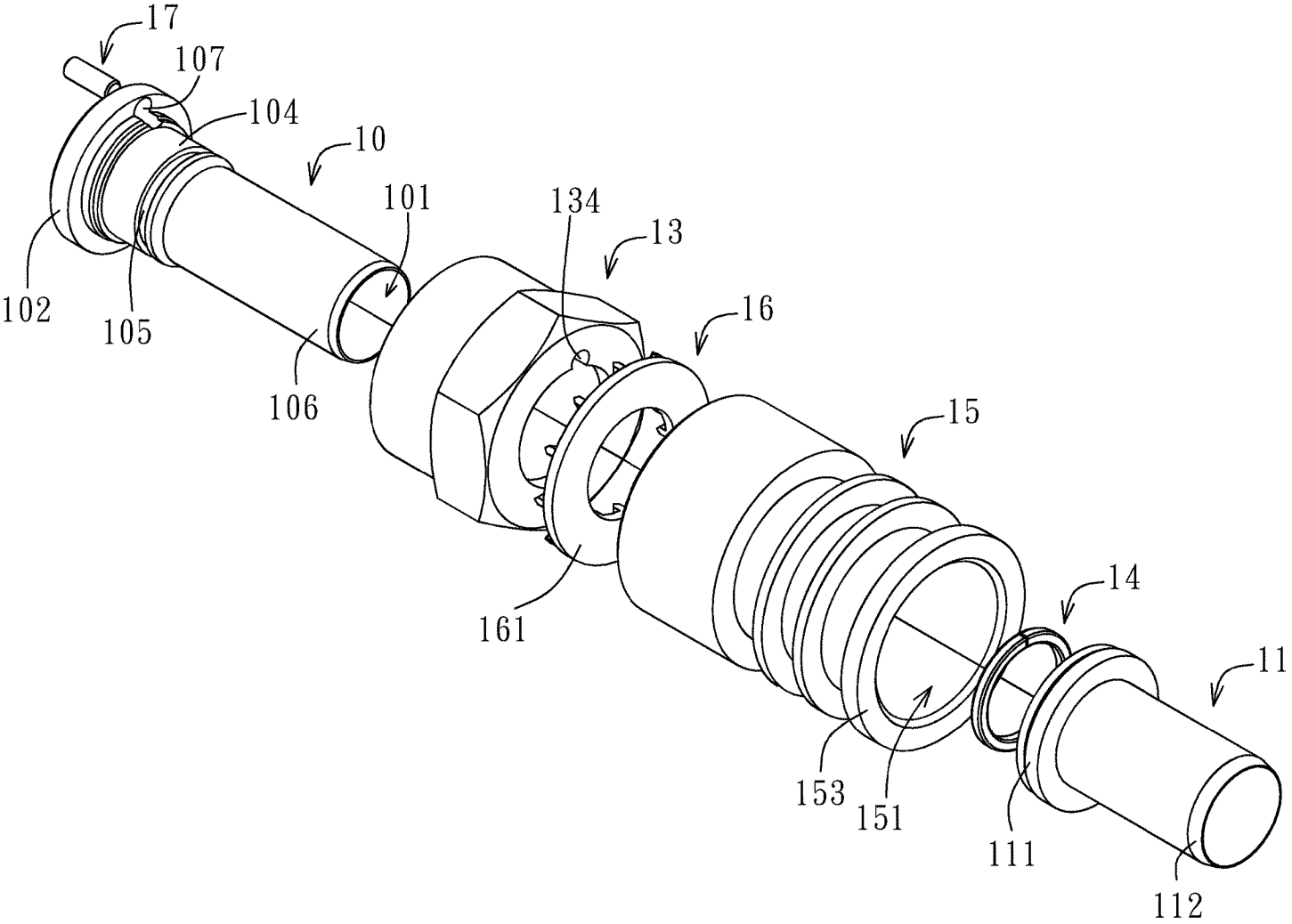
FIG. 12*a* shows a perspective exploded view of a coaxial cable connector in accordance with an eleventh embodiment of the present invention.
Figure 12B:
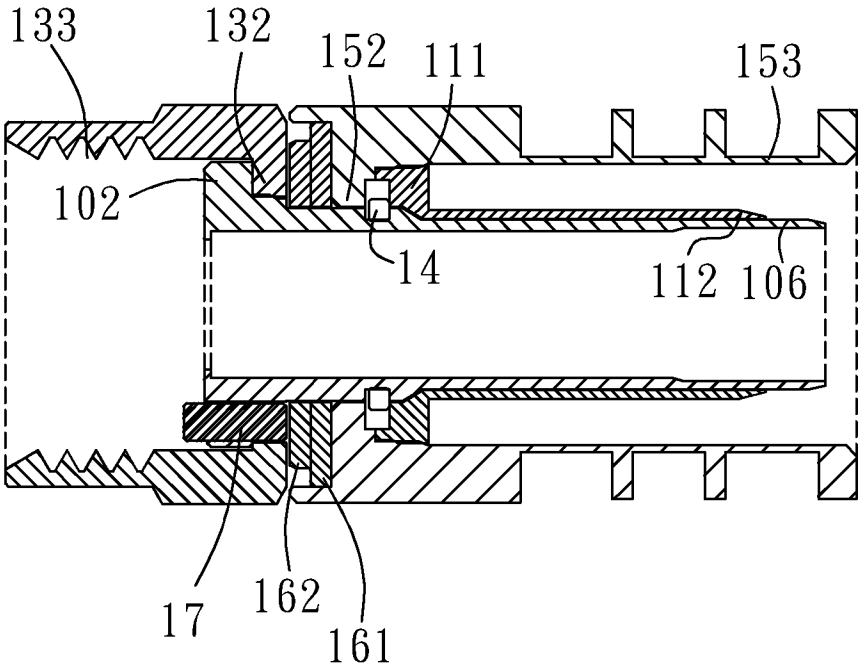
FIG. 12*b* shows a cross-sectional view of the coaxial cable connector in accordance with the eleventh embodiment of the present invention.

An element shown in FIGS. 12*a*-12*h* having the same reference number as that illustrated in FIGS. 2*a*-2*g* may be referred to the description for that as illustrated in FIGS. 2*a*-2*g*. FIG. 12*a* shows a perspective exploded view of a coaxial cable connector in accordance with an eleventh embodiment of the present invention. FIG. 12*b* shows a cross-sectional view of the coaxial cable connector in accordance with the eleventh embodiment of the present invention. Referring to FIGS. 12*a* and 12*b*, a coaxial cable connector in the eleventh embodiment may further include a locking element 16 coaxial with the nut 13, first and second inner sleeves 10 and 11, and outer sleeve 15. The locking element 16 may be sleeved around the first inner sleeve 10 and in an annular recess portion, around the first inner sleeve 10, of the outer sleeve 15. The nut 13 may have the inner flange 132 between the outer flange 102 of the inner sleeve 10 and the locking element. An axial through hole 107 passing through the outer flange 102 of the inner sleeve 10 is configured to be aligned with an axial groove 134 in an inner wall of the inner flange 132 of the nut 13. The coaxial cable connector may further include a locking pin configured to be inserted into the axial through hole 107 and the axial groove 134 to prevent the nut 13.

Figure 12D:
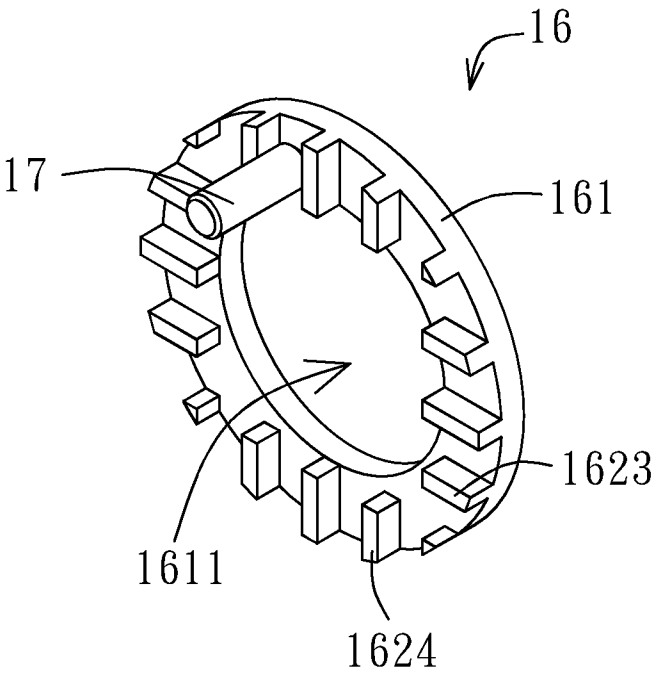
FIG. 12*d* shows a schematically perspective view of a second type of locking element in accordance with the eleventh embodiment of the present invention.
Figure 12C:
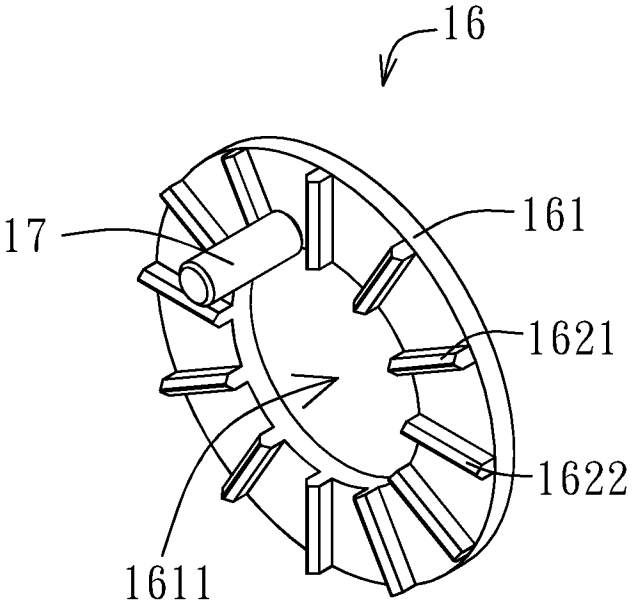
FIG. 12*c* shows a schematically perspective view of a first type of locking element in accordance with the eleventh embodiment of the present invention.

The outer sleeve 15 may include a front extension portion 154 annularly arranged to form a sidewall of the recess portion of the outer sleeve 15. The locking element 16 may include a ring-shaped plate 161 and multiple protrusions 162, integral with the ring-shaped plate 161 as a single part, protruding from a front side of the ring-shaped plate 161. The ring-shaped plate 161 may have an annular sidewall fixed, e.g., by way of tightly fitting, tolerance fitting, sintered metal bonding or adhesive bonding, to an annular inner wall of the front extension portion 154 of the outer sleeve 15. For a first type of the locking element 16 as seen in FIG. 12*c*, the protrusions 162 extend along radial directions. Fox example, one of the protrusions 162 may be the one 1621 extending along a first radial direction, and another one of the protrusions 162, next to the protrusion 1621, may be the one 1622 extending along a second radial direction, wherein a fan-shaped gap may be formed between the protrusions 1621 and 1622 and an angle between the first and second radial directions may range from 15 to 60 degrees. Alternatively, for a second type of the locking element 16 as seen in FIG. 12*d*, the protrusions 162 extends along radial directions. Fox example, multiple of the protrusions 162 arranged in parallel may be the ones 1623 extending along a first direction, and multiple of the protrusions 162 arranged in parallel may be the ones 1624 extending along a second direction, wherein an angle between the first and second directions may range from 70 to 90 degrees. The locking pin 17, locking element 16 and outer sleeve 15 may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the locking pin 17, locking element 16 and outer sleeve 15.

The assembly for the coaxial cable connector in the eleventh embodiment is similar with the assembly for the coaxial cable connector in the first embodiment. The difference therebetween is that the first inner sleeve 10 is fixed to the nut 13 with the axial through hole 107 being aligned with the axial groove 134. The further difference therebetween is that before the outer sleeve 15 is mounted to the first inner sleeve 10, the locking element 16 may be fixed into the recess portion of the outer sleeve 15 with the ring-shaped plate 161 having the annular sidewall fixed, e.g., by way of tightly fitting, tolerance fitting, sintered metal bonding or adhesive bonding, to the annular inner wall of the front extension portion 154 of the outer sleeve 15. When the outer sleeve 15 is being mounted to the first inner sleeve 10, the rear extension portion 106 is inserted into a through hole 151 in the outer sleeve 15 such that the outer sleeve 15 has an inner flange 152 sleeved around the second cylindrical surface 104 of the first inner sleeve 10. Next, the locking ring 14 is moved into the through hole 151 in the outer sleeve 15 from a rear extension portion 153 of the outer sleeve 15 so as to be fixed in the groove 105 circumferentially formed in the outer cylindrical wall of the first inner sleeve 10. Thereby, the locking ring 14 may abut against the inner flange 152 of the outer sleeve 15 to lock the inner flange 152 around the second cylindrical surface 104 of the first inner sleeve 10 and to prevent the outer sleeve 15 from moving in the axial direction away from the nut 13. Next, the second inner sleeve 11 is moved into the through hole 151 in the outer sleeve 15 from the rear extension portion 153 of the outer sleeve 15 so as to be arranged in an annular space between the first inner sleeve 10 and the outer sleeve 15. The outer flange 111 of the second inner sleeve 11 may have an outer cylindrical surface to be fixed, e.g., by way of tightly fitting, tolerance fitting, sintered metal bonding or adhesive bonding, with an inner cylindrical wall of the outer sleeve 15. The locking ring 14 is arranged between the inner flange 152 of the outer sleeve 15 and the outer flange 111 of the second inner sleeve 11 and to prevent the first inner sleeve 10 from moving in the axial direction relatively to the outer sleeve 15. Next, the locking pin 17 may be inserted from a front side of the nut 13 into the axial through hole 107 and axial groove 134 aligned with each other, wherein locking pin 17 has a front tip protruding frontward from the outer flange 102 of the first inner sleeve 10. The rear extension portion 106 is concentrically surrounded by the rear extension portion 112 that is concentrically surrounded by the rear extension portion 153. When the nut 13 is rotated relatively to the second inner sleeve 11 and the outer sleeve 15, the first inner sleeve 10 may also rotate relatively to both of the second inner sleeve 11 and the outer sleeve 15 due to the rear extension portion 112 having an inner diameter greater than an outer diameter of the rear extension portion 106 and the nut 13 being fixed with the first inner sleeve 10.

Figure 12E:
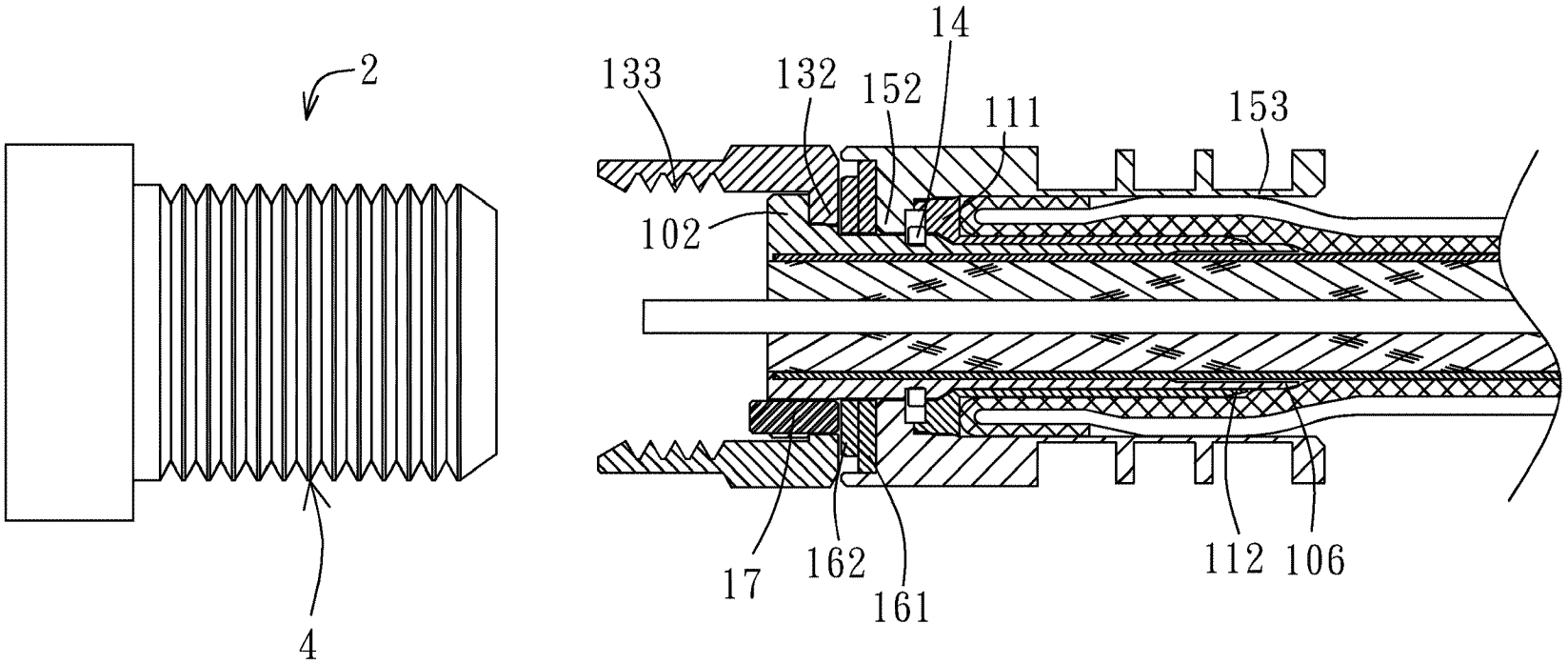
FIGS. 12*e* and 12*f* shows cross-sectional views of the coaxial cable connector before and after assembled with an externally threaded connector in accordance with the eleventh embodiment of the present invention.
Figure 12F:
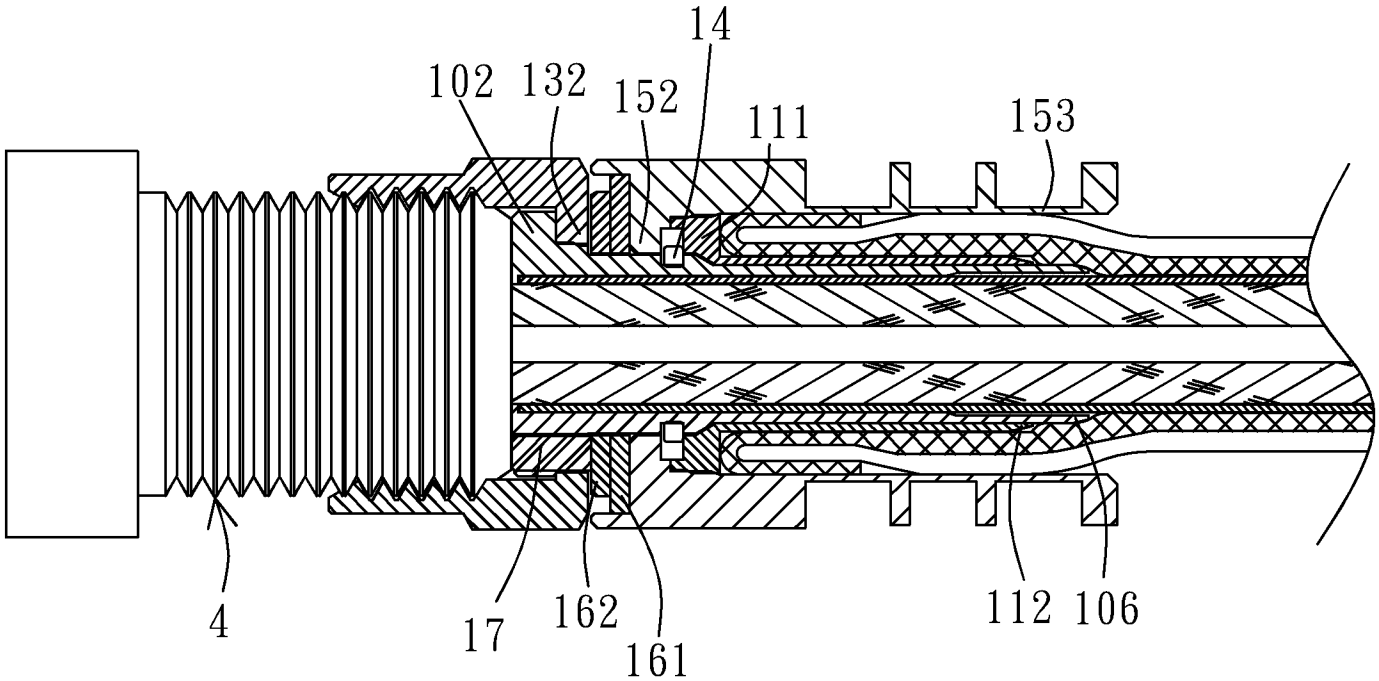

Referring to FIGS. 12*e* and 12*f*, the method for assembling the coaxial cable as illustrated in FIG. 1 with the coaxial cable connector as illustrated in the eleventh embodiment may be referred to that for assembling the coaxial cable with the coaxial cable connector as illustrated in the first embodiment. When the coaxial cable connector assembled with the coaxial cable is mounted to an externally threaded connector 2, the coaxial cable assembled with the coaxial cable connector may have the metal wire 1 to be inserted into a hole in the externally threaded connector 2, and the nut 13 may have the inner thread 133 engaging with the outer thread 4 of the externally threaded connector 2. Further, the inner sleeve 10 and locking pin 17 may be moved in the axial direction to the externally threaded connector 2 such that the locking pin 17 may have a front tip contacting the externally threaded connector 2. When the nut 13 continues to be rotated, the locking pin 17 may be pushed by the externally threaded connector 2 so as to move with its back tip to be inserted into a gap between neighboring two of the protrusions 162. Thereby, the locking element 16 may be engaged with the locking pin 17 so as to restrict the outer sleeve 15 from rotating relatively to the nut 13.

Figure 12H:
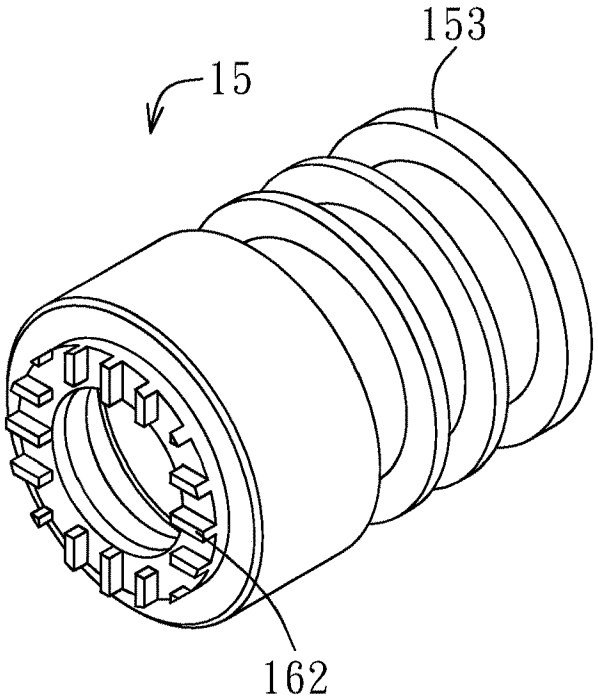
FIG. 12*h* shows a schematically perspective view of the second type of locking element integrally formed with the outer sleeve as a single part in accordance with the eleventh embodiment of the present invention.
Figure 12G:
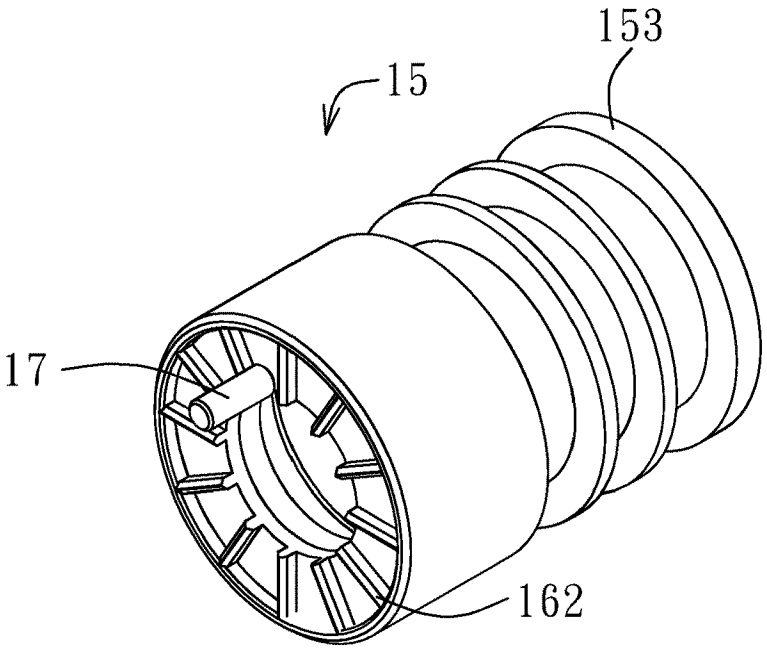
FIG. 12*g* shows a schematically perspective view of the first type of locking element integrally formed with an outer sleeve as a single part in accordance with the eleventh embodiment of the present invention.

Alternatively, the protrusions 162 and the outer sleeve 15 may be integrally formed as a single part, as shown in FIGS. 12*g* and 12*h*. The arrangement of the protrusions 162 may be referred to the illustration for FIGS. 12*c* and 12*d*. The protrusions 162 and the outer sleeve 15 may have the same material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive polymer such as a conductive plastic, or a non-metallic conductor. A rust-proof metal layer, containing copper, iron, silver, nickel, tin or gold, may be electroplated or electroless plated on surface of the single part.

Also, the second inner sleeve 11 may have its rear extension portion 112 to be designed like the rear extension portion 112 of the improved second inner sleeve in the tenth embodiment. The first inner sleeve 10 may have its rear extension portion 106 to be designed like the rear extension portion 106 of the improved first inner sleeve in the tenth embodiment.

Twelfth Embodiment

Figure 13A:
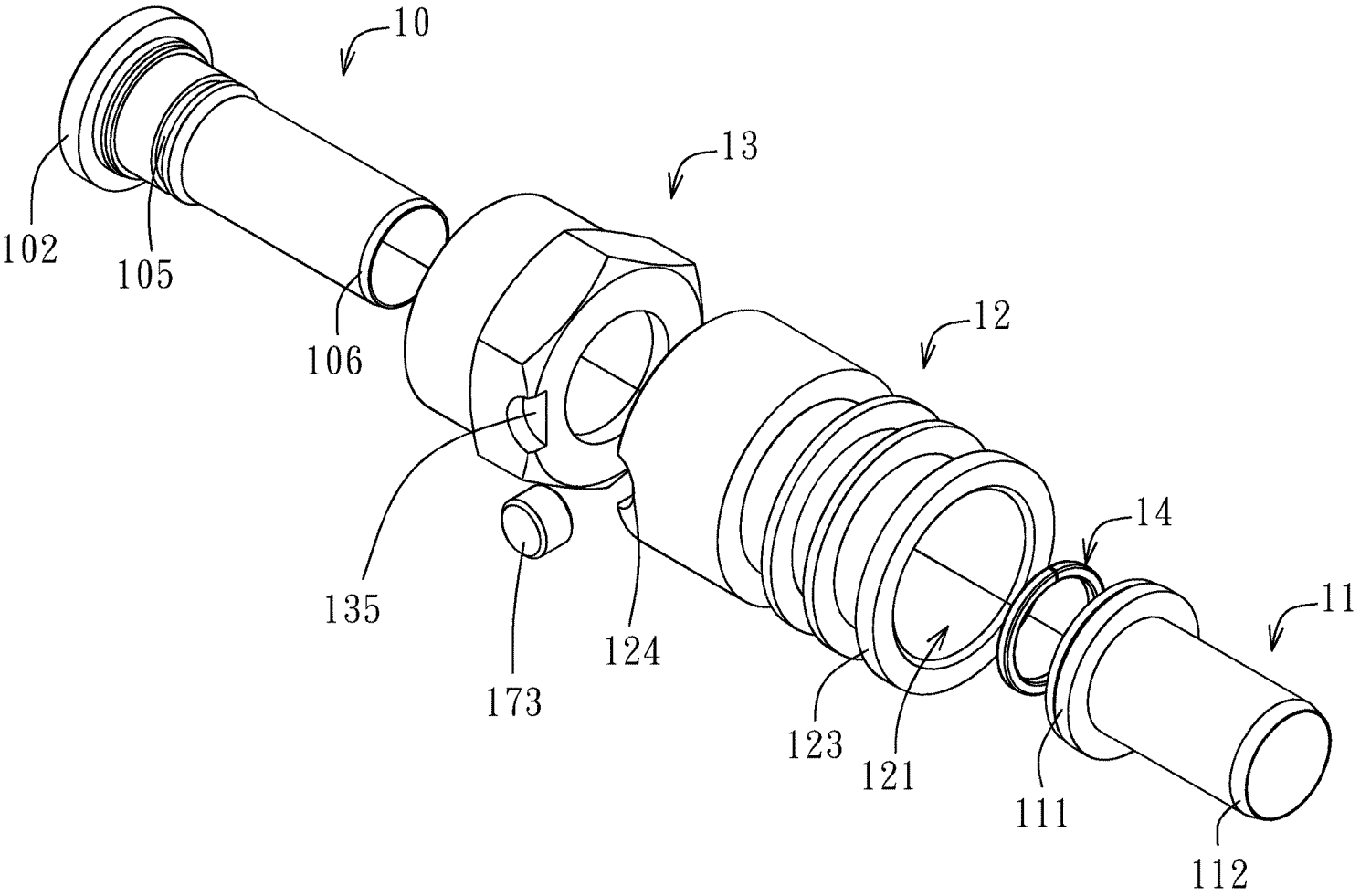
FIG. 13*a* shows a perspective exploded view of a coaxial cable connector in accordance with a twelfth embodiment of the present invention.
Figure 13B:
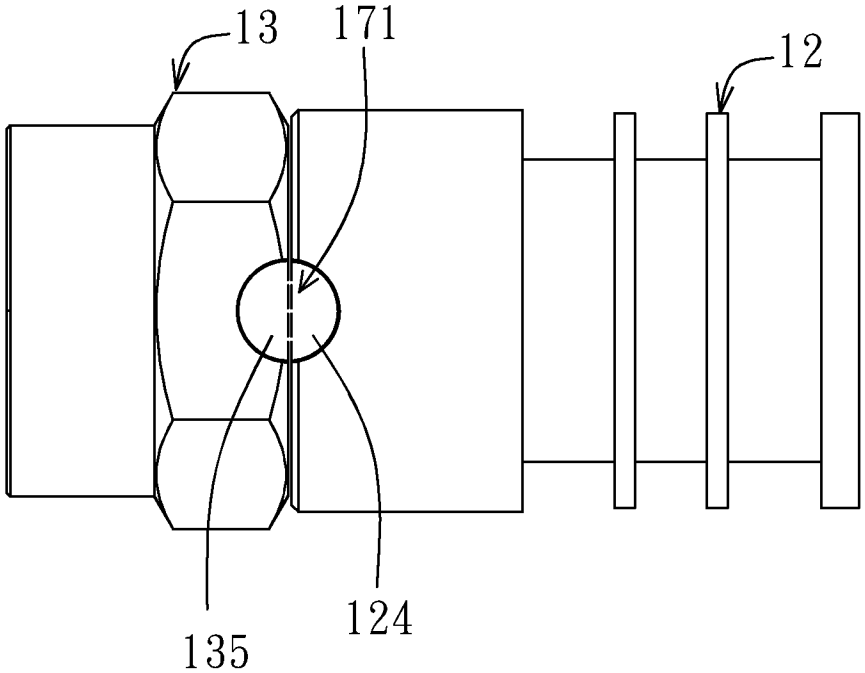
FIG. 13*b* shows a side view of the coaxial cable connector before assembled with a locking pin in accordance with the twelfth embodiment of the present invention.
Figure 13C:
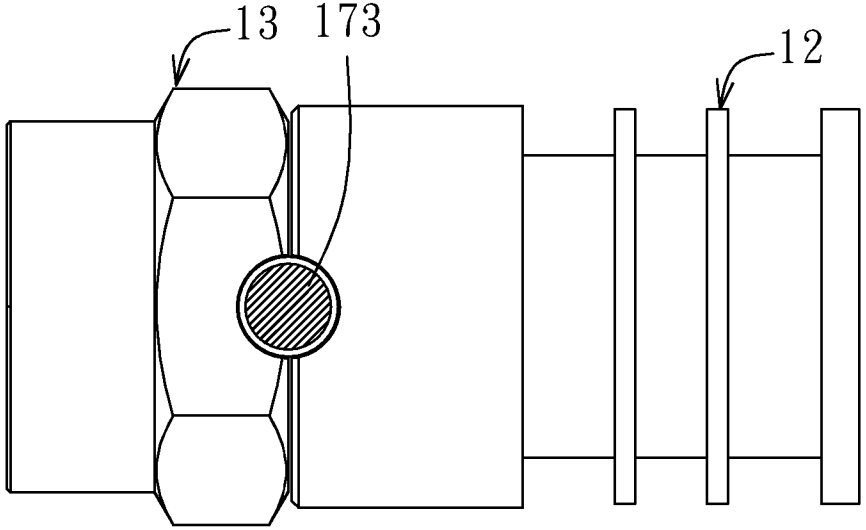
FIG. 13*c* shows a side view of the coaxial cable connector after assembled with the locking pin in accordance with the twelfth embodiment of the present invention.

An element shown in FIGS. 13*a*-13*c* having the same reference number as that illustrated in FIGS. 2*a*-2*g* may be referred to the description for that as illustrated in FIGS. 2*a*-2*g*. FIG. 13*a* shows a perspective exploded view of a coaxial cable connector in accordance with a twelfth embodiment of the present invention. FIG. 13*b* shows a side view of the coaxial cable connector before assembled with a locking pin in accordance with the twelfth embodiment of the present invention. FIG. 13*c* shows a side view of the coaxial cable connector after assembled with the locking pin in accordance with the twelfth embodiment of the present invention. Referring to FIGS. 13*a*, 13*b* and 13*c*, a first recess portion 135 may be formed in an outer wall of the nut 13 and at a rear side of the nut 13, and a second recess portion 124 may be formed in an outer wall of the outer sleeve 12 and at a front side of the outer sleeve 12. The first and second recess portions 135 and 124 of the nut 13 and outer sleeve 12 may form a locking hole 171, which may be shaped like a circle, square, triangle or polygon. When the nut 13 is rotated relatively to the outer sleeve 12 to have the first and second recess portions 135 and 124 to form the locking hole 171, the coaxial cable connector may further include a locking pin 173 to be inserted in the locking hole 171. Thereby, the outer sleeve 12 may be restricted from rotating relatively to the nut 13.

Also, the second inner sleeve 11 may have its rear extension portion 112 to be designed like the rear extension portion 112 of the improved second inner sleeve in the tenth embodiment. The first inner sleeve 10 may have its rear extension portion 106 to be designed like the rear extension portion 106 of the improved first inner sleeve in the tenth embodiment.

Thirteenth Embodiment

Figure 14A:
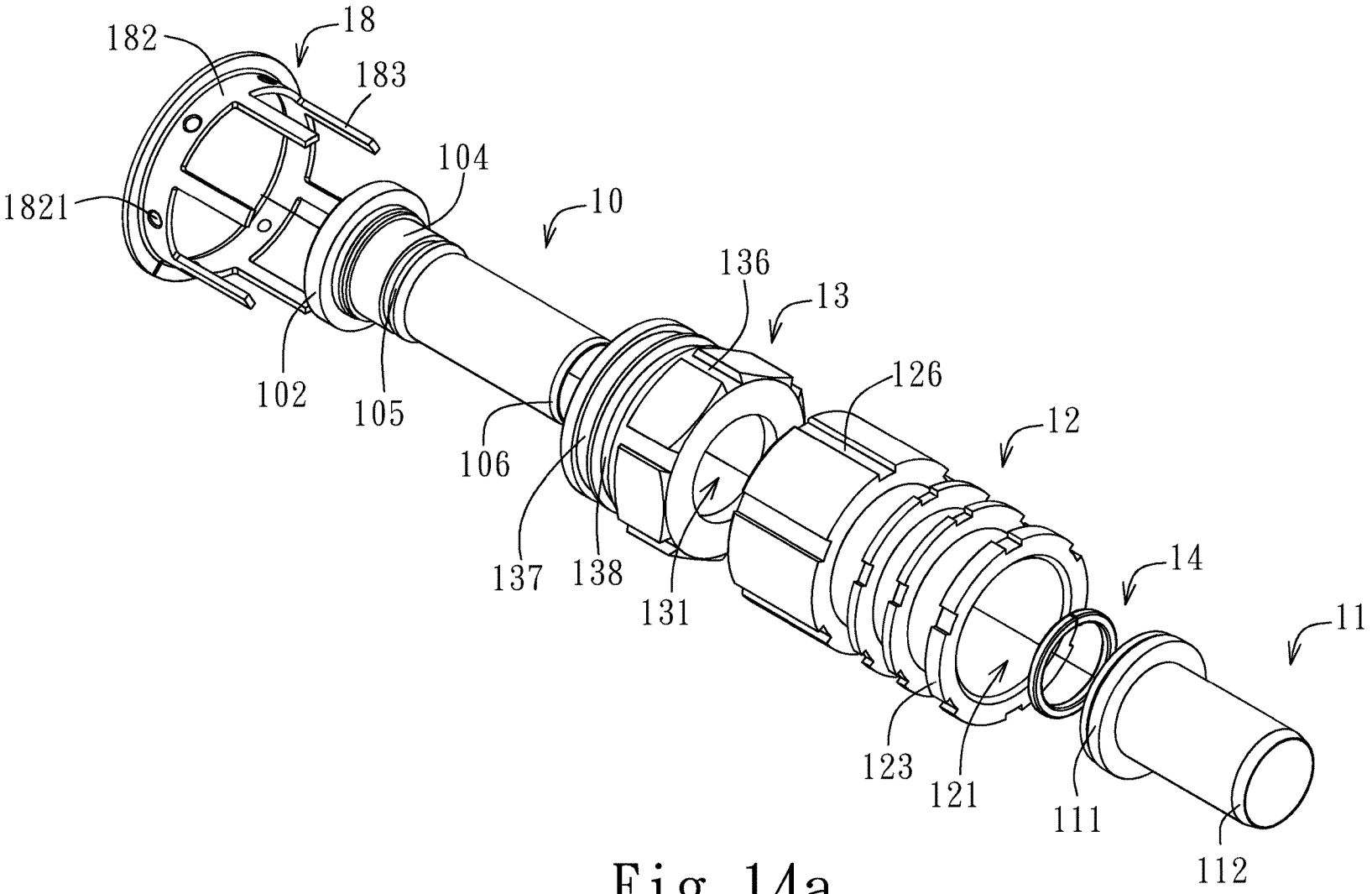
FIG. 14*a* shows a perspective exploded view of a coaxial cable connector in accordance with a thirteenth embodiment of the present invention.
Figure 14B:
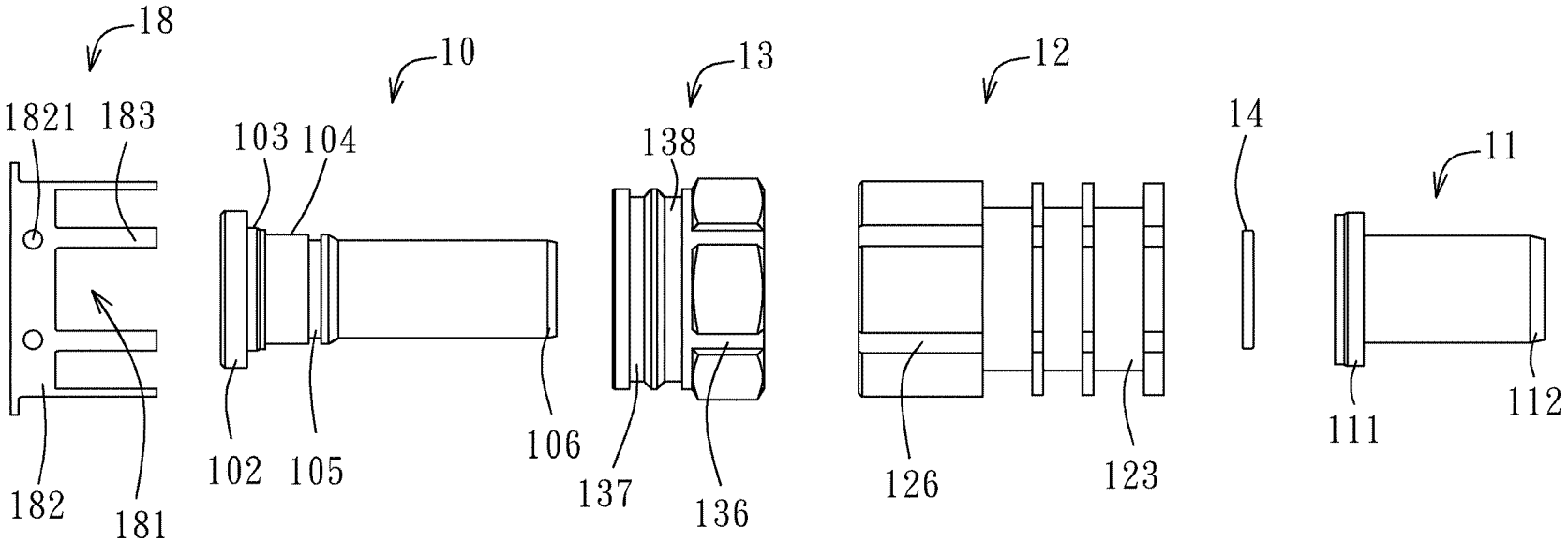
FIG. 14*b* shows a side exploded view of the coaxial cable connector in accordance with the thirteenth embodiment of the present invention.
Figure 14C:
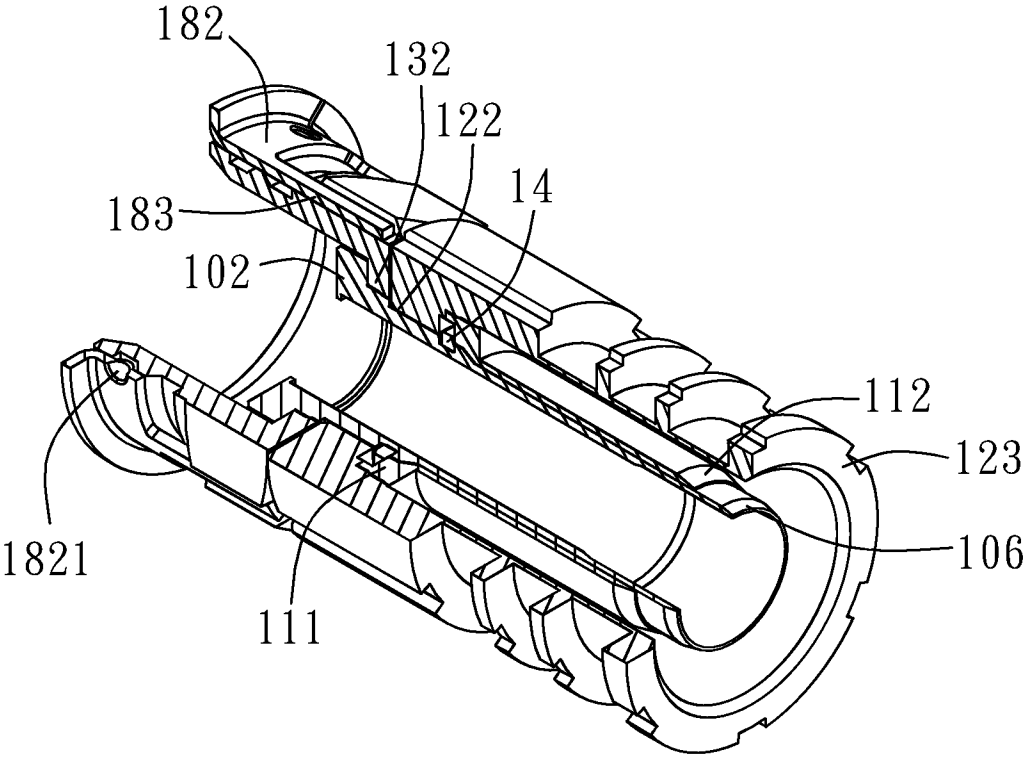
FIG. 14*c* shows a three-quarter cross-sectional perspective view of the coaxial cable connector in accordance with the thirteenth embodiment of the present invention.

An element shown in FIGS. 14*a*-14*e* having the same reference number as that illustrated in FIGS. 2*a*-2*g* may be referred to the description for that as illustrated in FIGS. 2*a*-2*g*. FIG. 14*a* shows a perspective exploded view of a coaxial cable connector in accordance with a thirteenth embodiment of the present invention. FIG. 14*b* shows a side exploded view of the coaxial cable connector in accordance with the thirteenth embodiment of the present invention. FIG. 14*c* shows a three-quarter cross-sectional perspective view of the coaxial cable connector in accordance with the thirteenth embodiment of the present invention. Referring to FIGS. 14*a*-14*c*, the coaxial cable connector may further include a locking element 18 mounted to an outer wall of the nut 13. The locking element 18 includes a ring portion 182 and multiple locking bars 183 integrally formed with the ring portion 182 as a single part. Each of the locking bars 183 extending in parallel and in the axial direction may have a front end joining a rear side of the ring portion 182. Multiple axial grooves 136 in the outer wall of the nut 13 and multiple axial grooves 126 in the outer wall of the outer sleeve 12 may be configured to accommodate the locking bars 183. The locking bars 183 maybe moved frontward in the axial direction relatively to the nut 13 and away from the axial grooves 126 so as to allow the nut 13 to rotate relatively to the outer sleeve 12 and moved backward in the axial direction relatively to the nut 13 and into the axial grooves 126 so as to restrict the nut 13 from rotating relatively to the outer sleeve 12. The locking bars 183 may be arranged with equal intervals on the circular periphery. Multiple annular grooves 137 and 138 in the outer wall of the nut 13 may be configured to receive multiple bumps 1821 of the locking element 18, wherein the bumps 1821 may inwardly protrude from an annular inner wall of the ring portion 182.

Figure 14E:
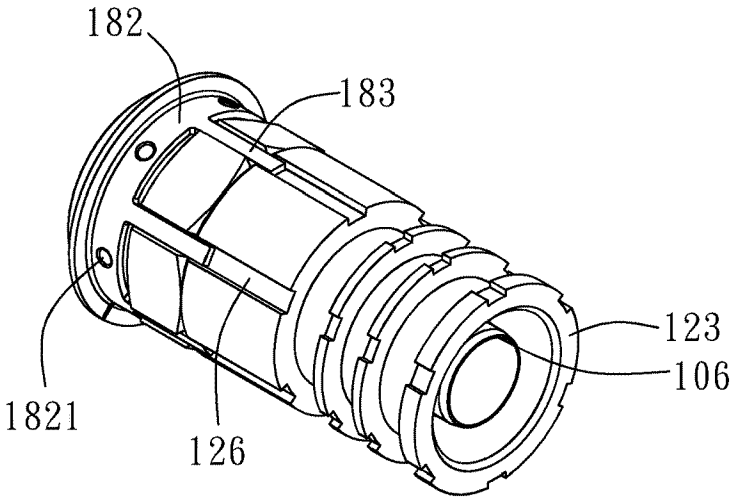
FIGS. 14*d* and 14*e* show perspective views of a locking cylinder of the coaxial cable connector in accordance with the thirteenth embodiment of the present invention.
Figure 14D:
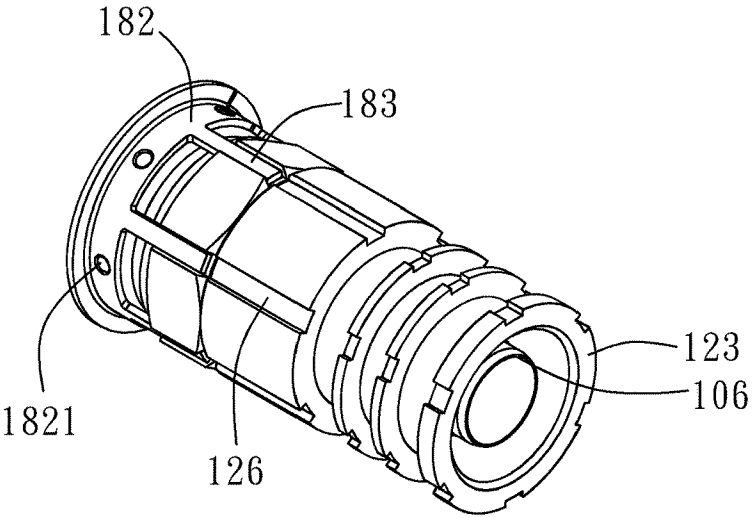

Referring to FIGS. 14*d* and 14*e*, after the coaxial cable connector is mounted to the externally threaded connector 2, the locking element 18 may be moved backward in the axial direction relatively to the nut 13 such that its bumps 1821 may be moved backward in the axial direction from a first state of engagement to the annular groove 137 to a second state of engagement to the annular groove 138 and its locking bars 183 may be moved backward in the axial direction along the axial grooves 136 and into the axial grooves 126 so as to restrict the nut 13 from rotating relatively to the outer sleeve 12. Before the coaxial cable connector is detached from the externally threaded connector 2, the locking element 18 may be moved frontward in the axial direction relatively to the nut 13 such that its bumps 1821 may be moved frontward in the axial direction from the second state to the first state and its locking bars 183 may be moved frontward in the axial direction along the axial grooves 136 and 126 until its locking bars 183 are moved away from the axial grooves 126 so as to allow the nut 13 and the locking element 18 to rotate relatively to the outer sleeve 12.

Also, the second inner sleeve 11 may have its rear extension portion 112 to be designed like the rear extension portion 112 of the improved second inner sleeve in the tenth embodiment. The first inner sleeve 10 may have its rear extension portion 106 to be designed like the rear extension portion 106 of the improved first inner sleeve in the tenth embodiment.

Fourteenth Embodiment

Figure 15A:
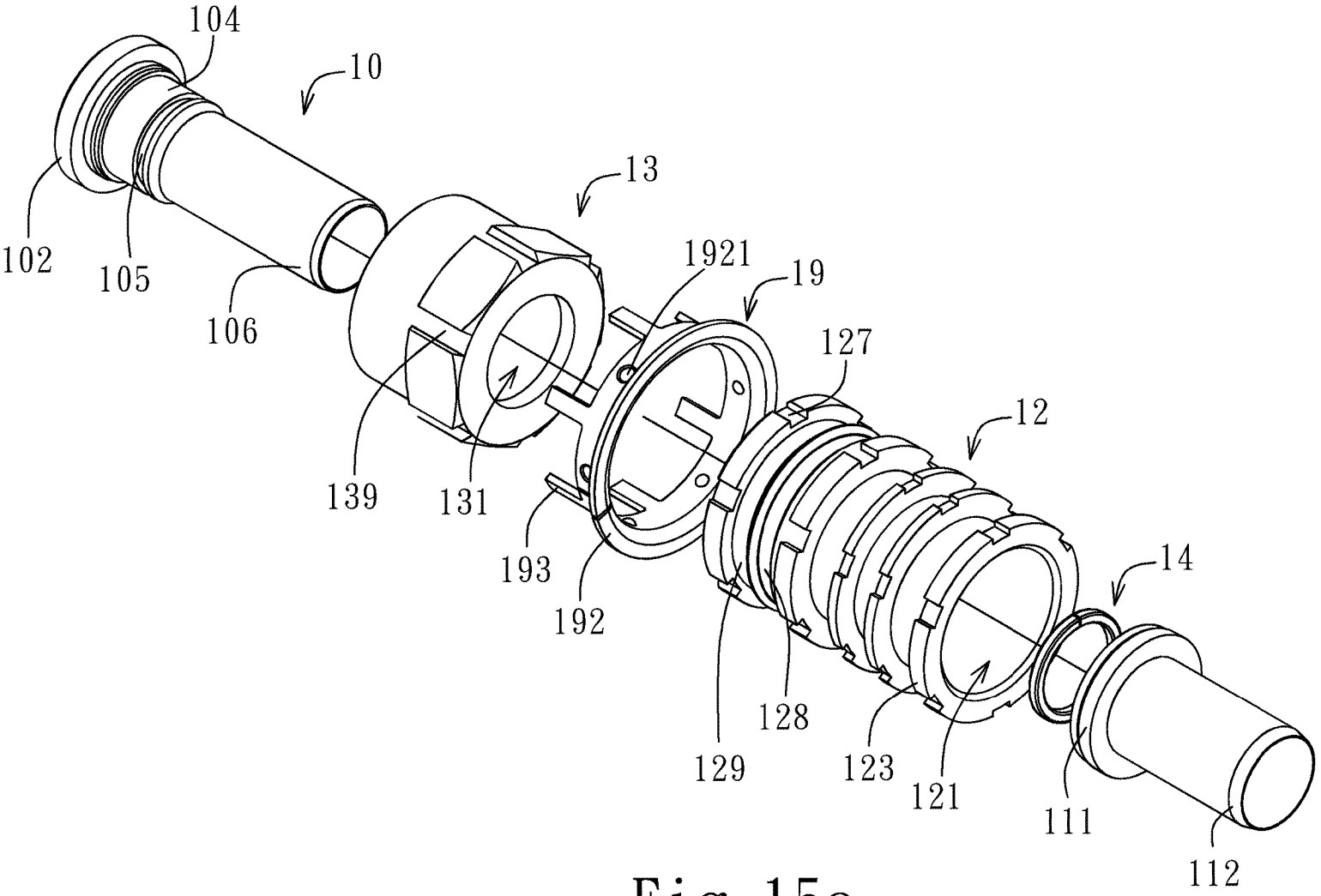
FIG. 15*a* shows a perspective exploded view of a coaxial cable connector in accordance with a fourteenth embodiment of the present invention.
Figure 15B:
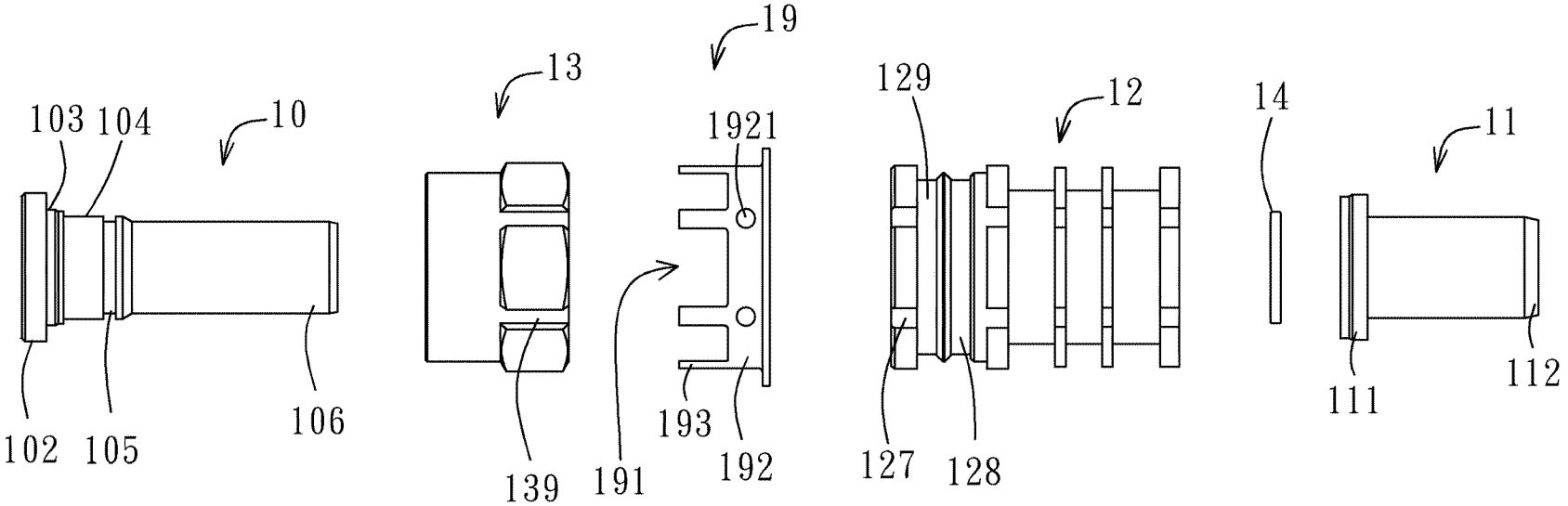
FIG. 15*b* shows a side exploded view of the coaxial cable connector in accordance with the fourteenth embodiment of the present invention.
Figure 15C:
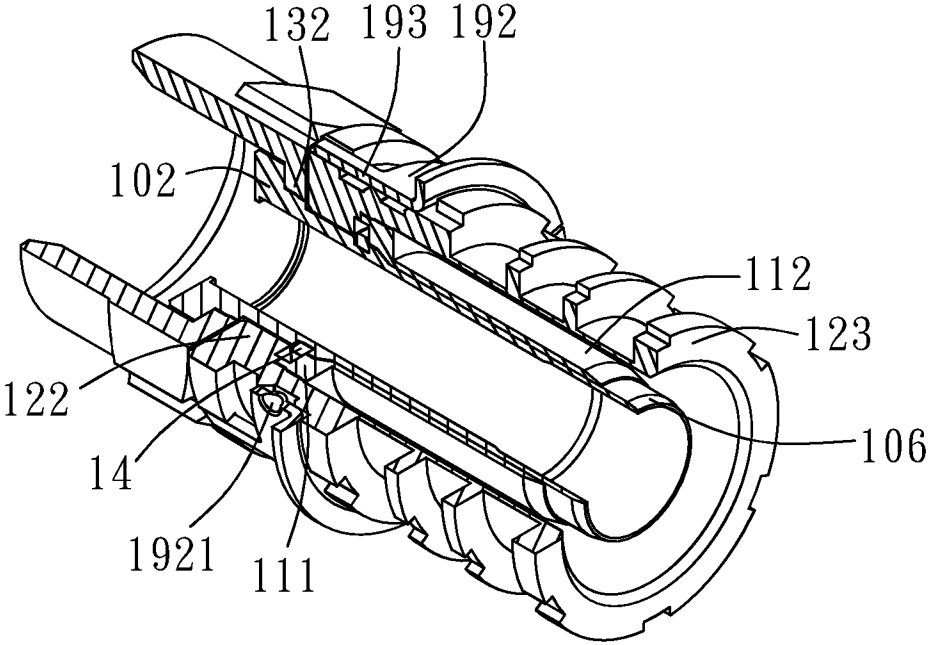
FIG. 15*c* shows a three-quarter cross-sectional perspective view of the coaxial cable connector in accordance with the fourteenth embodiment of the present invention.

An element shown in FIGS. 15*a*-15*e* having the same reference number as that illustrated in FIGS. 2*a*-2*g* may be referred to the description for that as illustrated in FIGS. 2*a*-2*g*. FIG. 15*a* shows a perspective exploded view of a coaxial cable connector in accordance with a fourteenth embodiment of the present invention. FIG. 15*b* shows a side exploded view of the coaxial cable connector in accordance with the fourteenth embodiment of the present invention. FIG. 15*c* shows a three-quarter cross-sectional perspective view of the coaxial cable connector in accordance with the fourteenth embodiment of the present invention. Referring to FIGS. 15*a*-15*c*, the coaxial cable connector may further include a locking element 19 mounted to an outer wall of the outer sleeve 12. The locking element 19 includes a ring portion 192 and multiple locking bars 193 integrally formed with the ring portion 192 as a single part. Each of the locking bars 193 extending in parallel and in the axial direction may have a rear end joining a front side of the ring portion 189. Multiple axial grooves 139 in the outer wall of the nut 13 and multiple axial grooves 127 in the outer wall of the outer sleeve 12 may be configured to accommodate the locking bars 193. The locking bars 193 maybe moved backward in the axial direction relatively to the nut 13 and away from the axial grooves 139 so as to allow the nut 13 to rotate relatively to the outer sleeve 12 and moved frontward in the axial direction relatively to the nut 13 and into the axial grooves 139 so as to restrict the nut 13 from rotating relatively to the outer sleeve 12. The locking bars 193 may be arranged with equal intervals on the circular periphery. Multiple annular grooves 128 and 129 in the outer wall of the outer sleeve 12 may be configured to receive multiple bumps 1921 of the locking element 19, wherein the bumps 1921 may inwardly protrude from an annular inner wall of the ring portion 192.

Figure 15E:
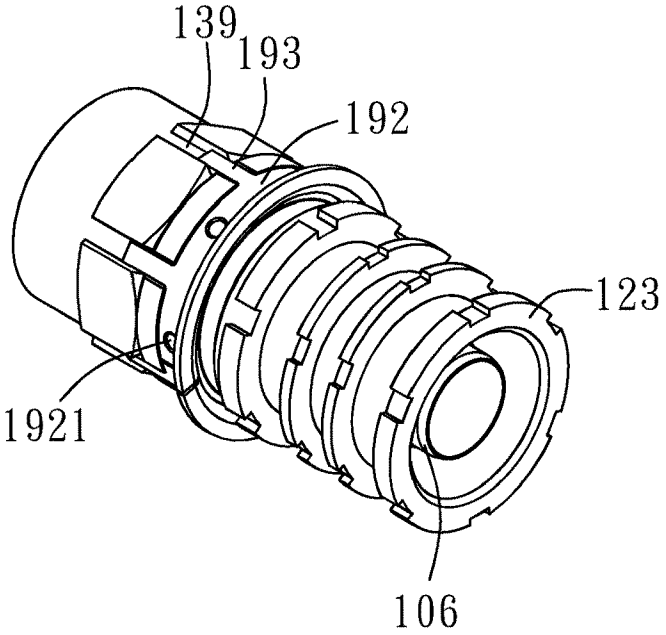
FIGS. 15*d* and 15*e* show perspective views of a locking cylinder of the coaxial cable connector in accordance with the fourteenth embodiment of the present invention.
Figure 15D:
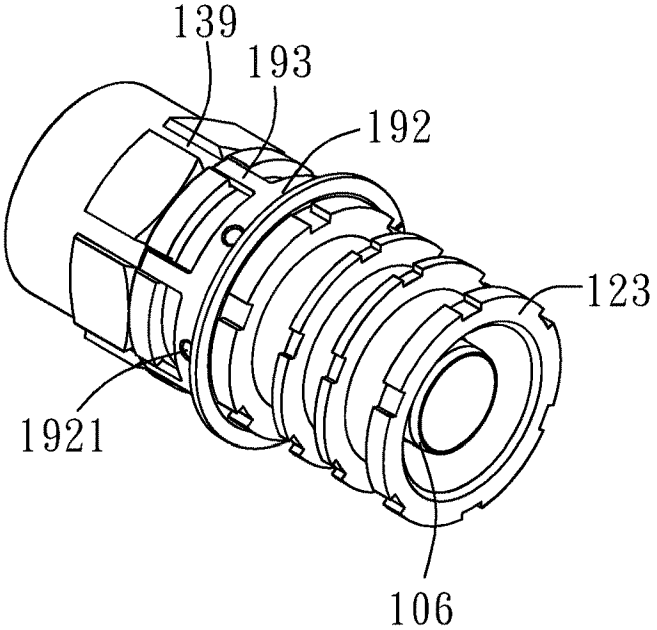

Referring to FIGS. 15*d* and 15*e*, after the coaxial cable connector is mounted to the externally threaded connector 2, the locking element 19 may be moved frontward in the axial direction relatively to the nut 13 such that its bumps 1921 may be moved frontward in the axial direction from a first state of engagement to the annular groove 128 to a second state of engagement to the annular groove 129 and its locking bars 193 may be moved frontward in the axial direction along the axial grooves 127 and into the axial grooves 139 so as to restrict the nut 13 from rotating relatively to the outer sleeve 12. Before the coaxial cable connector is detached from the externally threaded connector 2, the locking element 19 may be moved backward in the axial direction relatively to the nut 13 such that its bumps 1921 may be moved backward in the axial direction from the second state to the first state and its locking bars 193 may be moved backward in the axial direction along the axial grooves 139 and 127 until its locking bars 193 are moved away from the axial grooves 139 so as to allow the nut 13 to rotate relatively to the outer sleeve 12 and the locking element 19.

The components, steps, features, benefits and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, benefits and advantages. These also include embodiments in which the components and/or steps are arranged and/or ordered differently.

Also, the second inner sleeve 11 may have its rear extension portion 112 to be designed like the rear extension portion 112 of the improved second inner sleeve in the tenth embodiment. The first inner sleeve 10 may have its rear extension portion 106 to be designed like the rear extension portion 106 of the improved first inner sleeve in the tenth embodiment.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A coaxial cable connector configured to be mounted to an externally threaded connector and to have a coaxial cable to be assembled therewith, comprising:

a nut portion having an inner thread configured to engage with an outer thread of said externally threaded connector, wherein said nut portion has a first retaining structure comprising a first groove-shaped structure arranged at an outer periphery of said nut portion;

an inner-sleeve portion coaxially arranged with said nut portion;

a first sleeve coaxially arranged with said nut portion, wherein said first sleeve comprises an inner flange radially on an outer wall of said inner-sleeve portion, wherein said first sleeve has a second retaining structure comprising a second groove-shaped structure arranged at an outer periphery of said first sleeve and configured to align with said first groove-shaped structure; and a locking element comprising a locking structure configured to be arranged in said first and second retaining structures to have said nut portion not to rotate relatively to said first sleeve, wherein said locking structure comprises a first bar configured to move in said first and second groove-shaped structures.

2. The coaxial cable connector of claim 1, wherein said first retaining structure comprise a third groove-shaped structure arranged at said outer periphery of said nut portion, said second retaining structure comprises a fourth groove-shaped structure arranged at said outer periphery of said first sleeve and configured to align with said third groove-shaped structure, wherein said locking structure comprises a second bar configured to move in said third and fourth groove-shaped structures.

3. The coaxial cable connector of claim 2, wherein said locking element comprises a ring portion around said nut portion, wherein said first and second bars axially couple to said ring portion.

4. The coaxial cable connector of claim 3, wherein said locking element comprises multiple bumps inwardly protruding from an annular inner wall of said ring portion, wherein a first annular groove at said outer periphery of said nut portion is configured to receive said bumps.

5. The coaxial cable connector of claim 4, wherein a second annular groove at said outer periphery of said nut portion is configured to receive said bumps, wherein said first and second annular grooves are arranged annularly in parallel.

6. The coaxial cable connector of claim 2, wherein said locking element comprises a ring portion around said first sleeve, wherein said first and second bars axially couple to said ring portion.

7. The coaxial cable connector of claim 6, wherein said locking element comprises multiple bumps inwardly protruding from an annular inner wall of said ring portion, wherein a first annular groove at said outer periphery of said first sleeve is configured to receive said bumps.

8. The coaxial cable connector of claim 7, wherein a second annular groove at said outer periphery of said first sleeve is configured to receive said bumps, wherein said first and second annular grooves are arranged annularly in parallel.

9. The coaxial cable connector of claim 1, wherein said first and second groove-shaped structures and said first bar extend in an axial direction.

10. The coaxial cable connector of claim 1, wherein said inner-sleeve portion is tightly fixed with said nut portion.

11. The coaxial cable connector of claim 1, wherein said inner-sleeve portion is integrally formed with said nut portion as a single part.

12. The coaxial cable connector of claim 1 further comprising a second sleeve coaxially arranged with said first sleeve, wherein said second sleeve has an outer flange having an outer cylindrical surface tightly fixed with an inner wall of said first sleeve, wherein an annular space between said first and second sleeves is configured to accommodate a jacket of said coaxial cable such that said jacket is configured to surround an outer surface of said second sleeve and said first sleeve is configured to surround said jacket.

13. A coaxial cable connector configured to be mounted to an externally threaded connector and to have a coaxial cable to be assembled therewith, comprising:

a nut portion having an inner thread configured to engage with an outer thread of said externally threaded connector;

an inner-sleeve portion coaxially arranged with said nut portion;

a first sleeve coaxially arranged with said nut portion, wherein said first sleeve comprises an inner flange radially on an outer wall of said inner-sleeve portion; and a second sleeve coaxially arranged with said first sleeve, wherein said second sleeve has an outer flange having an outer cylindrical surface tightly fixed in contact with an inner wall of said first sleeve, wherein an annular space between said first and second sleeves is configured to accommodate a jacket of said coaxial cable such that said jacket is configured to surround an outer surface of said second sleeve and said first sleeve is configured to surround said jacket.

14. The coaxial cable connector of claim 13, wherein said inner-sleeve portion is tightly fixed with said nut portion.

15. The coaxial cable connector of claim 13, wherein said coaxial cable comprises a metal wire, an insulating layer enclosing said metal wire and a metal film enclosing said insulating layer, wherein said jacket is arranged around said metal film, wherein said second sleeve is configured to be sleeved around said metal wire, insulating layer and metal film of said coaxial cable, wherein said inner-sleeve portion is configured to be sleeved around said metal wire, insulating layer and metal film of said coaxial cable and contact said metal film.

16. The coaxial cable connector of claim 13, wherein a space between said inner-sleeve portion and said first sleeve receives a portion of said outer flange.

17. The coaxial cable connector of claim 13, wherein said second sleeve has an inner diameter substantially equal to that of said inner-sleeve portion.

18. The coaxial cable connector of claim 13, wherein said inner-sleeve portion is integrally formed with said nut portion as a single part.

19. The coaxial cable connector of claim 13, wherein said second sleeve has a first inner diameter at a radially inner side of said outer flange and a second inner diameter configured to be at a radially inner side of said jacket, wherein said first inner diameter is greater than said second inner diameter.

* * * * *